US007727692B2

(12) United States Patent
Yamada et al.

(10) Patent No.: US 7,727,692 B2
(45) Date of Patent: Jun. 1, 2010

(54) ELECTROPHOTOGRAPHIC PHOTORECEPTOR, IMAGE FORMING APPARATUS, AND PROCESS CARTRIDGE

(75) Inventors: Wataru Yamada, Kanagawa (JP); Katsumi Nukada, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 369 days.

(21) Appl. No.: 11/714,895

(22) Filed: Mar. 7, 2007

(65) Prior Publication Data

US 2008/0031642 A1 Feb. 7, 2008

(30) Foreign Application Priority Data

Jul. 6, 2006 (JP) ..... 2006-187037

(51) Int. Cl.
*G03G 15/05* (2006.01)

(52) U.S. Cl. ..... 430/69; 430/78

(58) Field of Classification Search ..... 430/69, 430/78

See application file for complete search history.

(56) References Cited

U.S. PATENT DOCUMENTS 5,352,555 A * 10/1994 Yagi et al. ..... 430/62
2003/0194625 A1* 10/2003 Tanaka et al. ..... 430/58.8

FOREIGN PATENT DOCUMENTS

| | | | |
|---|---|---|---|
| CN | 1759349 A | | 4/2006 |
| EP | 1688465 | * | 9/2006 |
| JP | A 11-38656 | | 2/1999 |
| JP | A 2002-6527 | | 1/2002 |
| JP | A 2002-82466 | | 3/2002 |
| JP | A 2002-82469 | | 3/2002 |
| JP | A 2003-186215 | | 7/2003 |
| JP | A 2003-186234 | | 7/2003 |

* cited by examiner

*Primary Examiner*—John L Goodrow
(74) *Attorney, Agent, or Firm*—Oliff & Berridge, PLC

(57) ABSTRACT

An electrophotographic photoreceptor comprises: an electroconductive support; and a photosensitive layer on the electroconductive support, wherein the photosensitive layer comprises a functional layer, the functional layer comprising: a compound having a triple bond and a hydroxyl group in a molecule; and a cured product of a curable resin.

16 Claims, 11 Drawing Sheets

ELECTROPHOTOGRAPHIC PHOTORECEPTOR, IMAGE FORMING APPARATUS, AND PROCESS CARTRIDGE

CROSS-REFERENCE TO RELATED APPLICATIONS

This application is based on and claims priority under 35 USC 119 from Japanese Patent Application No. 2006-187037 filed on Jul. 6, 2006.

BACKGROUND (i) Technical Field

The present invention relates to an electrophotographic photoreceptor, an image forming apparatus, and a process cartridge.

(ii) Related Art

An image forming apparatus of a xerography system has an electrophotographic photoreceptor (which is hereinafter referred simply to as a photoreceptor in some cases), a charging device, an exposing device, a developing device and a transferring device, and forms an image through an electrophotographic process using the devices.

In recent years, an image forming apparatus of a xerography system is improved in speed and service life through progress in technology of the constitutional members and the systems. Associated therewith, the subsystems are increasingly demanded to attain high speed operation and high reliability. In particular, a photoreceptor used for writing an image and a cleaning member for cleaning the photoreceptor are highly demanded to attain high speed operation and high reliability. The photoreceptor and the cleaning member receives larger stress through friction therebetween than the other members. Accordingly, the photoreceptor suffers from damages and abrasion, which cause image defects.

Therefore, in order to improve the service life of the photoreceptor, it is significantly important to suppress damages and abrasion from occurring, and the use of a curable resin is being considered from the standpoint of improving the mechanical strength of the photosensitive layer.

SUMMARY

The electrophotographic photoreceptor of the invention in one aspect contains an electroconductive support and a photosensitive layer on the electroconductive support. The photosensitive layer contains a functional layer. The functional layer contains a compound having a triple bond and a hydroxyl group in a molecule and a cured product of a curable resin.

DETAILED DESCRIPTION

Figure 1:
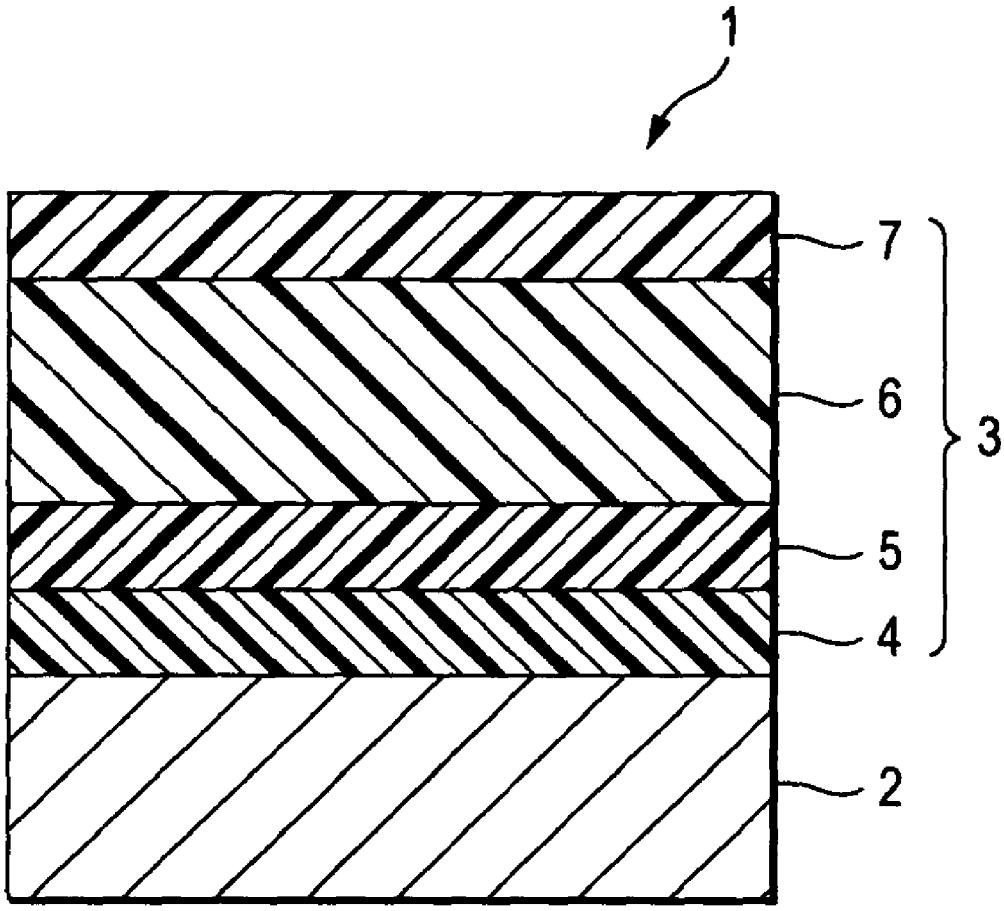
FIG. 1 is a schematic cross sectional view of an exemplary embodiment of the electrophotographic photoreceptor of the invention.

Exemplary embodiments of the invention will be described in detail below with reference to the drawings. In the drawings, the same symbols are attached to the same or equivalent members to omit duplicate explanations.

(Electrophotographic Photoreceptor)

FIG. 1 is a schematic cross sectional view of an exemplary embodiment of the electrophotographic photoreceptor of the invention. An electrophotographic photoreceptor 1 shown in FIG. 1 has a function-separated photosensitive layer 3 having a charge transporting layer 6 and a charge generating layer 5 separately. More specifically, the electrophotographic photoreceptor 1 has such a structure that contains an electroconductive support 2 having accumulated thereon in this order an undercoating layer 4, a charge generating layer 5, a charge transporting layer 6 and a protective layer 7. The protective layer 7 is a functional layer containing a compound having a triple bond and a hydroxyl group in a molecule and a cured product of a curable resin.

The constitutional members of the electrophotographic photoreceptor 1 will be described in detail below.

Examples of the electroconductive support 2 include a metallic plate, a metallic drum and a metallic belt using a metal or an alloy, such as aluminum, copper, zinc, stainless steel, chromium, nickel, molybdenum, vanadium, indium, gold and platinum, and paper and a plastic film or belt having coated, vapor-deposited or laminated thereon an electroconductive polymer, an electroconductive compound, such as indium oxide, or a metal or an alloy, such as aluminum, palladium and gold.

In order to prevent interference fringes formed upon irradiating with laser light from occurring, the surface of the electrophotographic support 2 is preferably roughened. The roughness thereof is preferably from 0.04 to 0.5 μm in terms of center line average roughness Ra. In the case where Ra is less than 0.04 μm, it is not preferred since the effect of preventing interference cannot be obtained due to a surface equivalent to a mirror surface is obtained, and in the case where Ra exceeds 0.5 μm, it is not preferred since the image quality is roughened even though the films according to an aspect of the invention are provided.

The method for roughening the surface of the electrophotographic photoreceptor 2 is preferably a wet horning method of spraying an abrasive suspended in water, a centerless polishing method of polishing the surface continuously by pressing the support onto rotating grind stone, and an anodic oxidation method. Such a method is also preferably used that a layer having electroconductive or semi-electroconductive powder dispersed therein is formed on the surface of the electroconductive support, but the surface itself is not roughened, whereby a roughened surface is obtained with the particles dispersed in the layer.

In the anodic oxidation method, anodic oxidation is carried out with aluminum as an anode in an electrolytic solution to form an oxidized film on the surface of aluminum. Examples of the electrolytic solution include a sulfuric acid solution and an oxalic acid solution. The porous anodically oxidized film obtained is chemically active as it is and is liable to be contaminated and suffer from change in resistance depending on environments. Accordingly, a sealing treatment is carried out, in which the fine pores of the anodically oxidized film are clogged by volume expansion through hydration reaction with pressurized steam or boiling water (in which a metallic salt, such as nickel salt, may be added), so as to form a stable hydrated oxide.

The thickness of the anodically oxidized film is preferably from 0.3 to 15 μm. In the case where the thickness thereof is less than 0.3 μm, sufficient effect cannot be obtained due to poor barrier property against injection. In the case where the thickness exceeds 15 μm, the residual potential may be increased upon repeated use.

The treatment with an acidic treating solution containing phosphoric acid, chromic acid and hydrofluoric acid may be carried out as follows. The mixing ratio of phosphoric acid, chromic acid and hydrofluoric acid in the acidic treating solution is preferably a range of from 10 to 11% by weight for phosphoric acid, a range of from 3 to 5% by weight for chromic acid, a range of from 0.5 to 2% by weight for hydrofluoric acid, and a range of from 13.5 to 18% by weight for the total concentration of the acids. The treating temperature may be from 42 to 48° C., and a thicker film can be formed rapidly at a higher temperature maintained. The thickness of the film is preferably from 0.3 to 15 μm. In the case where the thickness is less than 0.3 μm, it is insufficient in effect due to poor barrier property against injection. In the case where the thickness exceeds 15 μm, the residual potential may be increased upon repeated use.

The boehmite treatment may be carried out by immersing in pure water at 90 to 100° C. for 5 to 60 minutes, or making in contact with heated steam at 90 to 120° C. for 5 to 60 minutes. The thickness of the film is preferably from 0.1 to 5 μm. The film may be further subjected to an anodic oxidation treatment by using an electrolytic solution having low solubility of the film, such as adipic acid, boric acid, a borate salt, a phosphate salt, aphthalate salt, a maleate salt, abenzoate salt, atartrate salt and a citrate salt.

In the case where a light source emitting incoherent light is used, there is no necessity of roughening for preventing interference fringes, and defects due to unevenness on the surface of the electroconductive support 2 can be prevented from occurring, which is suitable for prolonging the service life.

The undercoating layer 4 may be provided depending on necessity, and in the case where the electroconductive support 2 has been subjected to the acidic solution treatment or the boehmite treatment, in particular, the undercoating layer 4 is preferably provided since the defect hiding power of the electroconductive support 2 might be lowered.

Examples of the material used for forming the undercoating layer 4 include an organic zirconium compound, such as a zirconium chelate compound, a zirconium alkoxide compound and a zirconium coupling agent, an organic titanium compound, such as a titanium chelate compound, a titanium alkoxide compound and a titanate coupling agent, an organic aluminum compound, such as an aluminum chelate compound and an aluminum coupling agent, and an organic metallic compound, such as an antimony alkoxide compound, a germanium alkoxide compound, an indium alkoxide compound, an indium chelate compound, a manganese alkoxide compound, a manganese chelate compound, a tin alkoxide compound, a tin chelate compound, an aluminum silicon alkoxide compound, an aluminum titanium alkoxide compound and an aluminum zirconium alkoxide compound, and in particular, an organic zirconium compound, an organic titanyl compound and an organic aluminum compound are preferably used since they have a low residual potential to provide favorable electrophotographic characteristics.

The undercoating layer 4 may further contain a silane coupling agent. Examples of the silane coupling agent include vinyltrichlorosilane, vinyltrimethoxysilane, vinyltriethoxysilane, vinyl-tris-2-methoxysilane, vinyltriacetoxysilane, γ-glycidoxypropyltrimethoxysilane, γ-methacryloxypropyltrimethoxysilane, γ-aminopropyltriethoxysilane, γ-chloropropyltrimethoxysilane, γ-2-aminoethylaminopropyltrimethoxysilane, γ-mercaptopropytrimethoxysilane, γ-ureidopropyltriethoxysilane and β-3,4-epoxycyclohexyltrimethoxysilane. The mixing ratio of the silane coupling agent may be determined depending on necessity.

The undercoating layer 4 may further contain a binder resin. Examples of the binder resin include such known binder resins, such as polyvinyl alcohol, polyvinylmethyl cellulose, poly-N-vinylimidazole, polyethylene oxide, ethyl cellulose, methyl cellulose, an ethylene-acrylic acid copolymer, polyamide, polyimide, casein, gelatin, polyethylene, polyester, a phenol resin, a vinyl chloride-vinyl acetate copolymer, an epoxy resin, polyvinylpyrrolidone, polyvinylpyridine, polyurethane, polyglutamic acid and polyacrylic acid. The mixing ratio of the binder resin may be determined depending on necessity.

The undercoating layer 4 may further contain an electron transporting pigment from the standpoint of decreasing the residual potential and improving the environmental stability. Examples of the electron transporting pigment include an organic pigment, such as a perylene pigment disclosed in JP-A-47-30330, a bisbenzimidazoleperylene pigment, a polycyclic quinone pigment, an indigo pigment and a quinacridone pigment, an organic pigment, such as a bisazo pigment and a phthalocyanine pigment, which have an electron attracting substituent, such as a cyano group, a nitro group, a nitroso group and a halogen atom, and an inorganic pigment, such as zinc oxide and titanium oxide. Among these pigments, a perylene pigment, a bisbenzimidazoleperylene pigment, a polycyclic quinone pigment, zinc oxide and titanium oxide are preferably used owing to the high electron mobility. The surface of the pigment may be treated with the aforementioned coupling agent or the binder resin for the purpose of controlling the dispersibility and the charge transporting property. In the case where the amount of the electron transporting pigment is too large, the strength of the undercoating layer is decreased to cause defects in the coated film, and the amount thereof may be 95% by weight or less, and preferably 90% by weight or less.

The undercoating layer 4 may further contain fine powder of an organic compound or fine powder of an inorganic compound from the standpoint of improving the electric characteristics and the light scattering property. Particularly effective examples thereof include a white pigment, such as titanium oxide, zinc oxide, zinc flower, zinc sulfide, lead white and lithopone, an inorganic pigment as a body pigment, such as alumina, calcium carbonate and barium sulfate, polyethylene terephthalate resin particles, benzoguanamine resin particles and styrene resin particles. The particle diameter of the fine powder added may be from 0.01 to 2 μm. The fine powder may be added depending on necessity, and the addition amount thereof is preferably from 10 to 90% by weight, and more preferably from 30 to 80% by weight, with respect to the total weight of the solid content of the undercoating layer 4.

The undercoating layer 4 may be formed by coating a coating composition containing the aforementioned constitutional materials on the electroconductive support 2 and then drying. As a solvent used in the coating composition for forming the undercoating layer 4, as an organic solvent, for example, any organic solvent may be used that dissolves the organic metallic compound and the resin and does not cause gelation or aggregation upon mixing or dispersing the electron transporting pigment. Examples of the organic solvent include methanol, ethanol, n-propanol, n-butanol, benzyl alcohol, methyl cellosolve, ethyl cellosolve, acetone, methyl ethyl ketone, cyclohexanone, methyl acetate, n-butyl acetate, dioxane, tetrahydrofuran, methylene chloride, chloroform, chlorobenzene and toluene, which may be used solely or a mixture of two or more thereof. Examples of the dispersing method of the coating composition include a roll mill, a ball mill, a vibration ball mill, an attritor, a sand mill, a colloid mill, a paint shaker and an ultrasonic wave. Examples of the coating method of the coating composition include such ordinary coating methods as a blade coating method, a wire bar coating method, a spray coating method, a dip coating method, a bead coating method, an air knife coating method and a curtain coating method. The coating composition after coating is dried at a temperature where the solvent can be evaporated to form a film. The thickness of the undercoating layer 4 is generally from 0.01 to 30 μm, and preferably from 0.05 to 25 μm.

The charge generating layer 5 contains a charge generating material and a binder resin. Examples of the charge generating material include known pigments, for example, an organic pigment, such as an azo pigment, e.g., a bisazo pigment and a trisazo pigment, a condensed ring aromatic pigment, e.g., a dibromoanthanthrone pigment, a perylene pigment, a pyrrolopyrrole pigment, and a phthalocyanine pigment, and an inorganic pigment, such as trigonal selenium and zinc oxide, and in the case where exposure light having a wavelength of from 380 to 500 nm is used upon forming an image, a metallic or non-metallic phthalocyanine pigment, trigonal selenium and dibromoanthanthrone are preferred. Among these, hydroxygallium phthalocyanine disclosed in JP-A-5-263007 and JP-A-5-279591, chlorogallium phthalocyanine disclosed in JP-A-5-98181, dichlorotin phthalocyanine disclosed in JP-A-5-14072 and JP-A-5-14073, and titanyl phthalocyanine disclosed in JP-A-4-189873 and JP-A-5-43813 are particularly preferred.

The binder resin of the charge generating layer 5 may be selected from a wide range of insulating resins. It may also be selected from an organic electroconductive polymer, such as poly-N-vinylcarbazole, polyvinylanthracene, polyvinylpyrene and polysilane. Preferred examples of the binder resin include insulating resins, such as a polyvinyl butyral resin, a polyarylate resin (e.g., a polycondensation product of bisphenol A and phthalic acid), a polycarbonate resin, a polyester resin, a phenoxy resin, a vinyl chloride-vinyl acetate copolymer, a polyamide resin, an acrylate resin, a polyacrylamide resin, a polyvinylpyridine resin, a cellulose resin, a urethane resin, an epoxy resin, casein, a polyvinyl alcohol resin and a polyvinylpyrrolidone resin, but the invention is not limited to these resins. The binder resins may be used solely or as a mixture of two or more thereof. The mixing ratio of the charge generating material and the binder resin is preferably in a range of from 10/1 to 1/10 by weight.

The charge generating layer 5 may be formed by coating a coating composition containing the aforementioned constitutional materials on the undercoating layer 4, and then drying. Examples of the solvent used in the coating composition for forming the charge generating layer 5 include organic solvents, such as methanol, ethanol, n-propanol, n-butanol, benzyl alcohol, methyl cellosolve, ethyl cellosolve, acetone, methyl ethyl ketone, cyclohexanone, methyl acetate, n-butyl acetate, dioxane, tetrahydrofuran, methylene chloride, chloroform, chlorobenzene and toluene, which may be used solely or a mixture of two or more thereof. Examples of the dispersing method upon preparing the coating composition include ordinary methods, such as a ball mill dispersing method, an attritor dispersing method and a sand mill dispersing method. In this case, such conditions are necessarily employed that the crystal form of the pigment as the charge generating material is not change through dispersion. Upon dispersing, it is effective that the particle diameter of the pigment particles becomes 0.5 μm or less, preferably 0.3 μm or less, and more preferably 0.15 μm or less. Examples of the coating method of the coating composition include such ordinary coating methods as a blade coating method, a wire bar coating method, a spray coating method, a dip coating method, a bead coating method, an air knife coating method and a curtain coating method. The coating composition after coating is dried at a temperature where the solvent can be evaporated to form a film. The thickness of the charge generating layer 5 is generally from 0.1 to 5 μm, and preferably from 0.2 to 2.0 μm.

The charge transporting layer 6 contains a charge transporting material and a binder resin, or contains a polymer charge transporting material.

Examples of the charge transporting material include an electron transporting compound, such as a quinone compound, e.g., p-benzoquinone, chloranil, bromanil and anthraquinone, a tetracyanoquinodimethane compound, a fluorenone compound, e.g. 2,4,7-trinitrofluorenone, a xanthone compound, a benzophenone compound, a cyanovinyl compound and an ethylene compound, and a hole transporting compound, such as a triarylamine compound, a benzidine compound, an arylalkane compound anaryl-substituted ethylene compound, a stilbene compound, an anthracene compound and a hydrazone compound, and the invention is not limited to these compounds. The charge transporting materials may be used solely or as a mixture of two or more thereof.

Preferred examples of the charge transporting material include compounds represented by the following general formulae (a-1), (a-2) and (a-3) from the standpoint of mobility:

(a-1)

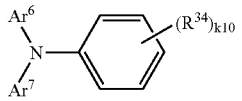

wherein $R^{34}$ represents a hydrogen atom or a methyl group, k10 represents 1 or 2, and $Ar^6$ and $Ar^7$ each represents a substituted or unsubstituted aryl group, —$C_6H_4$—C($R^{38}$)=C($R^{39}$)($R^{40}$) or —$C_6H_4$—CH=CH—CH=C(Ar)$_2$. Examples of the substituent include a halogen atom, an alkyl group having from 1 to 5 carbon atoms, an alkoxy group having from 1 to 5 carbon atoms and a substituted amino group having an alkyl group having from 1 to 3 carbon atoms substituted. $R^{38}$, $R^{39}$ and $R^{40}$ each represents a hydrogen atom, a substituted or unsubstituted alkyl group or a substituted or unsubstituted aryl group, and Ar represents a substituted or unsubstituted aryl group.

(a-2)

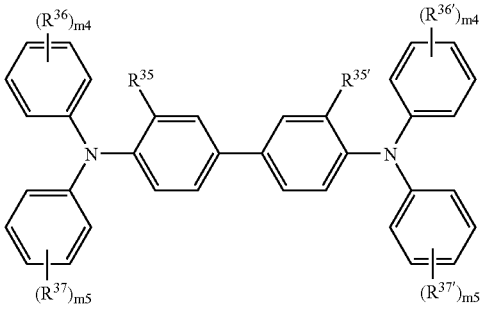

wherein $R^{35}$ and $R^{35'}$ each independently represents a hydrogen atom, a halogen atom, an alkoxy group having from 1 to 5 carbon atoms or an alkoxy group having from 1 to 5 carbon atoms, $R^{36}$, $R^{36'}$, $R^{37}$ and $R^{37'}$ each independently represents a halogen atom, an alkyl group having from 1 to 5 carbon atoms, an alkoxy group having from 1 to 5 carbon atoms, an amino group having an alkyl group having 1 or 2 carbon atoms substituted, a substituted or unsubstituted amino group, —C($R^{38}$)=C($R^{39}$)($R^{40}$) or —CH=CH—CH=C(Ar)$_2$, $R^{38}$, $R^{39}$ and $R^{40}$ each represents a hydrogen atom, a substituted or unsubstituted alkyl group or a substituted or unsubstituted aryl group, Ar represents a substituted or unsubstituted aryl group, and m4 and m5 each independently represents an integer of from 0 to 2.

(a-3)

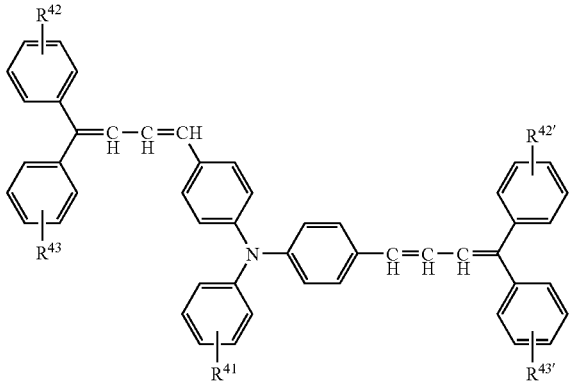

wherein $R^{41}$ represents a hydrogen atom, a halogen atom, an alkoxy group having from 1 to 5 carbon atoms, an alkoxy group having from 1 to 5 carbon atoms or —CH=CH—CH=C(Ar)$_2$, and Ar represents a substituted or unsubstituted aryl group. $R^{42}$, $R^{42'}$, $R^{43}$ and $R^{43'}$ each independently represents a hydrogen atom, a halogen atom, an alkyl group having from 1 to 5 carbon atoms, an alkoxy group having from 1 to 5 carbon atoms, an amino group having alkyl group having 1 or 2 carbon atoms substituted, or a substituted or unsubstituted aryl group.

Examples of the binder resin used in the charge transporting layer 6 include a polycarbonate resin, a polyester resin, a methacrylate resin, an acrylate resin, a polyvinyl chloride resin, a polyvinylidene chloride resin, a vinylidene chloride-acrylonitrile copolymer, a vinyl chloride-vinyl acetate copolymer, a vinyl chloride-vinyl acetate-maleic anhydride copolymer, a silicone resin, a silicone-alkyd resin, a phenol-formaldehyde resin and a styrene-alkyd resin. These binder resins may be used solely or as a mixture of two or more thereof. The mixing ratio of the charge transporting material and the binder resin is preferably from 10/1 to 1/5 by weight.

As the polymer charge transporting material, known materials, such as poly-N-vinylcarbazole and polysilane, can be used. In particular, a polyester polymer charge transporting material disclosed in JP-A-8-176293 and JP-A-8-208820 is preferred owing to the high charge transporting property thereof. The polymer charge transporting material may be used solely as a constitutional material of the charge transporting layer 6, and may be formed into a film after mixing with the binder resin.

The charge transporting layer 6 may be formed by coating a coating composition containing the aforementioned constitutional materials on the charge generating layer 5, and then drying. Examples of the solvent used in the coating composition for forming the charge generating layer 5 include ordinary organic solvents, such as an aromatic hydrocarbon, such as benzene, toluene, xylene and chlorobenzene, a ketone, such as acetone and 2-butanone, a halogenated aliphatic hydrocarbon, such as methylene chloride, chloroform and ethylene chloride, and a cyclic or linear ether, such as tetrahydrofuran and ethyl ether, which may be used solely or a mixture of two or more thereof. Examples of the coating method of the coating composition for forming the charge transporting layer include such ordinary coating methods as a blade coating method, a wire bar coating method, a spray coating method, a dip coating method, a bead coating method, an air knife coating method and a curtain coating method. The coating composition after coating is dried at a temperature where the solvent can be evaporated to form a film. The thickness of the charge transporting layer 6 is generally from 5 to 50 μm, and preferably from 10 to 30 μm.

In order to prevent the photoreceptor from being deteriorated by ozone and an oxidizing gas generated in the image forming apparatus, or light and heat, the charge transporting layer 6 constituting the photosensitive layer 3 may contain an additive, such as an antioxidant, a light stabilizer and a heat stabilizer. Examples of the antioxidant include hindered phenol, hindered amine, p-phenylenediamine, arylalkane, hydroquinone, spirochroman, spiroindanone, derivatives of these compounds, an organic sulfur compound, and an organic phosphorous compound. Examples of the light stabilizer include benzophenone, benzotriazole, dithiocarbamate, tetramethylpyridine and derivatives of these compounds.

The photosensitive layer 3 may contain at least one electron acceptive substance for the purpose of improving the sensitivity, decreasing the residual potential, and decreasing fatigue upon repeated use.

Examples of the electron acceptive substance include succinic anhydride, maleic anhydride, dibromomaleic anhydride, phthalic anhydride, tetrabromophthalic anhydride, tetracyanoethylene, tetracyanoquinodimethane, o-dinitrobenzene, m-dinitrobenzene, chloranil, dinitroanthraquinone, trinitrofluorene, picric acid, o-nitrobenzoic acid, p-nitrobenzoic acid and phthalic acid. Among these, a fluorenone compound, a quinone compound, and a benzene derivative having an electron attracting group, such as Cl, CN and $NO_2$, are particularly preferred.

The protective layer 7 contains a compound having a triple bond and a hydroxyl group in a molecule, and a cured product of a curable resin, as having been described.

The number of the triple bond contained in the compound having a triple bond and a hydroxyl group in a molecule is not particularly limited, and is preferably from 1 to 10, and more preferably from 1 to 4.

The number of the hydroxyl group contained in the compound having a triple bond and a hydroxyl group in a molecule is not particularly limited, and is preferably from 1 to 100, and more preferably from 1 to 10.

Examples of the compound having a triple bond and a hydroxyl group in a molecule include those compounds having a carbon-carbon triple bond and a hydroxyl group, such as 2-propyn-1-ol, 1-butyn-3-ol, 2-butyn-1-ol, 3-butyn-1-ol, 1-pentyn-3-ol, 2-pentyn-1-ol, 3-pentyn-1-ol, 4-pentyn-1-ol, 4-pentyn-2-ol, 1-hexyn-3-ol, 2-hexyn-1-ol, 3-hexyn-1-ol, 5-hexyn-1-ol, 5-hexyn-3-ol, 1-heptyn-3-ol, 2-heptyn-1-ol, 3-heptyn-1-ol, 4-heptyn-2-ol, 5-heptyn-3-ol, 1-octyn-3-ol, 3-octyn-1-ol, 3-nonyn-1-ol, 2-decyn-1-ol, 3-decyn-1-ol, 10-undecyn-1-ol, 3-methyl-1-butyn-3-ol, 3-methyl-1-penten-4-yn-3-ol, 3-methyl-1-pentyn-3-ol, 5-methyl-1-hexyn-3-ol, 3-ethyl-1-pentyn-3-ol, 3-ethyl-1-heptyn-3-ol, 4-ethyl-1-octyn-3-ol, 3,4-dimethyl-1-pentyn-3-ol, 3,5-dimethyl-1-hexyn-3-ol, 3,6-dimethyl-1-heptyn-3-ol, 2,2,8,8-tetramethyl-3,6-nonadiyn-5-ol, 4,6-nonadecadiyn-1-ol, 10,12-pentacosadiyn-1-ol, 2-butyn-1,4-diol, 3-hexyn-2,5-diol, 2,4-hexadiyn-1,6-diol, 2,5-dimethyl-3-hexyn-2,5-diol, 3,6-dimethyl-4-octyn-3,6-diol, 2,4,7,9-tetramethyl-5-decyn-4,7-diol, (+)-1,6-bis(2-chlorophenyl)-1,6-diphenyl-2,4-hexadiyn-1,6-diol, (−)-1,6-bis(2-chlorophenyl)-1,6-diphenyl-2,4-hexadiyn-1,6-diol, 2-butyn-1,4-diol bis(2-hydroxyethyl), 1,4-diacetoxy-2-butyn-4-diethylamino-2-butyn-1-ol, 1,1-diphenyl-2-propyn-1-ol, 1-ethynyl-1-cyclohexanol, 9-ethynyl-9-fluorenol, 2,4-hexadiyndiyl-1,6-bis(4-phenylazobenzene sulfonate), ethyl 2-hydroxy-3-butynoate, 2-methyl-4-phenyl-3-butyn-2-ol, methyl propargyl ether, 5-phenyl-4-pentyn-1-ol, 1-phenyl-1-propyn-3-ol, 1-phenyl-2-propyn-1-ol, 4-trimethylsilyl-3-butyn-2-ol and 3-trimethylsilyl-2-propyn-1-ol. Examples thereof also include adding an alkylene oxide, such as ethylene oxide, to a part or the whole of the hydroxyl groups of these compounds (such as Surfynol 400 Series, produced by Shin-Etsu Chemical Co., Ltd.). Upon preparing the curable resin composition, the aforementioned compounds may be used as it is or as an aqueous solution (such as a 55% aqueous solution of 1-butyn-3-ol (concentration: ca. 7.5 mol/L). Among these, at least one compound selected from 2-propyn-1-ol, 3,5-dimethyl-1-hexyn-3-ol, 2,4-hexadiyn-1,6-diol, 2,5-dimethyl-3-hexyn-2,5-diol, 2,4,7,9-tetramethyl-5-decyn-4,7-diol and 4-trimethylsilyl-3-butyn-2-ol, or a compound represented by the following general formula (XX-1) or (XX-2) is preferably used:

(XX-1)

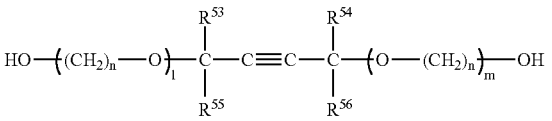

-continued (XX-2)

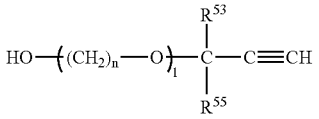

wherein $R^{53}$, $R^{54}$, $R^{55}$ and $R^{56}$ each independently represents a monovalent organic group, and l, m and n each independently represents an integer.

Among the compounds represented by the general formulae (XX-1) and (XX-2), a compound wherein $R^{53}$, $R^{54}$, $R^{55}$ and $R^{56}$ each represents an alkyl group is preferred, and a compound wherein at least one of $R^{53}$, $R^{54}$, $R^{55}$ and $R^{56}$ represents a branched alkyl group is more preferred. n is preferably 300 or less. While the reason why the compounds exhibit favorable characteristics is not completely clear, the inventors expect as follows. Alkylene glycol, a hydroxyl group or a triple bond has a function of decreasing the surface tension. In particular, the compound having n of 300 or less has high solubility in the coating composition and high affinity to the components of the coating composition, and a branched alkyl group increases the compatibility with the coating composition owing to the moderate hydrophilicity thereof, whereby the surface tension of the coating composition is effectively lowered.

The content of the compound having a triple bond and a hydroxyl group in a molecule is preferably from 0.01 to 10% by weight, and more preferably from 0.1 to 5% by weight, based on the total solid content of the protective layer 7. In the case where the content of the compound having a triple bond and a hydroxyl group in a molecule is less than 0.01% by weight, there is such a tendency that the effect of preventing defects in a coated film becomes insufficient. In the case where the content of the compound having a triple bond and a hydroxyl group in a molecule exceeds 10% by weight, there is such a tendency that the strength of the resulting cured product is lowered due to bleed-out of the compound, and the peripheral members are contaminated thereby.

The presence of the compound having a triple bond and a hydroxyl group in a molecule in the protective layer 7 can be confirmed by ordinary organic analysis methods, such as IR (infrared absorption spectrum) and NMR (nuclear magnetic resonance spectrum). For example, a triple bond has a relatively sharp characteristic peak around 2,200 $cm^{-1}$ in IR, and a hydroxyl group has a broad characteristic peak around 3,400 to 3,200 $cm^{-1}$, by which the presence of the compound can be confirmed.

As the curable resin, a curable resin that is soluble in an alcohol can be preferably used. The curable resin soluble in an alcohol referred herein means such a curable resin that can be dissolved in at least one alcohol selected from alcohols having 5 or less carbon atoms in an amount of 1% by weight or more. Preferred examples of the curable resin soluble in an alcohol include thermosetting resins, such as a phenol resin, a thermosetting acrylate resin, a thermosetting silicone resin, an epoxy resin, a melamine resin and a urethane resin, and among the thermosetting resins, a phenol resin is preferred from the standpoint of the mechanical strength, the electric characteristics and the attachment removing property of the cured product of the thermosetting curable resin composition. The compound having a triple bond and a hydroxyl group in a molecule is preferably used with the resin having an aromatic ring in a molecule owing to the high affinity.

As the phenol resin, a compound having a phenol structure, examples of which include a substituted phenol compound having one hydroxyl group, such as phenol, cresol, xylenol, p-alkylphenol and p-phenylphenol, a substituted phenol compound having two hydroxyl groups, such as catechol, resorcinol and hydroquinone, and a bisphenol compound, such as bisphenol A and bisphenol Z, is reacted with formaldehyde, paraformaldehyde or the like in the presence of an acid or alkali catalyst to produce a monomer, such as a monomethylolphenol compound, a dimethylolphenol compound and a trimethylolphenol compound, a mixture thereof, an oligomer thereof, and a mixture of the monomer and the oligomer. Among these, relatively large molecules having a number of molecular repeating units of about from 2 to 20 are oligomers, and molecules smaller than them are monomers.

Examples of the acid catalyst used herein include sulfuric acid, p-toluenesulfonic acid, phenolsulfonic acid and phosphoric acid. Examples of the alkali catalyst used herein include a hydroxide or an oxide of an alkali metal or an alkaline earth metal, such as NaOH, KOH, $Ca(OH)_2$, $Mg(OH)_2$, $Ba(OH)_2$, CaO and MgO, an amine catalyst, and an acetate salt, such as zinc acetate and sodium acetate.

Examples of the amine catalyst include ammonia, hexamethylenetetramine, trimethylamine, triethylamine and triethanolamine, but the invention is not limited thereto.

In the case where a basic catalyst is used, there are some cases where carriers are considerably trapped by the remaining catalyst to deteriorate the electrophotographic characteristics. In such cases, it is preferred that the catalyst is distilled off under reduced pressure, neutralized with an acid, or inactivated or removed by making in contact with an absorbent, such as silica gel, or an ion exchange resin. Upon curing, a curing catalyst may be used. The curing catalyst used herein is not particularly limited as far as it exerts no adverse effect on the electric characteristics.

The protective layer 7 preferably contains, in addition to the aforementioned constitutional components, electroconductive inorganic particles or charge transporting organic compound for improving the electric characteristics. The protective layer 7 more preferably contains both electroconductive inorganic particles and charge transporting organic compound.

Examples of the electroconductive inorganic particles include a metal, a metallic oxide and carbon black. Examples of the metal include aluminum, zinc, copper, chromium, nickel, silver, stainless steel, and plastic particles having these metals vapor-deposited thereon. Examples of the metallic oxide include zinc oxide, titanium oxide, tin oxide, antimony oxide, indium oxide, bismuth oxide, indium oxide doped with tin, tin oxide doped with antimony or tantalum, and zirconium oxide doped with antimony. These materials may be used solely or in combination of two or more thereof. In the case where two or more thereof are used in combination, they may be simply mixed or may be formed into a solid solution or a fused material. The average particle diameter of the electroconductive particles used in the invention is preferably 0.3 μm or less, and particularly preferably 0.1 μm or less, from the standpoint of the transparency of the protective layer. Among the electroconductive inorganic particles, a metallic oxide is particularly preferably used in the invention from the standpoint of the transparency. The surface of the particles is preferably subjected to a treatment for controlling the dispersibility. Examples of the treating agent include a silane coupling agent, a silicone oil, a siloxane compound and a surfactant. These materials preferably contain a fluorine atom.

As the charge transporting organic compound, those compatible with the curable resin used are preferred, and those forming a chemical bond with the curable resin used are more preferred.

As the charge transporting organic compound having a reactive functional group, compounds represented by the following general formulae (I), (II), (III), (IV), (V) and (VI) are preferred since they are excellent in film forming property, mechanical strength and stability:

$$F\text{—}((X^1)_{n1}R^1\text{—}Z^1H)_{m1} \quad \text{(I)}$$

wherein F represents an organic group derived from a compound having a hole transporting function; $R^1$ represents an alkylene group; $Z^1$ represents an oxygen atom, a sulfur atom, NH or COO; $X^1$ represents an oxygen atom or a sulfur atom; m1 represents an integer of from 1 to 4; and n1 represents 0 or 1, $$F\text{—}((X^2)_{n2}\text{—}(R^2)_{n3}\text{—}(Z^2)_{n4}G)_{n5} \quad \text{(II)}$$

wherein F represents an organic group derived from a compound having a hole transporting function; $X^2$ represents an oxygen atom or a sulfur atom; $R^2$ represents an alkylene group; $Z^2$ represents an oxygen atom, a sulfur atom, NH or COO; G represents an epoxy group; n2, n3 and n4 each independently represents 0 or 1; and n5 represents an integer of from 1 to 4, $$F(\text{-}D\text{-}Si(R^3)_{(3-a)}Q_a)_b \quad \text{(III)}$$

wherein F represents a b-valent organic group derived from a compound having a hole transporting function; D represents a divalent group having flexibility; $R^3$ represents a hydrogen atom, a substituted or unsubstituted alkyl group or a substituted or unsubstituted aryl group; Q represents a hydrolyzable group; a represents an integer of from 1 to 3; and b represents an integer of from 1 to 4, (IV)

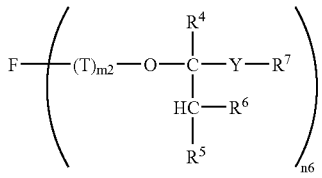

wherein F represents an organic group derived from a compound having a hole transporting function; T represents a divalent group; Y represents an oxygen atom or a sulfur atom; $R^4$, $R^5$ and $R^6$ each independently represents a hydrogen atom or a monovalent organic group; $R^7$ represents a monovalent organic group; m2 represents 0 or 1; n6 represents an integer of from 1 to 4, provided that $R^6$ and $R^7$ may be bonded to each other to form a heterocyclic ring containing Y as a heteroatom, (V)

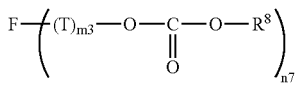

wherein F represents an organic group derived from a compound having a hole transporting function; T represents a divalent group; $R^8$ represents a monovalent organic group; m3 represents 0 or 1; and n7 represents an integer of from 1 to 4, and $$F-[L-O-R^9]_{n8} \quad (VI)$$

wherein F represents an organic group derived from a compound having a hole transporting function; L represents an alkylene group; $R^9$ represents a monovalent organic group; and n8 represents an integer of from 1 to 4.

The group represented by F in the general formulae (I) to (VI) is preferably a group represented by the following general formula (VII):

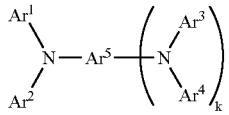

(VII)

wherein $Ar^1$, $Ar^2$, $Ar^3$ and $Ar^4$ each independently represents a substituted or unsubstituted aryl group; and $Ar^5$ represents a substituted or unsubstituted arylene group, provided that from 1 to 4 of $Ar^1$, $Ar^2$, $Ar^3$, $Ar^4$ and $Ar^5$ have a bond that is bonded to a part represented by the following general formula (VIII) in the compound represented by the general formula (I), a part represented by the following general formula (IX) in the compound represented by the general formula (II), a part represented by the following general formula (X) in the compound represented by the general formula (III), a part represented by the following general formula (XI) in the compound represented by the general formula (IV), a part represented by the following general formula (XII) in the compound represented by the general formula (V), or a part represented by the following general formula (XIII) in the compound represented by the general formula (VI):

$$-(X^1)_{n1}R^1-Z^1H \quad (VIII)$$

$$-(X^2)_{n2}-(R^2)_{n3}-(Z^2)_{n4}G \quad (IX)$$

$$-D-Si(R^3)_{(3-a)}Q_a \quad (X)$$

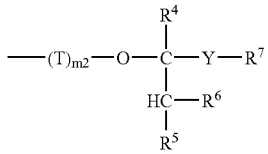

(XI)

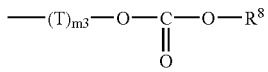

(XII)

(XIII)

As the substituted or unsubstituted aryl group represented by $Ar^1$, $Ar^2$, $Ar^3$ and $Ar^4$ in the general formula (VII), specifically, aryl groups represented by the following general formulae (1) to (7) are preferred:

TABLE 1

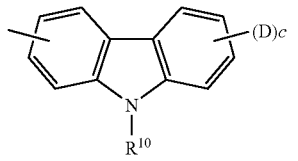

(1)

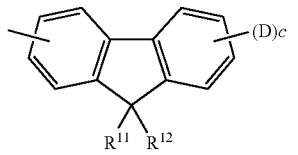

(2)

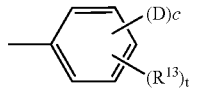

(3)

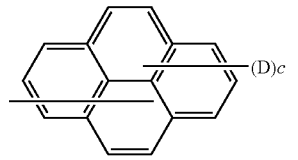

(4)

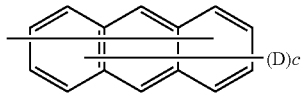

(5)

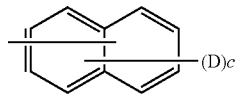

(6)

—Ar—(Z')s—Ar—(D)c (7)

In the general formulae (1) to (7), $R^{10}$ represents a hydrogen atom, an alkyl group having from 1 to 4 carbon atoms, an alkoxy group having from 1 to 4 carbon atoms, a phenyl group having these groups substituted, an unsubstituted phenyl group or an aralkyl group having from 7 to 10 carbon atoms; $R^{11}$ to $R^{13}$ each represents a hydrogen atom, an alkyl group having from 1 to 4 carbon atoms, an alkoxy group having from 1 to 4 carbon atoms, a phenyl group having these groups substituted, an unsubstituted phenyl group, an aralkyl group having from 7 to 10 carbon atoms or a halogen atom; Ar represents a substituted or unsubstituted arylene group; D represents one of structures represented by the general formulae (VIII) to (XIII); c and s each represents 0 or 1; and t represents an integer of from 1 to 3.

Examples of Ar in the aryl group represented by the general formula (7) include arylene groups represented by the following general formulae (8) and (9):

TABLE 2

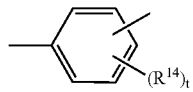

(8)

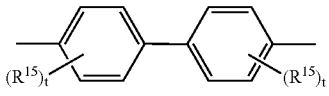

(9)

wherein $R^{14}$ and $R^{15}$ each represents a hydrogen atom, an alkyl group having from 1 to 4 carbon atoms, an alkoxy group having from 1 to 4 carbon atoms, a phenyl group having an alkoxy group having from 1 to 4 carbon atoms substituted, an unsubstituted phenyl group, an aralkyl group having from 7 to 10 carbon atoms or a halogen atom; and t represents an integer of from 1 to 3.

Examples of Z' in the aryl group represented by the general formula (7) include divalent groups represented by the following general formulae (10) to (17):

TABLE 3

| | |
|---|---|
| $—(CH_2)_q—$ | (10) |
| $—(CH_2CH_2O)_r—$ | (11) |
| 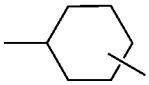 | (12) |
| 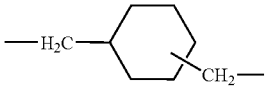 | (13) |
| 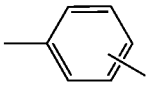 | (14) |
| 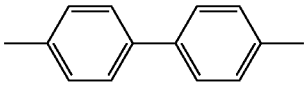 | (15) |
| 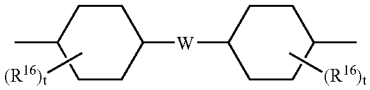 | (16) |
| 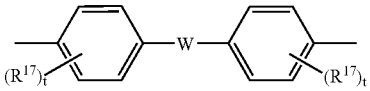 | (17) |

wherein R16 and R17 each represents a hydrogen atom, an alkyl group having from 1 to 4 carbon atoms, an alkoxy group having from 1 to 4 carbon atoms, a phenyl group having an alkoxy group having from 1 to 4 carbon atoms substituted, an unsubstituted phenyl group, an aralkyl group having from 7 to 10 carbon atoms or a halogen atom; W represents a divalent group; q and r each represents an integer of from 1 to 10; and t represents an integer of from 1 to 3.

In the general formulae (16) and (17), W represents a divalent group represented by the following general formulae (18) to (26). In the general formula (25), u represents an integer of from 0 to 3:

TABLE 4

| | |
|---|---|
| $—CH_2—$ | (18) |
| $—C(CH_3)_2—$ | (19) |
| —O— | (20) |
| —S— | (21) |
| $—C(CF_3)_2—$ | (22) |
| $—Si(CH_3)_2—$ | (23) |
| 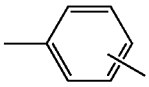 | (24) |

TABLE 4-continued

| | |
|---|---|
| 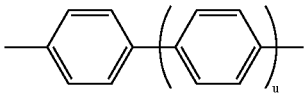 | (25) |
| 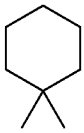 | (26) |

Specific examples of the structure of $Ar^5$ in the general formula (VI) include the specific structures of $Ar^1$ to $Ar^4$ with c=1 in the case where k=0, and the specific structures of $Ar^1$ to $Ar^4$ with c=0 in the case where k=1.

Specific examples of the compound represented by the general formula (I) include the following compounds (I-1) to (I-37). In the compounds (I-1) to (I-37), the bond shown with no substituent represents a methyl group.

TABLE 5

| | |
|---|---|
| I-1 | 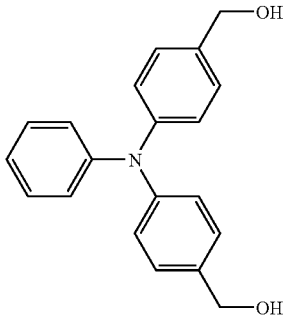 |
| I-2 | 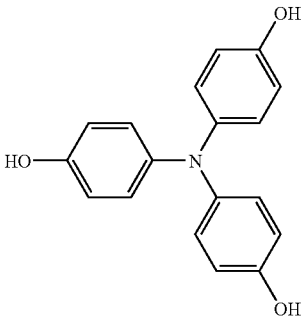 |
| I-3 | 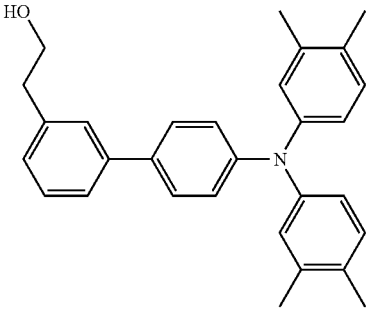 |

TABLE 5-continued
I-4
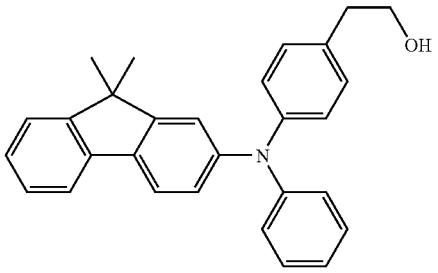
I-5
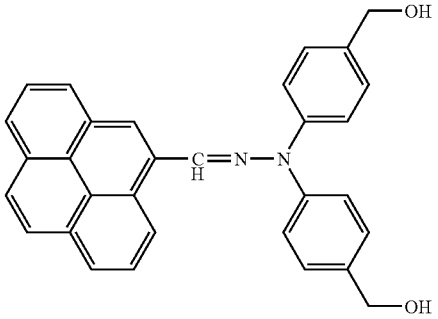
TABLE 6
I-6
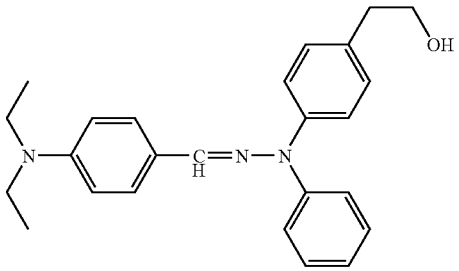
I-7
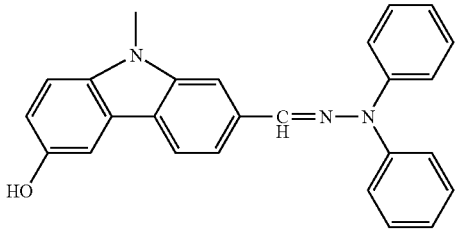
I-8
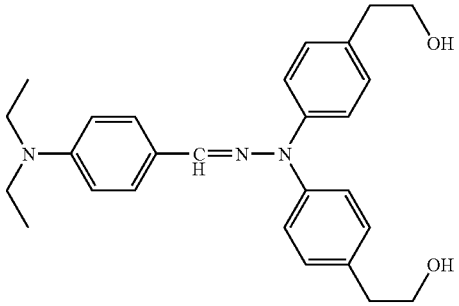
TABLE 6-continued
I-9
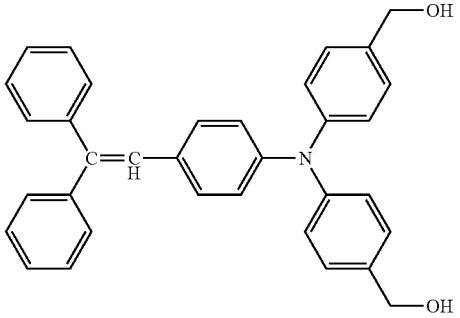
I-10
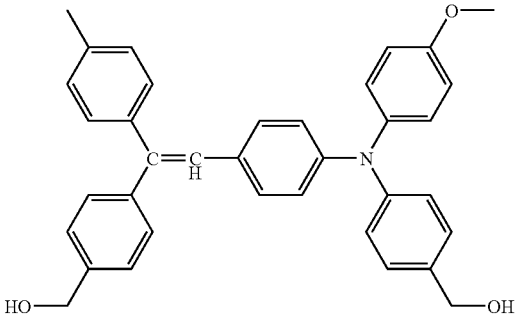
TABLE 7
I-11
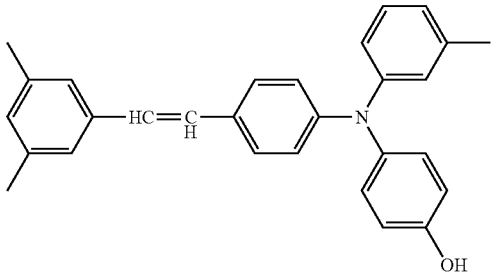
I-12
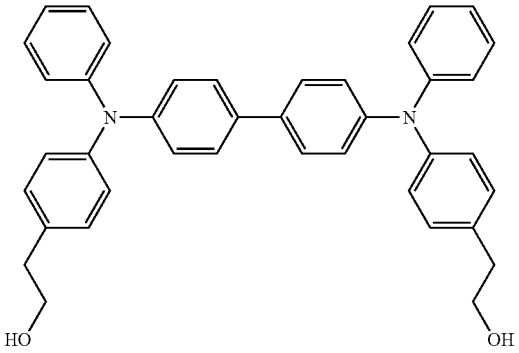

TABLE 7-continued
I-13
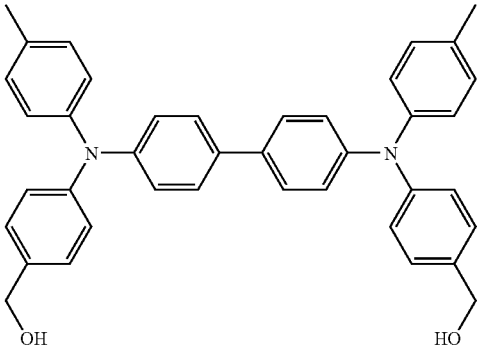
I-14
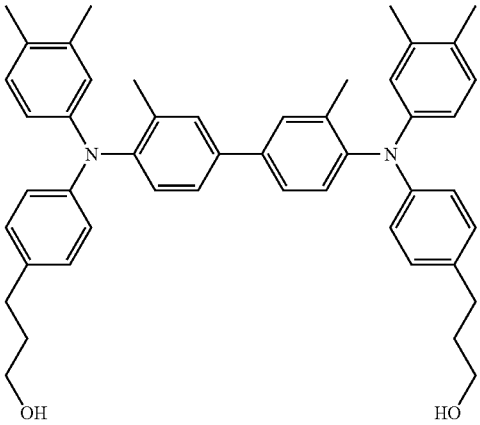
TABLE 8
I-15
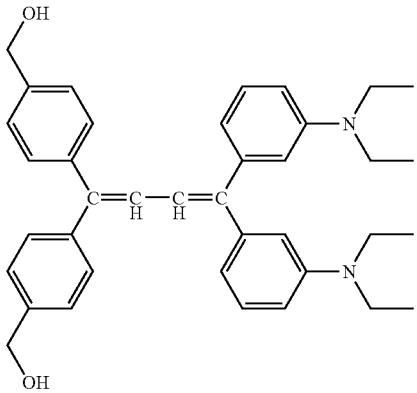
I-16
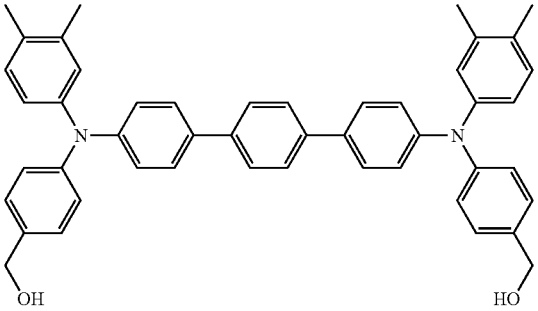
TABLE 8-continued
I-17
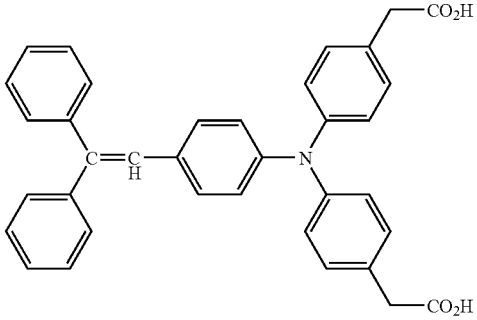
I-18
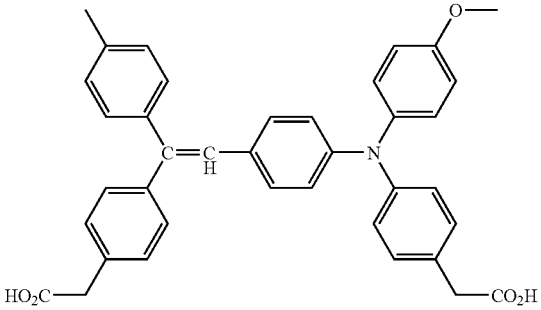
TABLE 9
I-19
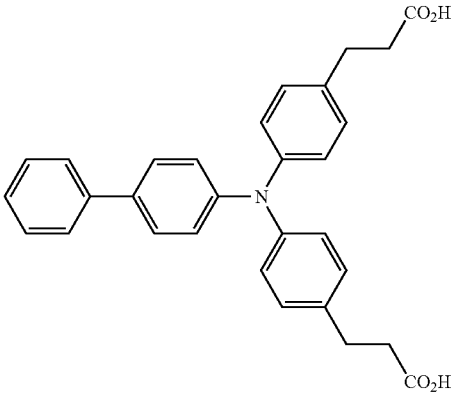
I-20
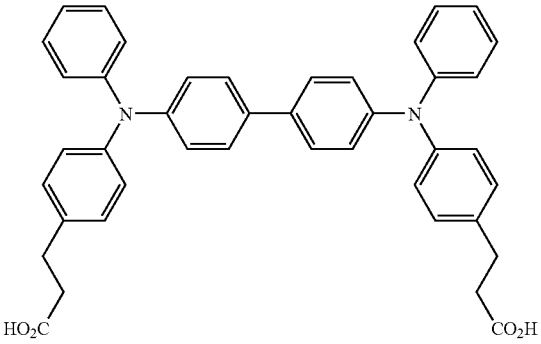

TABLE 9-continued
I-21
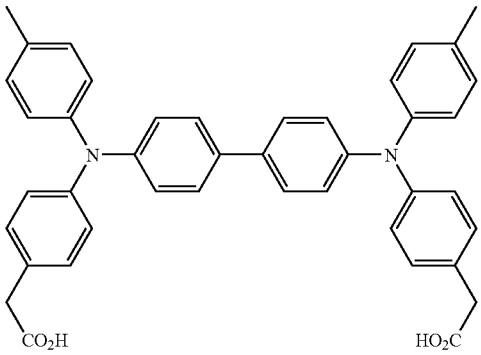
I-22
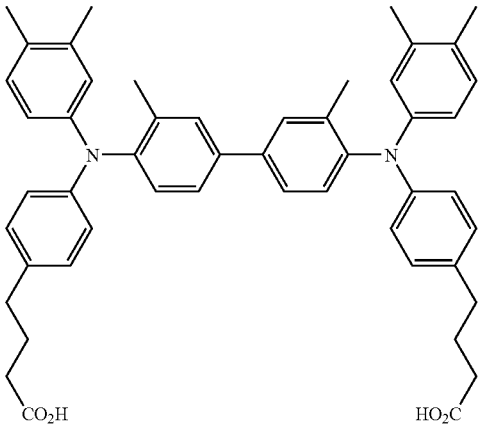
TABLE 10
I-23
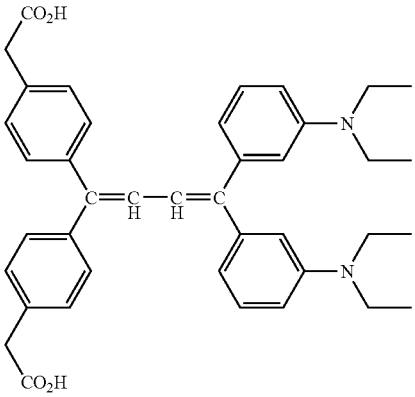
TABLE 10-continued
I-24
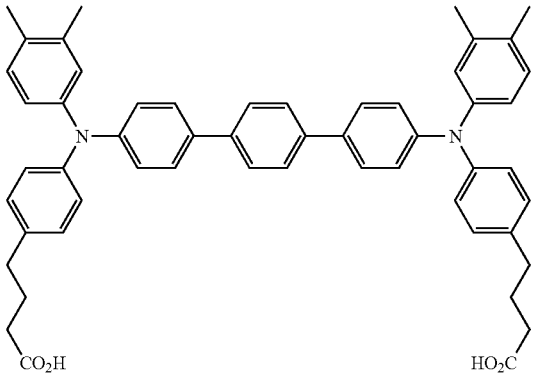
I-25
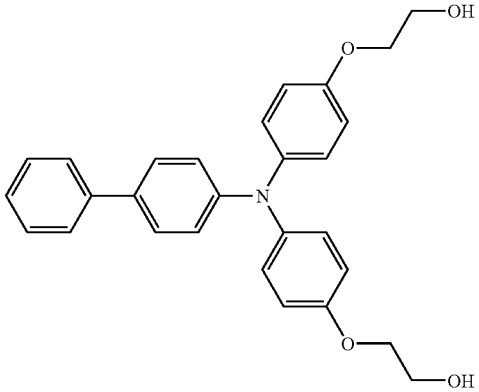
I-26
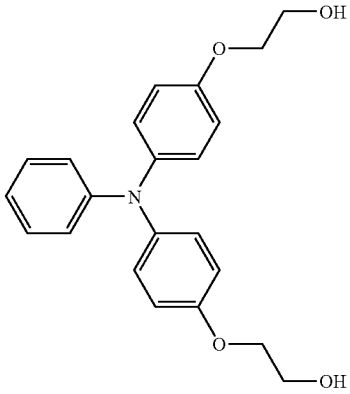
TABLE 11
I-27
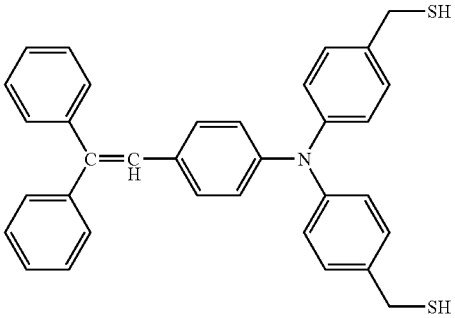

TABLE 11-continued
I-28
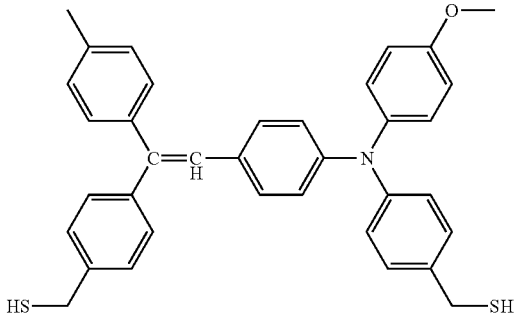
I-29
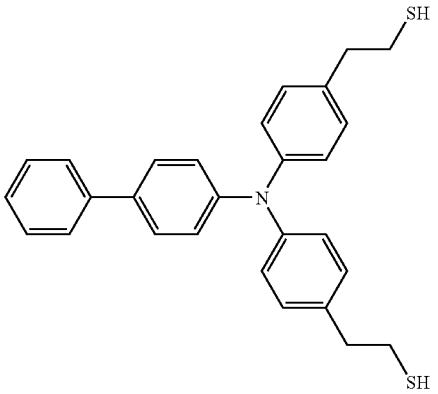
TABLE 12
I-30
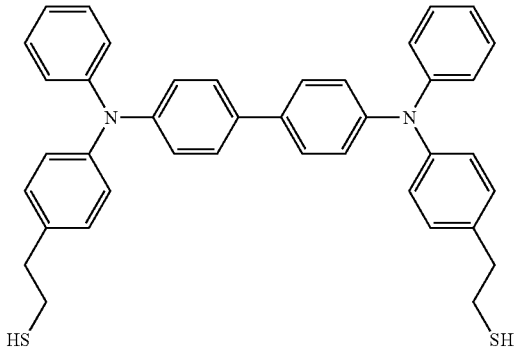
I-31
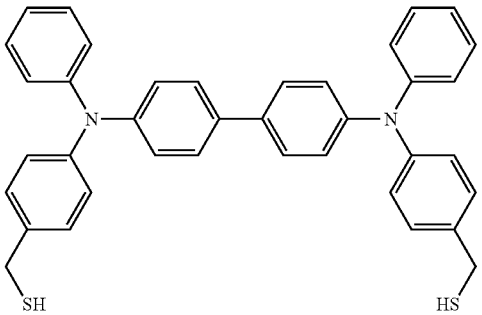
TABLE 12-continued
I-32
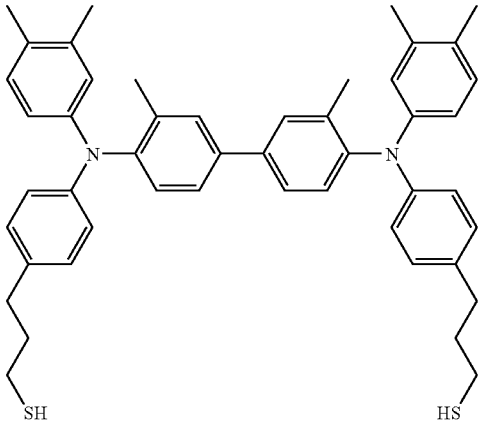
I-33
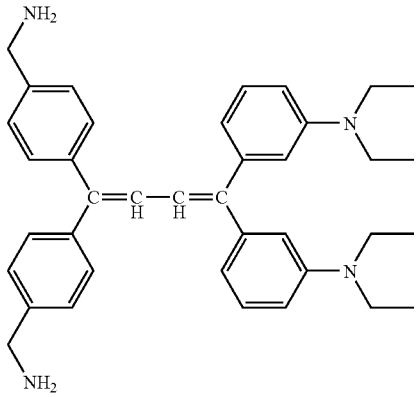
TABLE 13
I-34
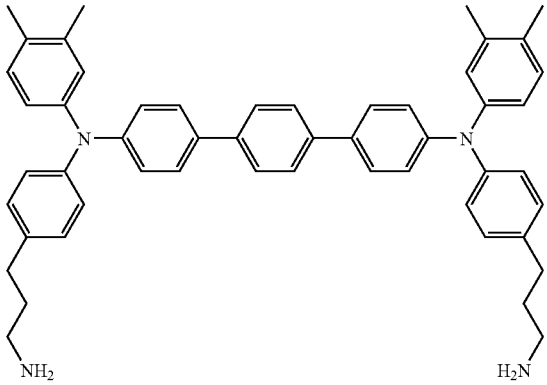
I-35
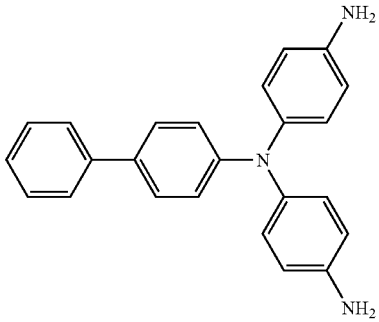

TABLE 13-continued
| | |
|---|---|
| I-36 | 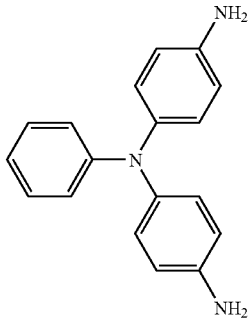 |
| I-37 | 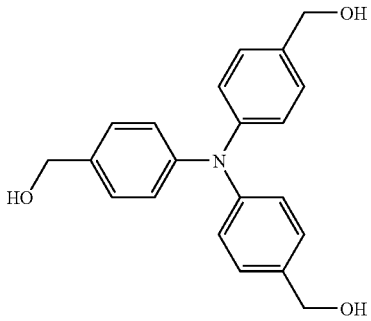 |
Specific examples of the compound represented by the general formula (II) include the following compounds (II-1) to (II-47). In the compounds (II-1) to (II-47), Me and the bond shown with no substituent each represents a methyl group, and Et represents an ethyl group.
TABLE 14
| | |
|---|---|
| II-1 | 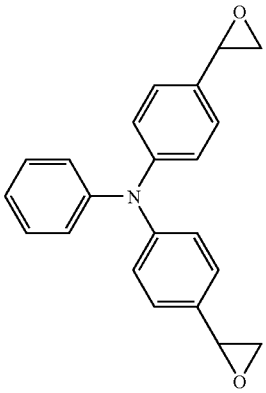 |
TABLE 14-continued
| | |
|---|---|
| II-2 | 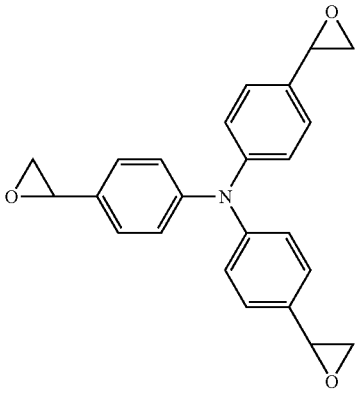 |
| II-3 | 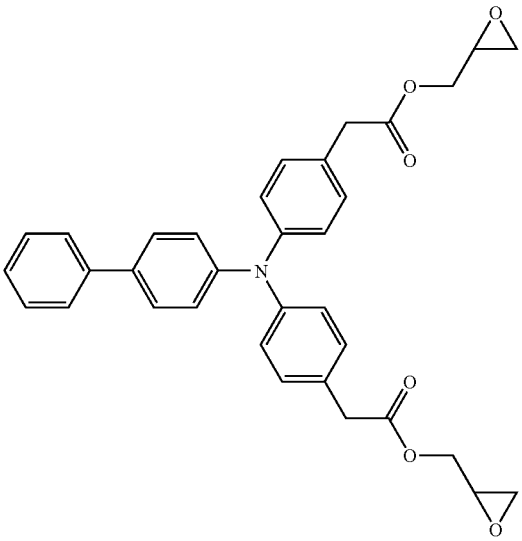 |
| II-4 | 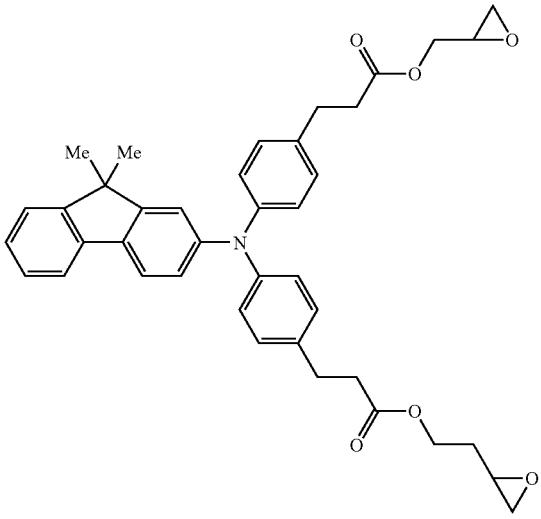 |

TABLE 15
II-5
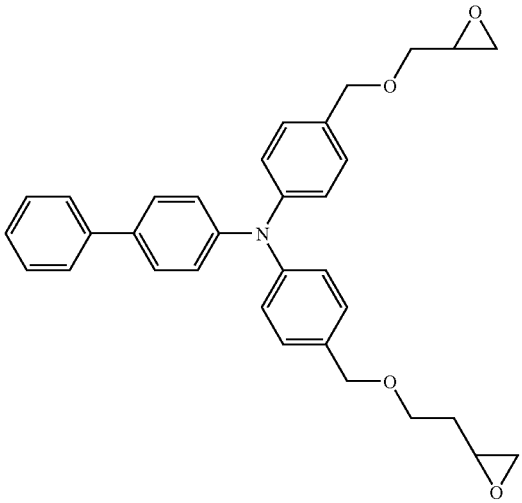
II-6
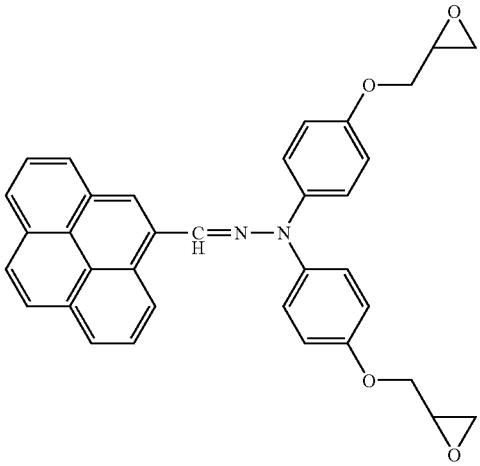
II-7
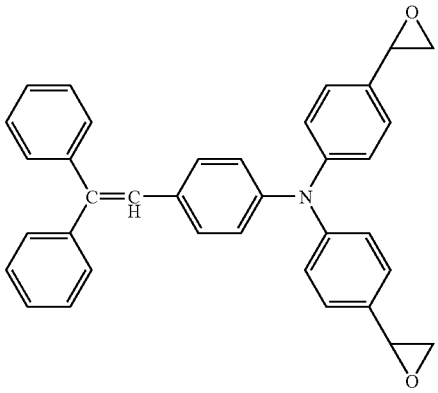
TABLE 15-continued
II-8
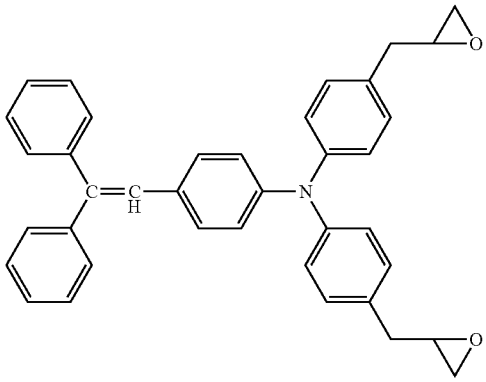
TABLE 16
II-9
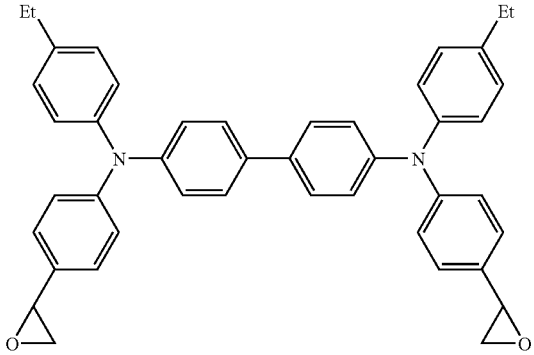
II-10
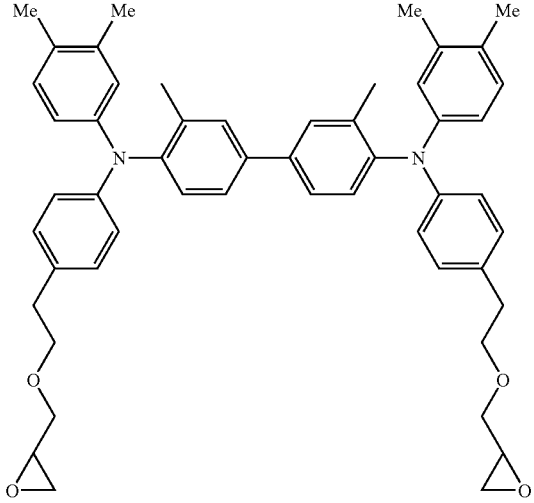

TABLE 16-continued
| | |
|---|---|
| 11 | 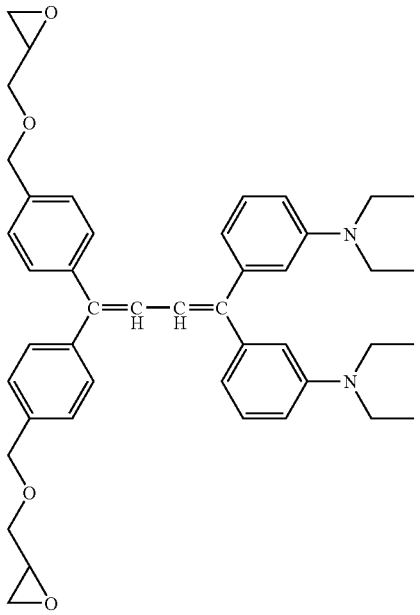 |
TABLE 17
| | |
|---|---|
| II-12 | 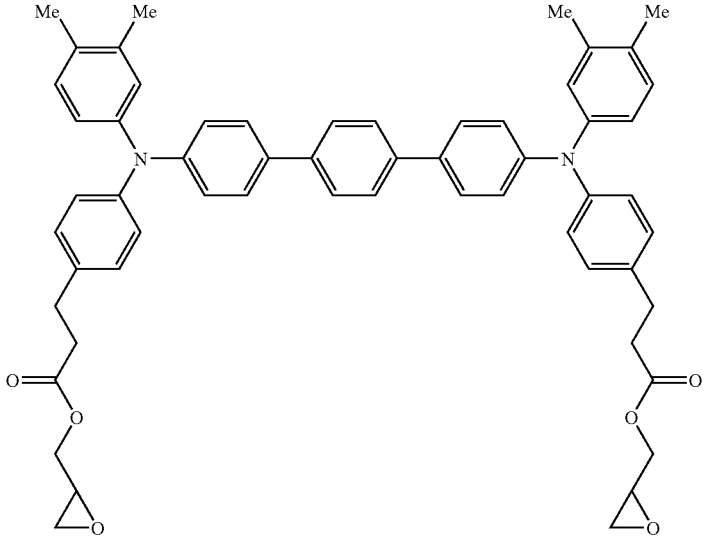 |

TABLE 17-continued
| | |
|---|---|
| II-13 | 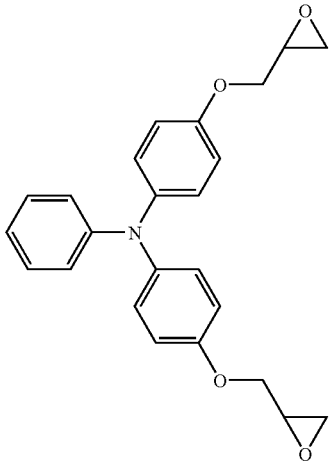 |
| II-14 | 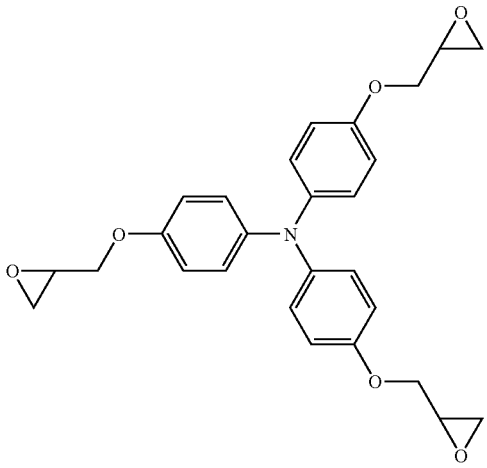 |
TABLE 18
| | |
|---|---|
| II-15 | 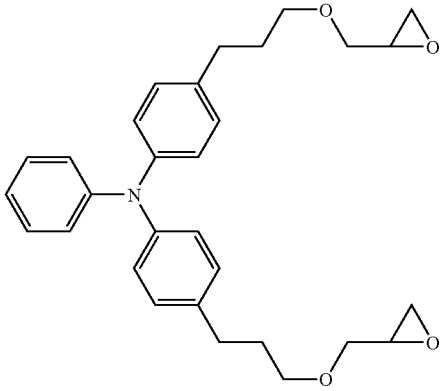 |
TABLE 18-continued
| | |
|---|---|
| II-16 | 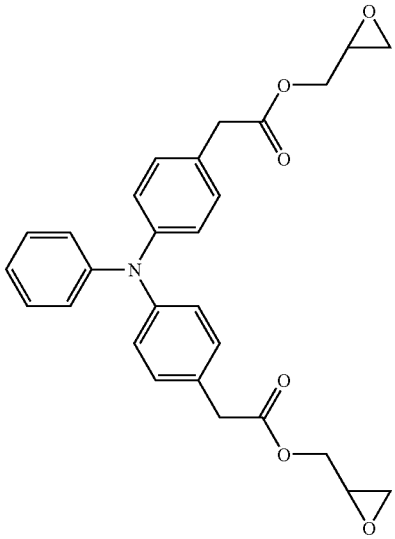 |

TABLE 18-continued
II-17
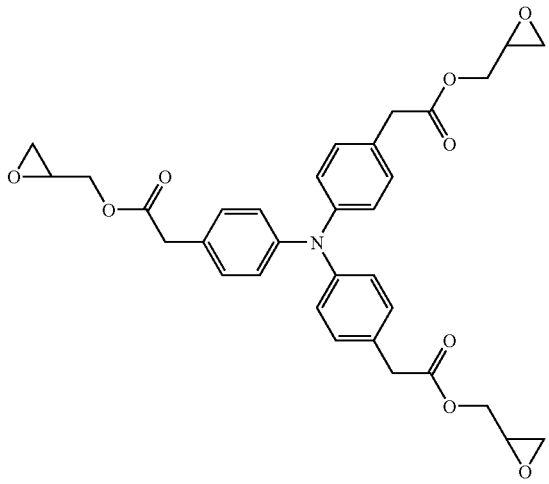
TABLE 19
II-18
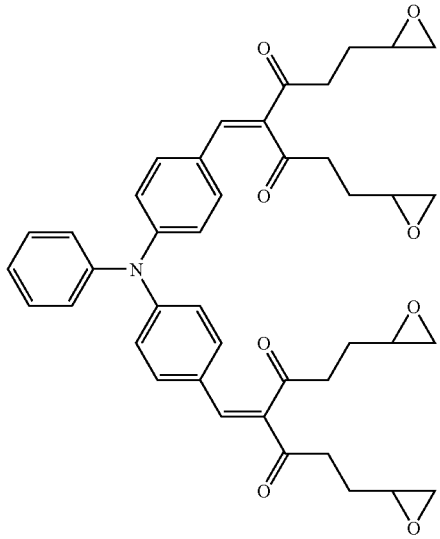
II-19
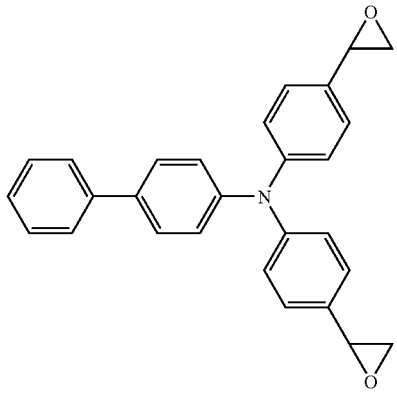
TABLE 19-continued
II-20
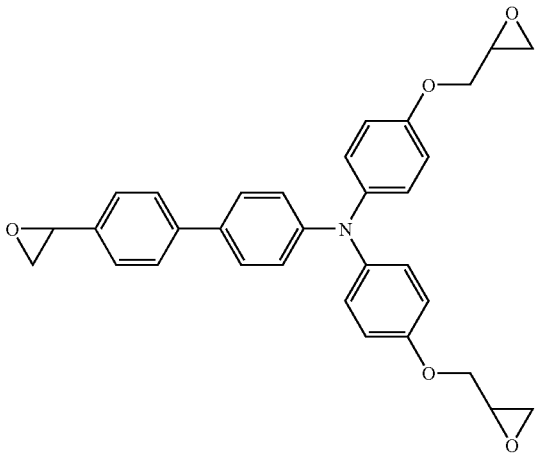
II-21
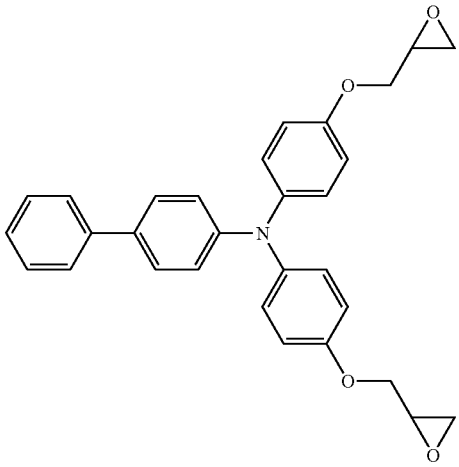
TABLE 20
II-22
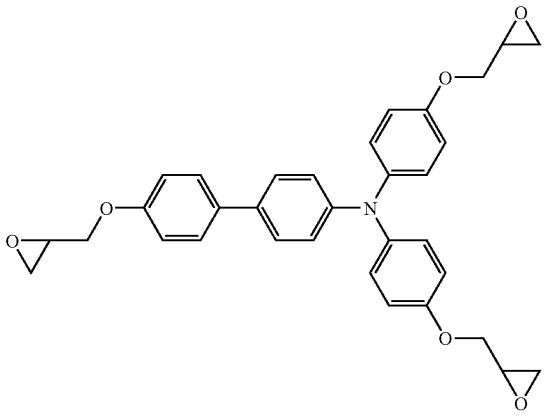

TABLE 20-continued
II-23
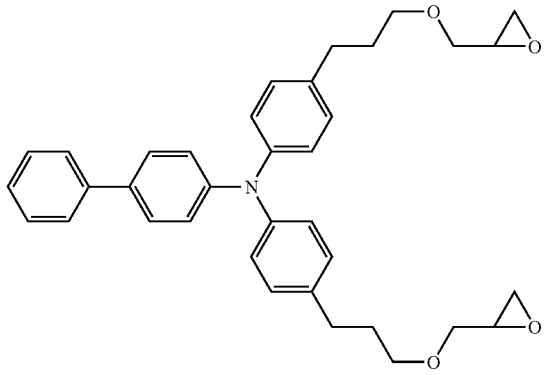
II-24
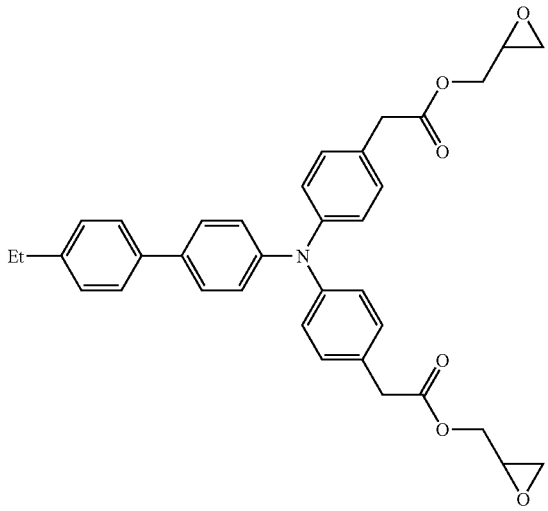
TABLE 21
II-25
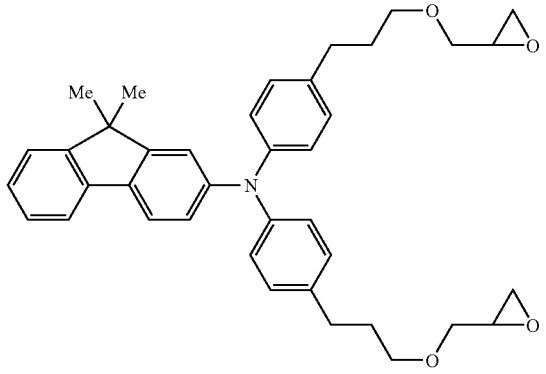
TABLE 21-continued
II-26
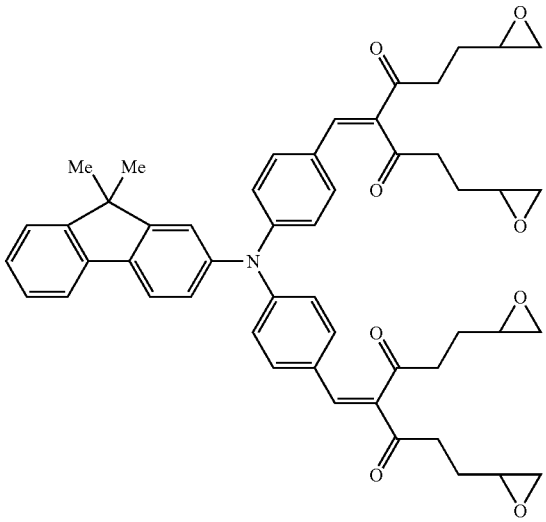
II-27
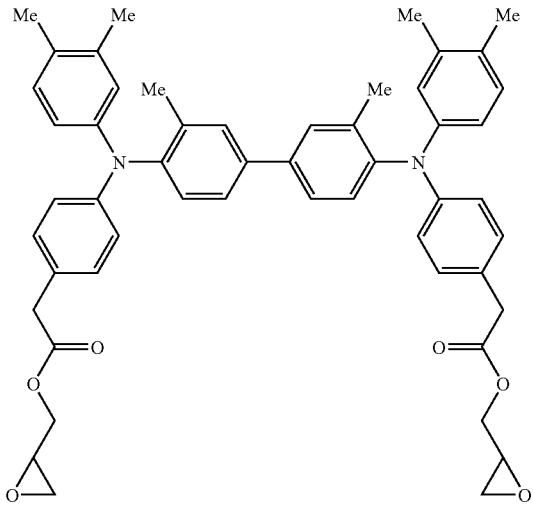

TABLE 22
| | |
|---|---|
| II-28 | 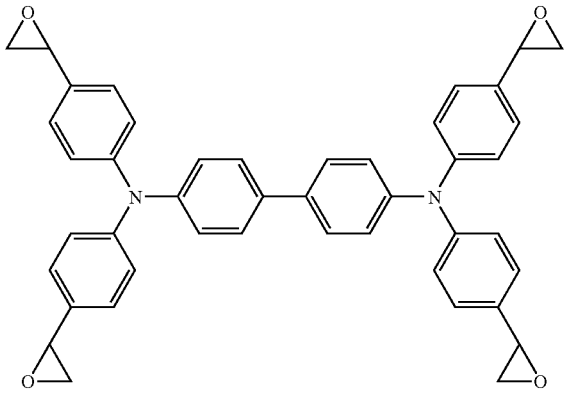 |
| II-29 | 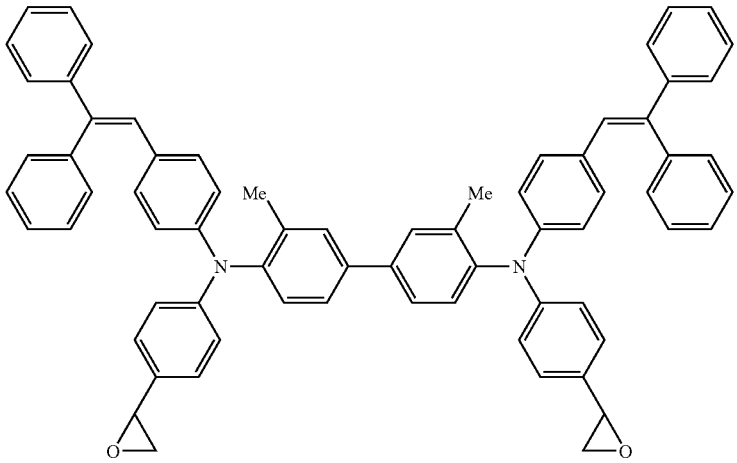 |
| II-30 | 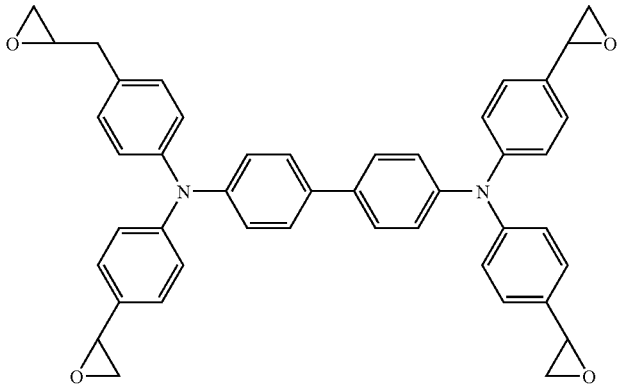 |
| II-31 | 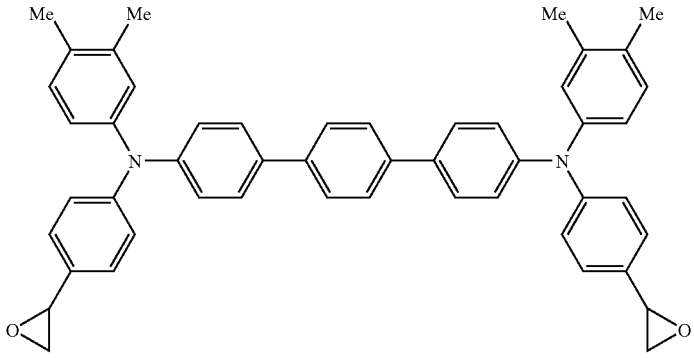 |

TABLE 23
II-32
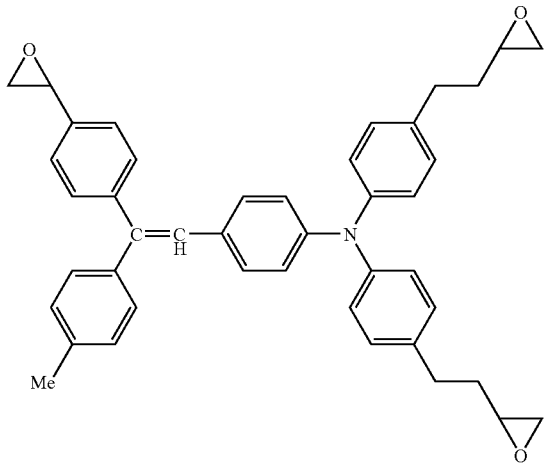
II-33
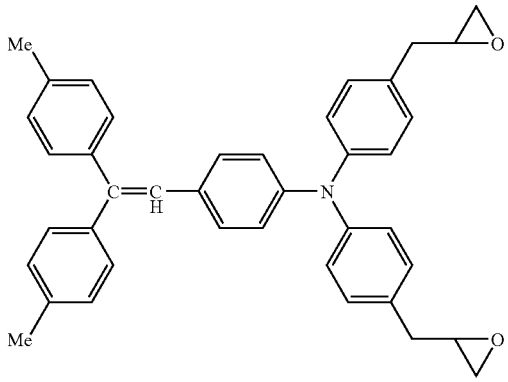
II-34
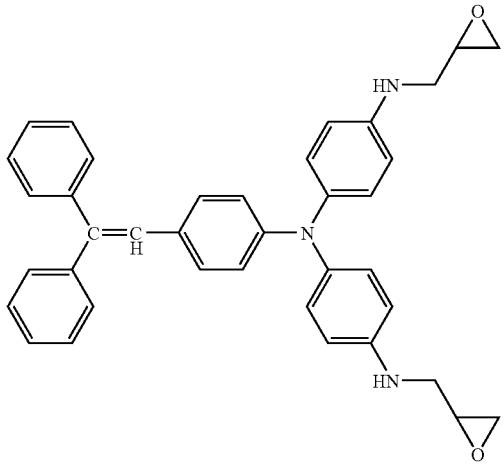
TABLE 23-continued
II-35
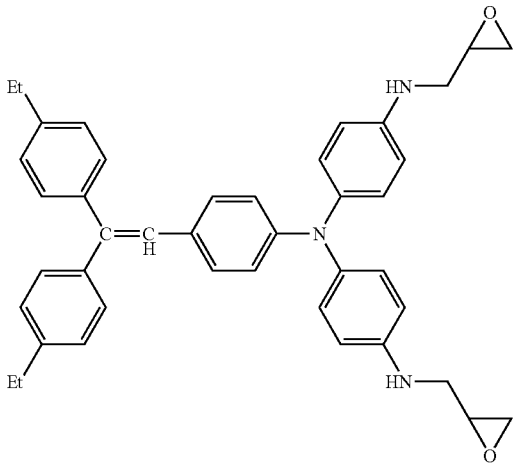
TABLE 24
II-36
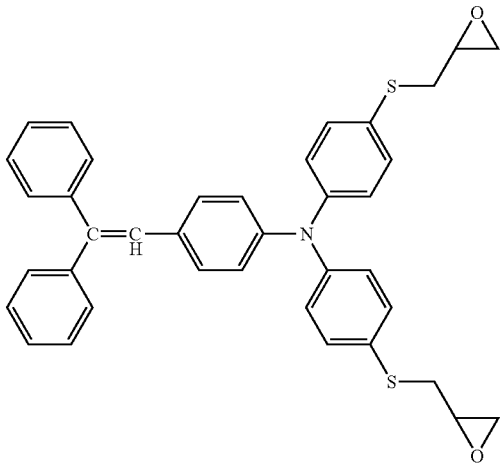
II-37
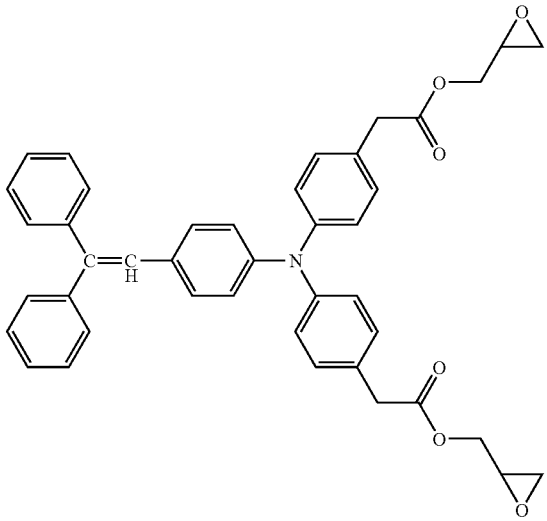

TABLE 24-continued
II-38
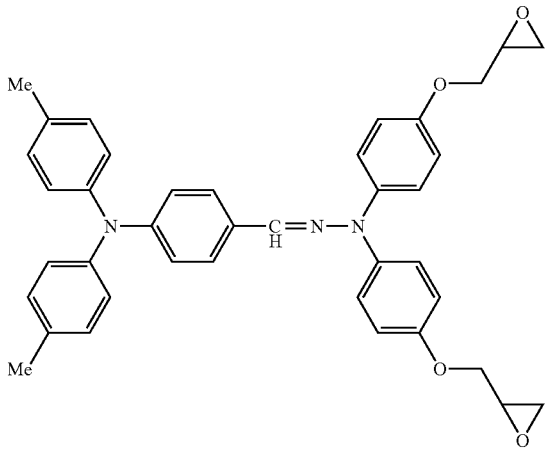
TABLE 25
II-39
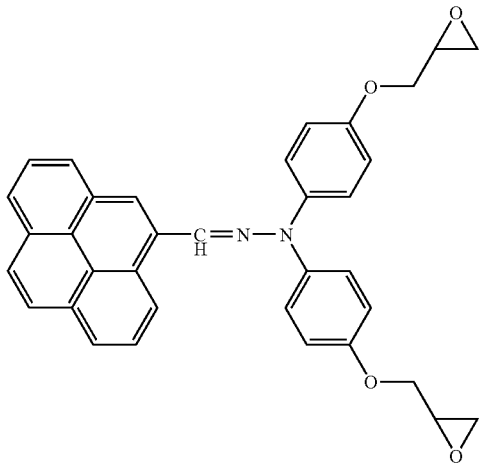
II-40
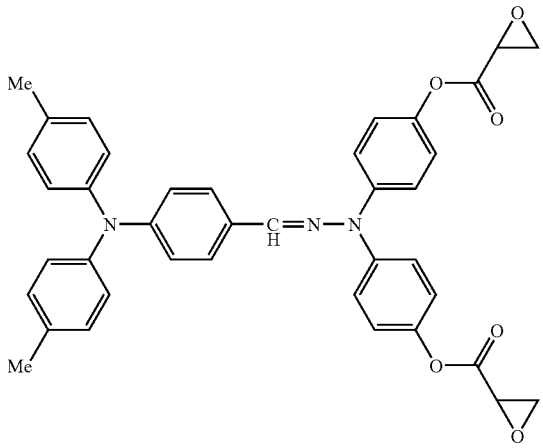
TABLE 25-continued
II-41
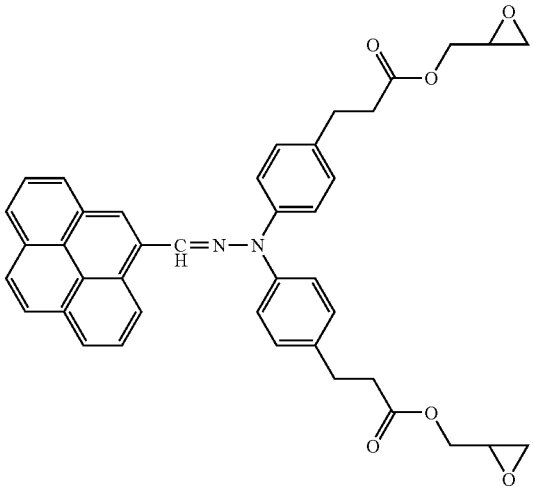
TABLE 26
II-42
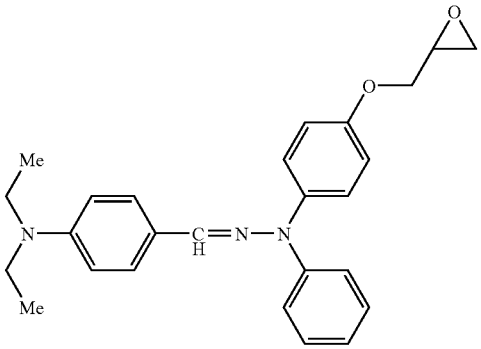
II-43
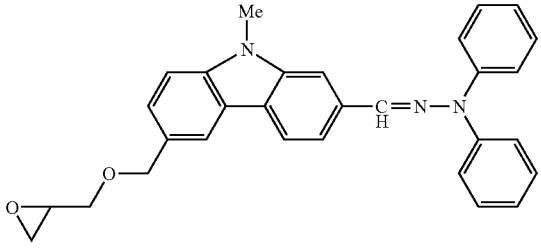

TABLE 26-continued
| | |
|---|---|
| 44 | 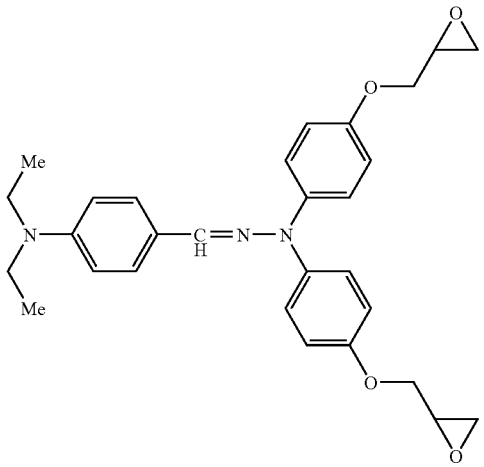 |
TABLE 27
| | |
|---|---|
| II-45 | 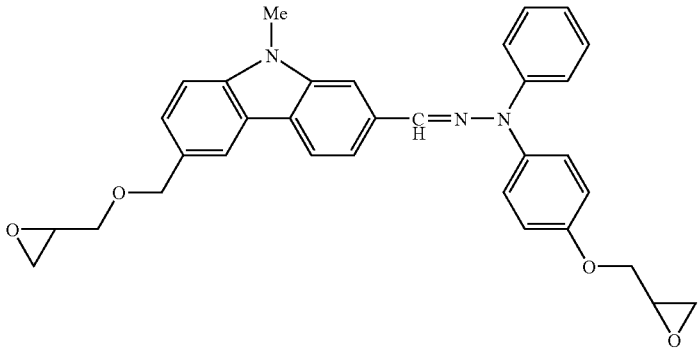 |
| II-46 | 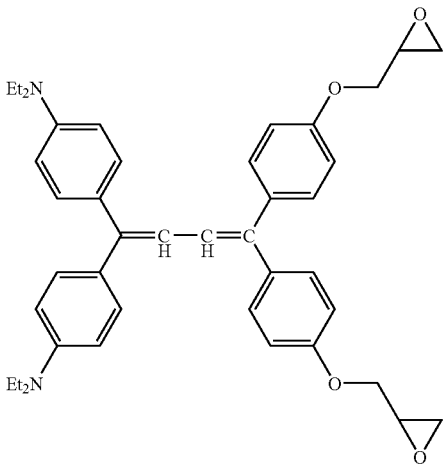 |

TABLE 27-continued

| | |
|---|---|
| II-47 | 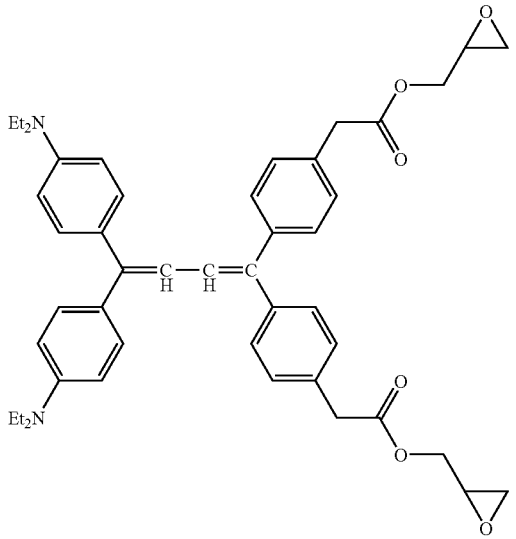 |

Specific examples of the compound represented by the general formula (III) include the following compounds (III-1) to (III-61). The compounds (III-1) to (III-61) have the combinations of $Ar^1$ to $Ar^5$ and k of the compound represented by the general formula (VII) shown in the following tables, and have the alkoxysilyl groups (which is represented by S) defined in the following tables.

TABLE 28

| No. | $Ar^1$ | $Ar^2$ | $Ar^3$ | $Ar^4$ |
|---|---|---|---|---|
| III-1 | 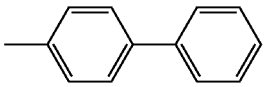 | 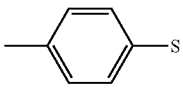 | — | — |
| III-2 | 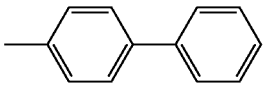 | 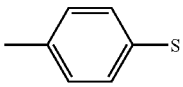 | — | — |
| III-3 | 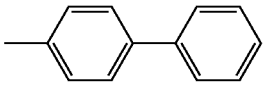 | 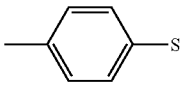 | — | — |
| III-4 | 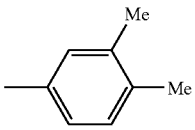 | 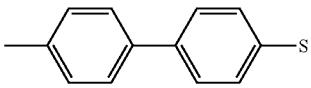 | — | — |
| III-5 | 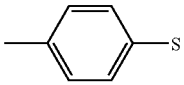 | 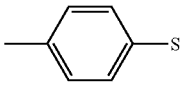 | — | — |
| III-6 | 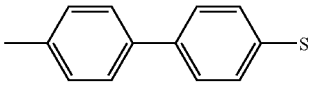 | 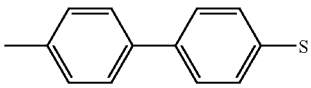 | — | — |

TABLE 28-continued
| | | | | |
|---|---|---|---|---|
| III-7 | 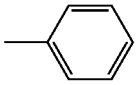 | 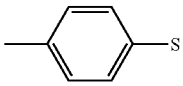 | 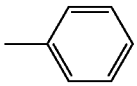 | 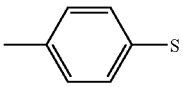 |
| No. | $Ar^5$ | k | S |
|---|---|---|---|
| III-1 | 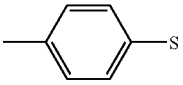 | 0 | —(CH2)2—COO—(CH2)3—Si(OiPr)3 |
| III-2 | 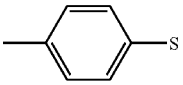 | 0 | —(CH2)2—COO—(CH2)3—Si(OiPr)2Me |
| III-3 | 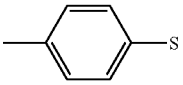 | 0 | —(CH2)2—COO—(CH2)3—Si(OiPr)Me2 |
| III-4 | 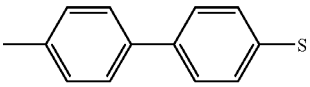 | 0 | —COO—(CH2)3—Si(OiPr)3 |
| III-5 | 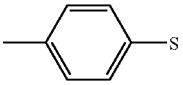 | 0 | —(CH2)2—COO—(CH2)3—Si(OiPr)3 |
| III-6 | 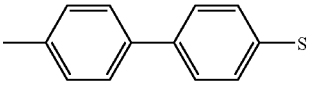 | 0 | —COO—(CH2)3—Si(OiPr)3 |
| III-7 | 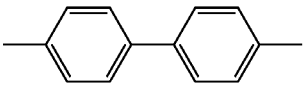 | 1 | —(CH2)4—Si(OEt)3 |
TABLE 29
| No. | $Ar^1$ | $Ar^2$ | $Ar^3$ | $Ar^4$ |
|---|---|---|---|---|
| III-8 | 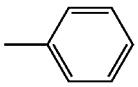 | 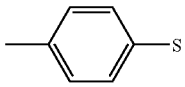 | 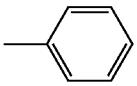 | 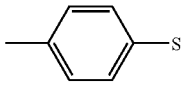 |
| III-9 | 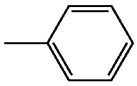 | 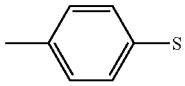 | 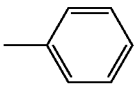 | 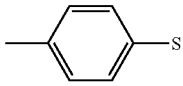 |
| III-10 | 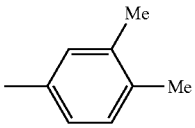 | 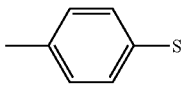 | 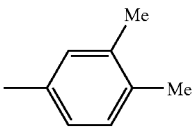 | 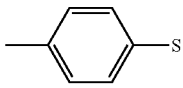 |
| III-11 | 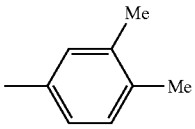 | 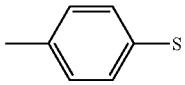 | 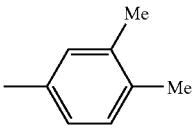 | 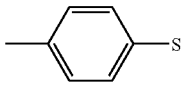 |
| III-12 | 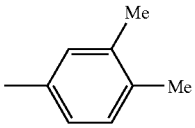 | 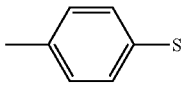 | 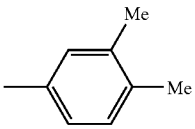 | 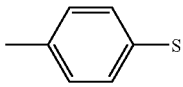 |

TABLE 29-continued
| | | | | |
|---|---|---|---|---|
| III-13 | 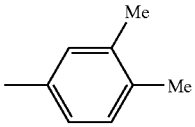 | 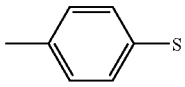 | 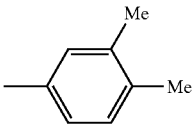 | 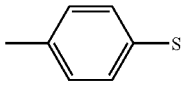 |
| III-14 | 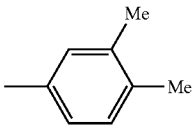 | 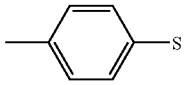 | 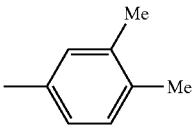 | 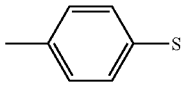 |
| No. | $Ar^5$ | k | S |
|---|---|---|---|
| III-8 | 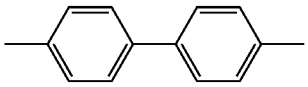 | 1 | —(CH2)4—Si(OiPr)3 |
| III-9 | 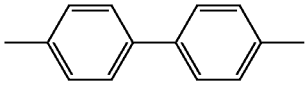 | 1 | —CH═CH—(CH2)2—Si(OiPr)3 |
| III-10 | 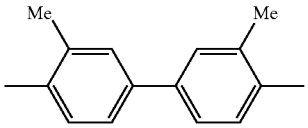 | 1 | —(CH2)4—Si(OMe)3 |
| III-11 | 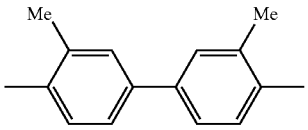 | 1 | —(CH2)4—Si(OiPr)3 |
| III-12 | 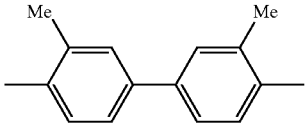 | 1 | —CH═CH—(CH2)2—Si(OiPr)3 |
| III-13 | 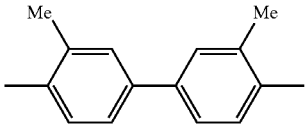 | 1 | —CH═N—(CH2)3—Si(OiPr)3 |
| III-14 | 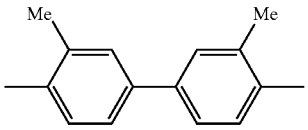 | 1 | —O—(CH2)3—Si(OiPr)3 |
TABLE 30
| No. | $Ar^1$ | $Ar^2$ | $Ar^3$ | $Ar^4$ |
|---|---|---|---|---|
| III-15 | 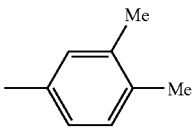 | 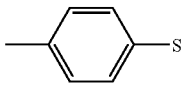 | 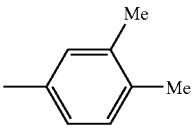 | 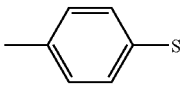 |

TABLE 30-continued
| | | | | |
|---|---|---|---|---|
| III-16 | 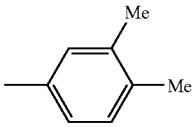 | 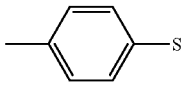 | 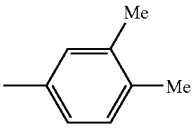 | 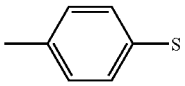 |
| III-17 | 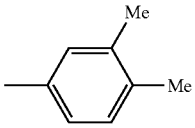 | 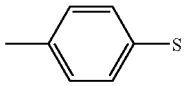 | 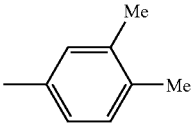 | 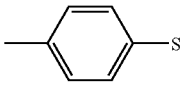 |
| III-18 | 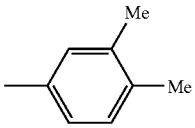 | 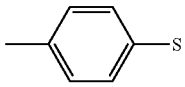 | 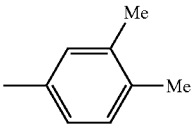 | 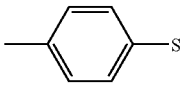 |
| III-19 | 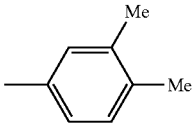 | 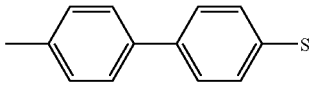 | 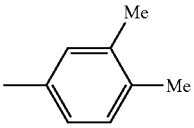 | 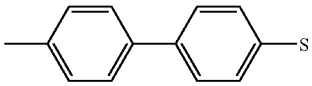 |
| III-20 | 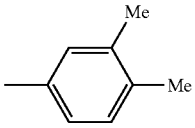 | 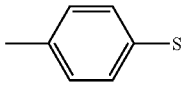 | 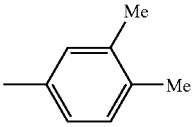 | 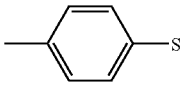 |
| No. | $Ar^5$ | k | S |
|---|---|---|---|
| III-15 | 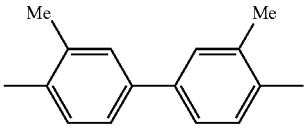 | 1 | —COO—(CH2)3—Si(OiPr)3 |
| III-16 | 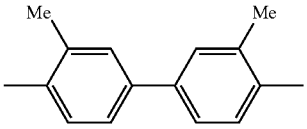 | 1 | —(CH2)2—COO—(CH2)3—Si(OiPr)3 |
| III-17 | 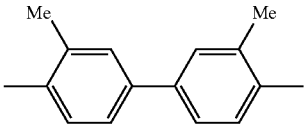 | 1 | —(CH2)2—COO—(CH2)3—Si(OiPr)2Me |
| III-18 | 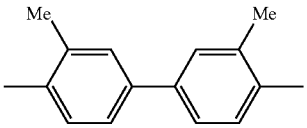 | 1 | —(CH2)2—COO—(CH2)3—Si(OiPr)Me2 |
| III-19 | 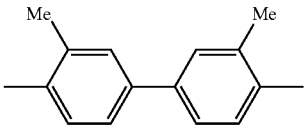 | 1 | —COO—(CH2)3—Si(OiPr)3 |
| III-20 | 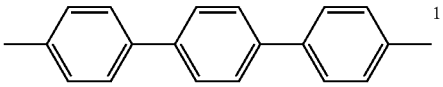 | 1 | —(CH2)4—Si(OiPr)3 |

TABLE 31
| No. | $Ar^1$ | $Ar^2$ | $Ar^3$ | $Ar^4$ |
|---|---|---|---|---|
| III-21 | 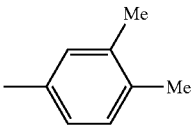 | 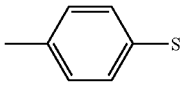 | 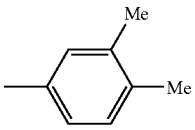 | 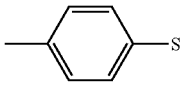 |
| III-22 | 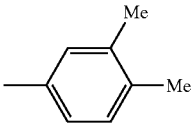 | 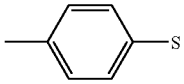 | 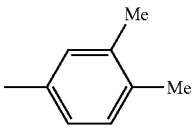 | 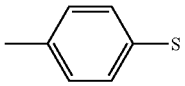 |
| III-23 | 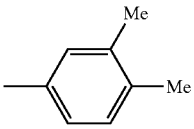 | 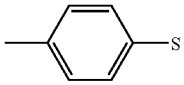 | 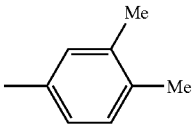 | 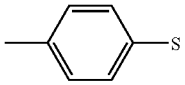 |
| III-24 | 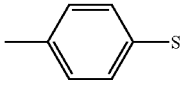 | 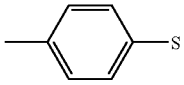 | 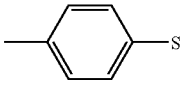 | 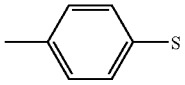 |
| III-25 | 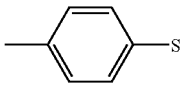 | 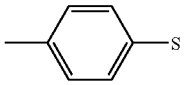 | 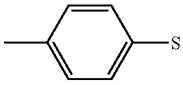 | 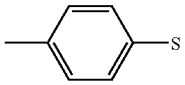 |
| III-26 | 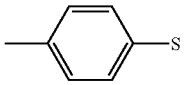 | 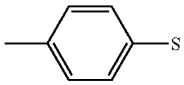 | 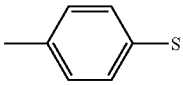 | 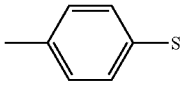 |
| III-27 | 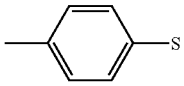 | 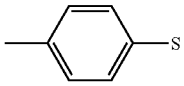 | 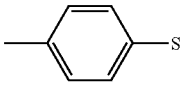 | 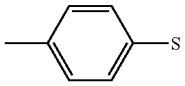 |
| III-28 | 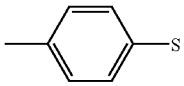 | 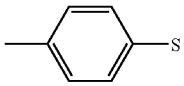 | 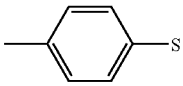 | 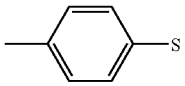 |
| No. | $Ar^5$ | k | S |
|---|---|---|---|
| III-21 | 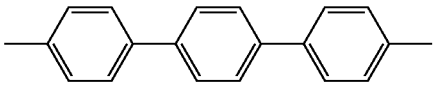 | 1 | —CH═CH—(CH2)2—Si(OiPr)3 |
| III-22 | 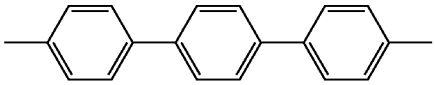 | 1 | —(CH2)2—COO—(CH2)3—Si(OiPr)3 |
| III-23 | 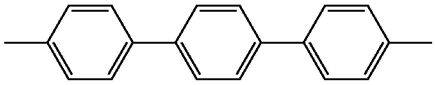 | 1 | —(CH2)2—COO—(CH2)3—Si(OiPr)2Me |
| III-24 | 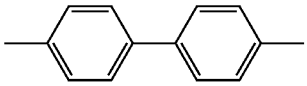 | 1 | —COO—(CH2)3—Si(OiPr)3 |
| III-25 | 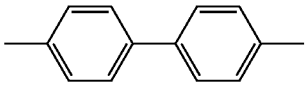 | 1 | —(CH2)2—COO—(CH2)3—Si(OiPr)3 |
| III-26 | 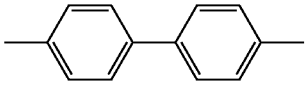 | 1 | —(CH2)2—COO—(CH2)3—Si(OiPr)2Me |

TABLE 31-continued

| | | | |
|---|---|---|---|
| III-27 | | 1 | —(CH2)2—COO—(CH2)3—Si(OiPr)Me2 |
| III-28 | Me Me | 1 | —COO—(CH2)3—Si(OiPr)3 |

TABLE 32

| No. | $Ar^1$ | $Ar^2$ | $Ar^3$ | $Ar^4$ |
|---|---|---|---|---|
| III-29 | S | S | S | S |
| III-30 | S | S | S | S |
| III-31 | S | S | S | S |
| III-32 | | | — | — |
| III-33 | | | — | — |
| III-34 | | | — | — |
| III-35 | | | — | — |
| III-36 | | | — | — |

| No. | $Ar^5$ | k | S |
|---|---|---|---|
| III-29 | Me Me | 1 | —(CH2)2—COO—(CH2)3—Si(OiPr)3 |
| III-30 | Me Me | 1 | —(CH2)2—COO—(CH2)3—Si(OiPr)2Me |

TABLE 32-continued
| | | | |
|---|---|---|---|
| III-31 | 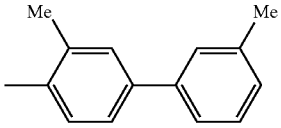 | 1 | —(CH2)2—COO—(CH2)3—Si(OiPr)Me2 |
| III-32 | 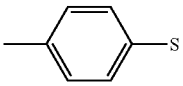 | 0 | —(CH2)4—Si(OiPr)3 |
| III-33 | 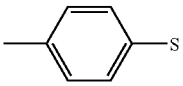 | 0 | —(CH2)4—Si(OEt)3 |
| III-34 | 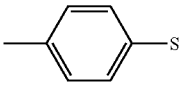 | 0 | —(CH2)4—Si(OMe)3 |
| III-35 | 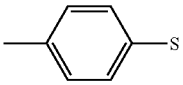 | 0 | —(CH2)4—SiMe(OMe)2 |
| III-36 | 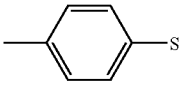 | 0 | —(CH2)4—SiMe(OiPr)2 |
TABLE 33
| No. | $Ar^1$ | $Ar^2$ | $Ar^3$ | $Ar^4$ | $Ar^5$ | k | S |
|---|---|---|---|---|---|---|---|
| III-37 | 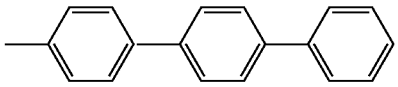 | | — | — | 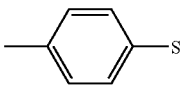 | 0 | —CH═CH—(CH2)2—Si(OiPr)3 |
| III-38 | 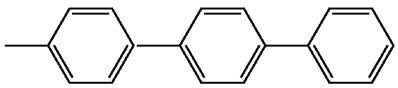 | | — | — | 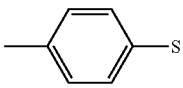 | 0 | —CH═CH—(CH2)2—Si(OMe)3 |
| III-39 | 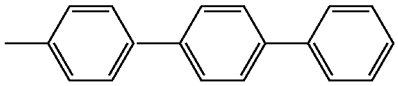 | | — | — | 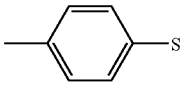 | 0 | —CH═N—(CH2)3—Si(OiMe)3 |
| III-40 | 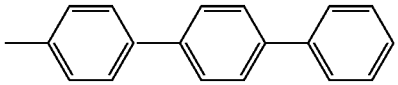 | | — | — | 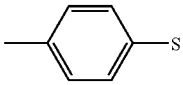 | 0 | —CH═N—(CH2)3—Si(OiPr)3 |
| III-41 | 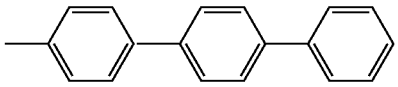 | | — | — | 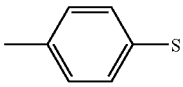 | 0 | —O—(CH2)3—Si(OiPr)3 |
| III-42 | 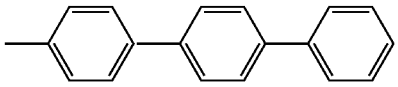 | | — | — | 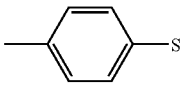 | 0 | —COO—(CH2)3—Si(OiPr)3 |
| III-43 | 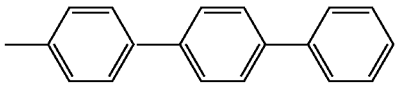 | | — | — | 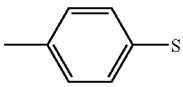 | 0 | —(CH2)2—COO—(CH2)3—Si(OiPr)3 |
| III-44 | 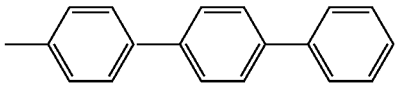 | | — | — | 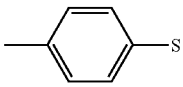 | 0 | —(CH2)2—COO—(CH2)3—Si(OiPr)2Me |

TABLE 34
| No. | $Ar^1$ | $Ar^2$ | $Ar^3$ | $Ar^4$ |
|---|---|---|---|---|
| III-45 | 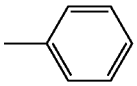 | 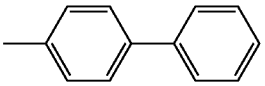 | — | — |
| III-46 | 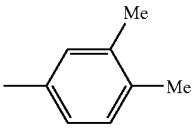 | 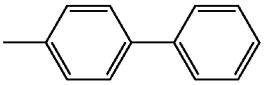 | — | — |
| III-47 | 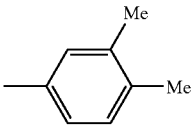 | 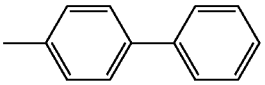 | — | — |
| III-48 | 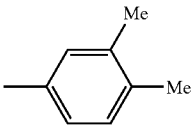 | 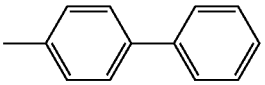 | — | — |
| III-49 | 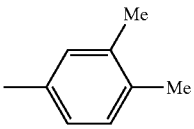 | 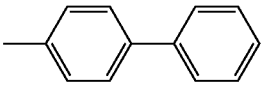 | — | — |
| III-50 | 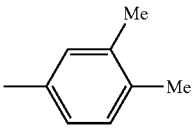 | 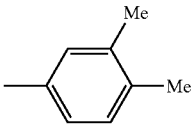 | — | — |
| III-51 | 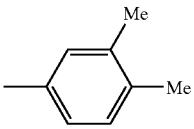 | 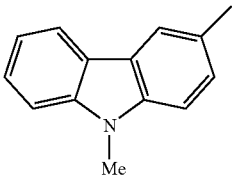 | — | — |
| III-52 | 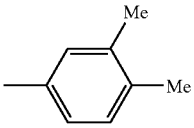 | 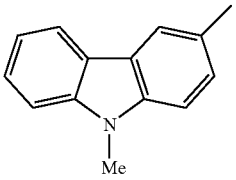 | — | — |
| No. | $Ar^5$ | k | S |
|---|---|---|---|
| III-45 | 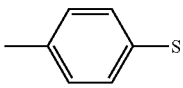 | 0 | —(CH2)2—COO—(CH2)3—Si(OiPr)Me2 |
| III-46 | 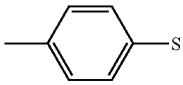 | 0 | —(CH2)4—Si(OMe)3 |

TABLE 34-continued
| | | | |
|---|---|---|---|
| III-47 | 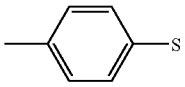 | 0 | —(CH2)2—COO—(CH2)3—Si(OiPr)3 |
| III-48 | 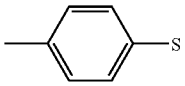 | 0 | —(CH2)2—COO—(CH2)3—SiMe(OiPr)2 |
| III-49 | 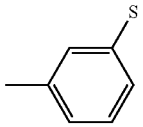 | 0 | —O—(CH2)3—Si(OiPr)3 |
| III-50 | 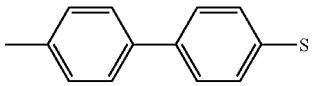 | 0 | —COO—(CH2)3—Si(OiPr)3 |
| III-51 | 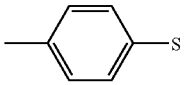 | 0 | —(CH2)4—Si(OiPr)3 |
| III-52 | 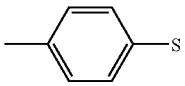 | 0 | —(CH2)2—COO—(CH2)3—Si(OiPr)3 |
TABLE 35
| No. | $Ar^1$ | $Ar^2$ | $Ar^3$ | $Ar^4$ |
|---|---|---|---|---|
| III-53 | 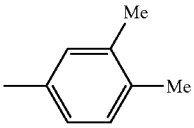 | 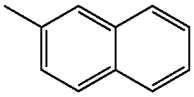 | — | — |
| III-54 | 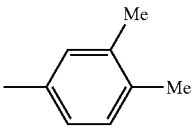 | 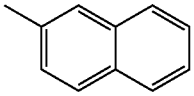 | — | — |
| III-55 | 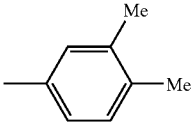 | 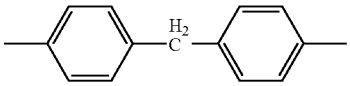 | — | — |
| III-56 | 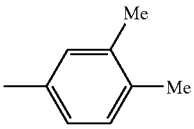 | 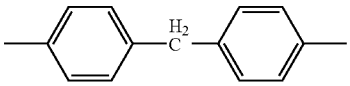 | — | — |
| III-57 | 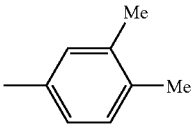 | 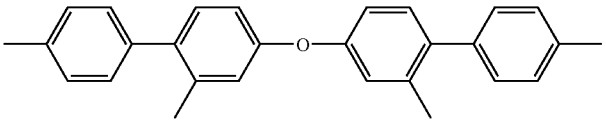 | — | — |

TABLE 35-continued
| | | | | |
|---|---|---|---|---|
| III-58 | 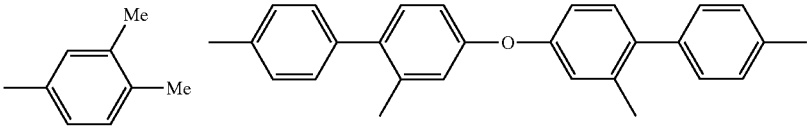 | | — | — |
| III-59 | 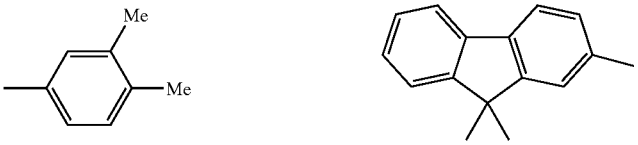 | | — | — |
| III-60 | 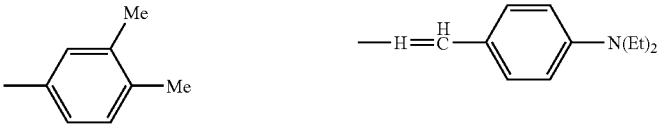 | | — | — |
| III-61 | 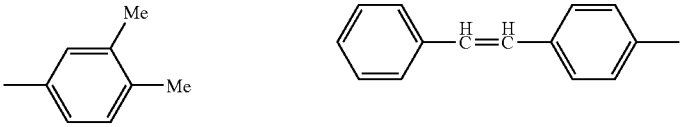 | | — | — |
| No. | $Ar^5$ | k | S |
|---|---|---|---|
| III-53 | 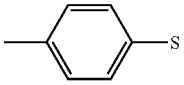 | 0 | —(CH2)4—Si(OiPr)3 |
| III-54 | 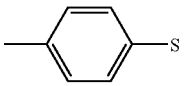 | 0 | —(CH2)2—COO—(CH2)3—Si(OiPr)3 |
| III-55 | 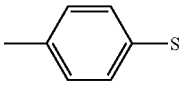 | 0 | —(CH2)4—Si(OiPr)3 |
| III-56 | 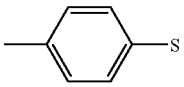 | 0 | —(CH2)2—COO—(CH2)3—Si(OiPr)3 |
| III-57 | 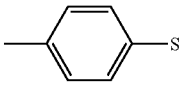 | 0 | —(CH2)4—Si(OiPr)3 |
| III-58 | 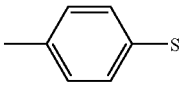 | 0 | —(CH2)2—COO—(CH2)3—Si(OiPr)3 |
| III-59 | 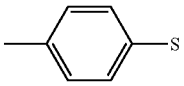 | 0 | —(CH2)2—COO—(CH2)3—Si(OiPr)3 |
| III-60 | 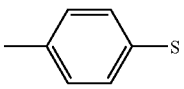 | 0 | —(CH2)2—COO—(CH2)3—Si(OiPr)3 |
| III-61 | 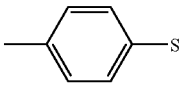 | 0 | —(CH2)2—COO—(CH2)3—Si(OiPr)3 |

Specific examples of the compound represented by the general formula (IV) include the following compounds (IV-1) to (IV-40). In the compounds (IV-1) to (IV-40), Me and the bond shown with no substituent each represents a methyl group, and Et represents an ethyl group.
TABLE 36
IV-1
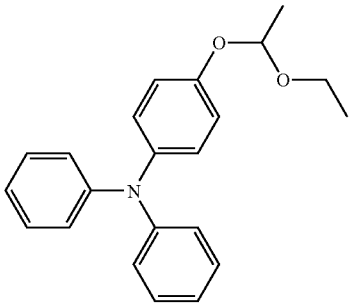
IV-2
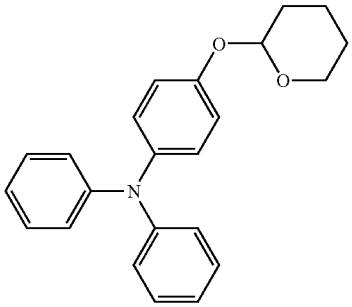
IV-3
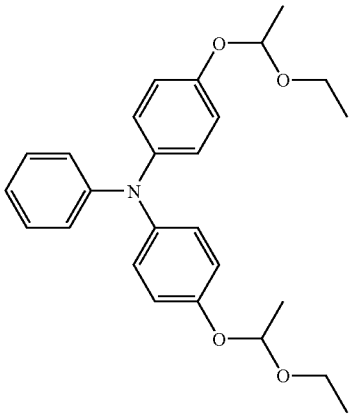
IV-4
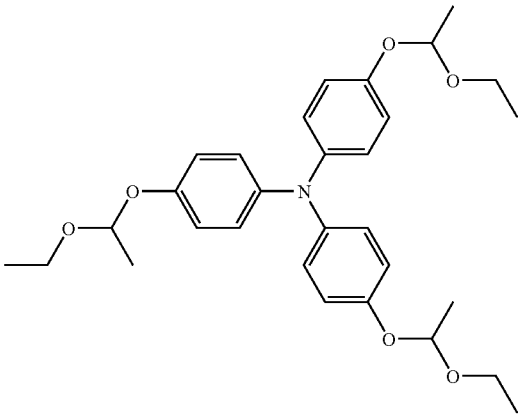
TABLE 37
IV-5
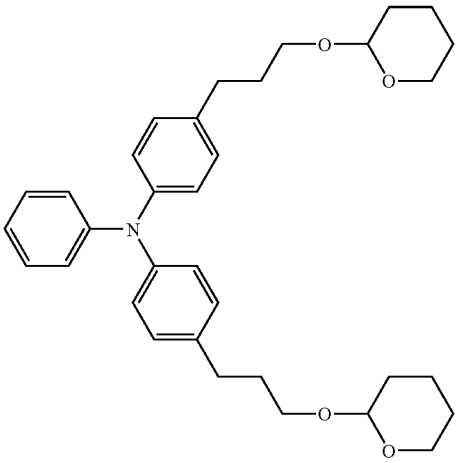
IV-6
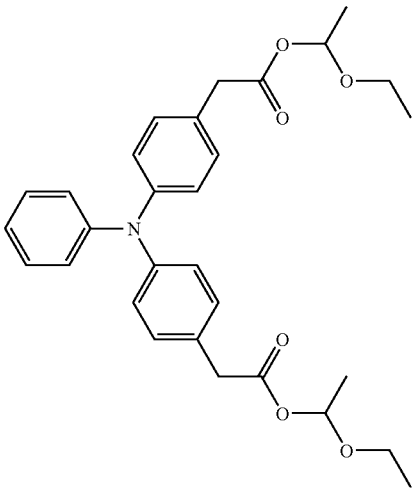
IV-7
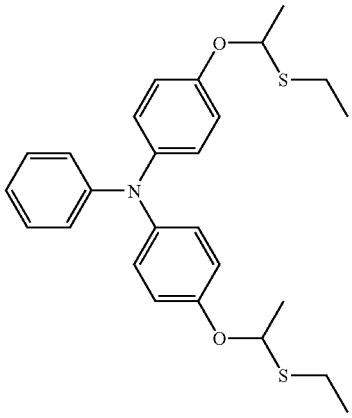

TABLE 37-continued
IV-8
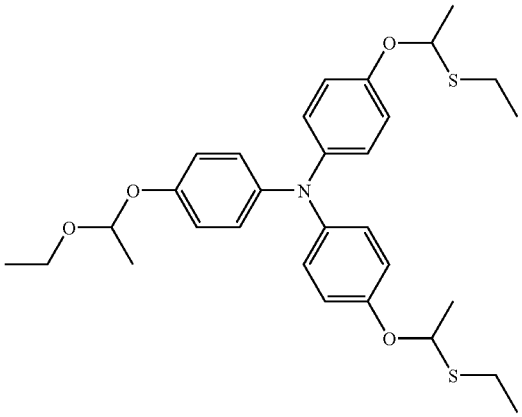
TABLE 38
IV-9
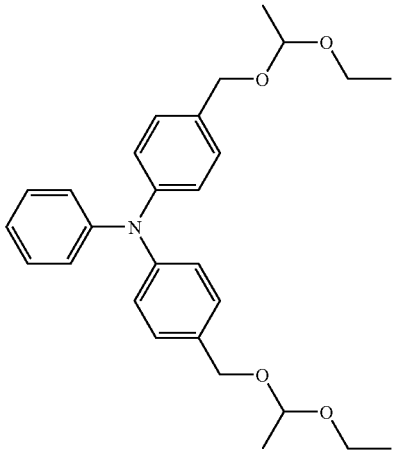
IV-10
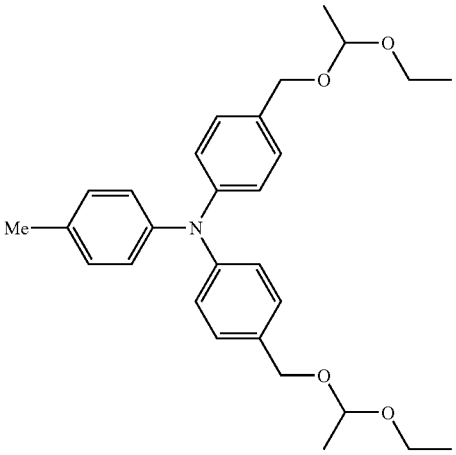
TABLE 38-continued
IV-11
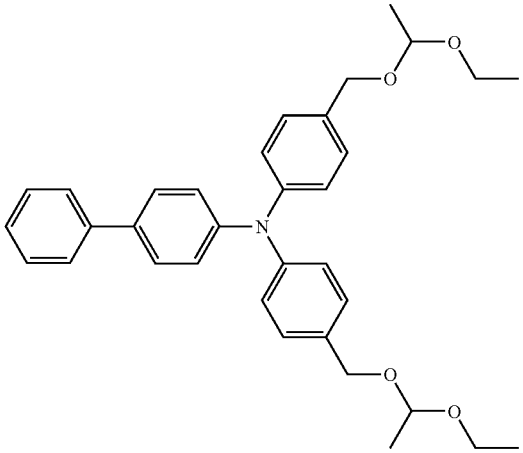
IV-12
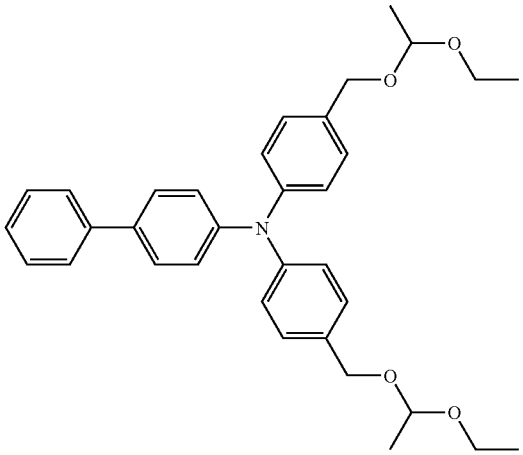

TABLE 39
IV-13
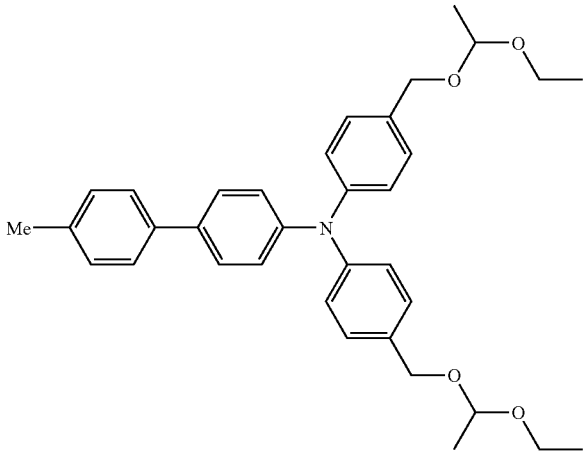
IV-14
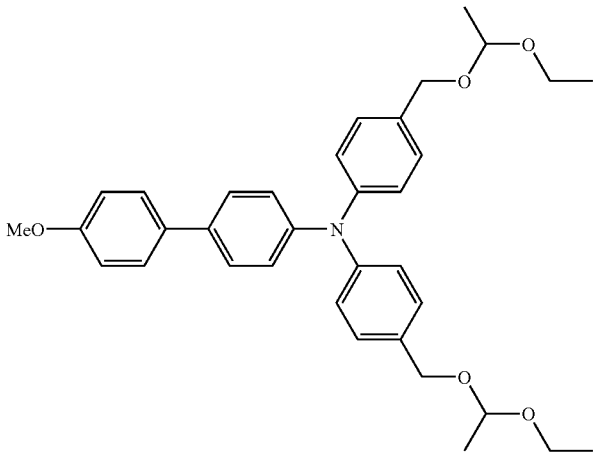
IV-15
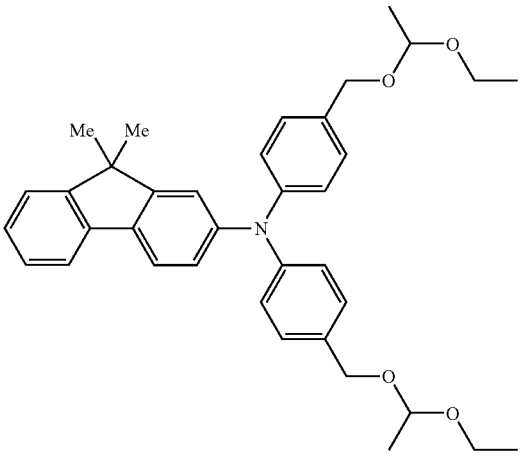

TABLE 39-continued
IV-16
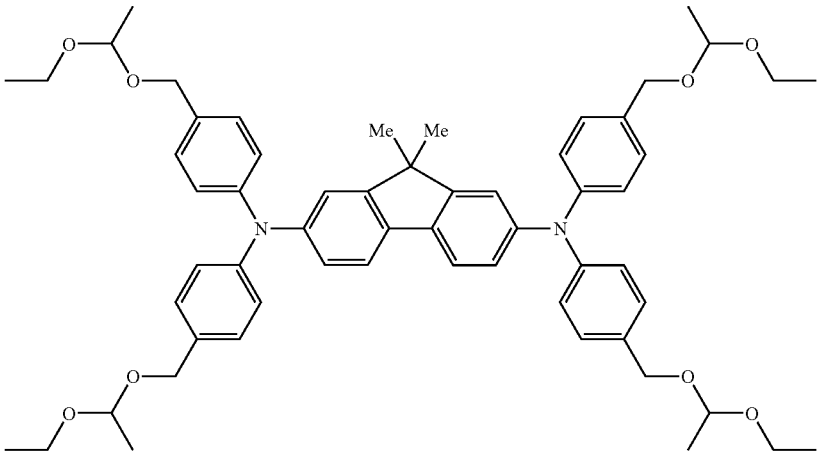
TABLE 40
IV-17
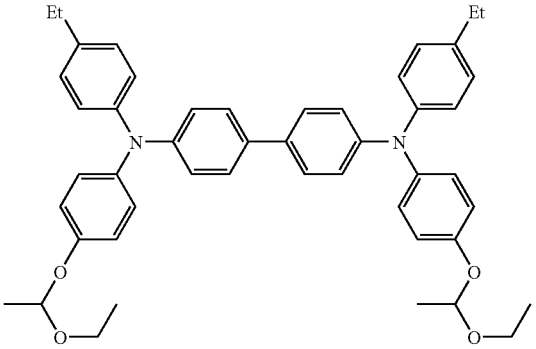
IV-18
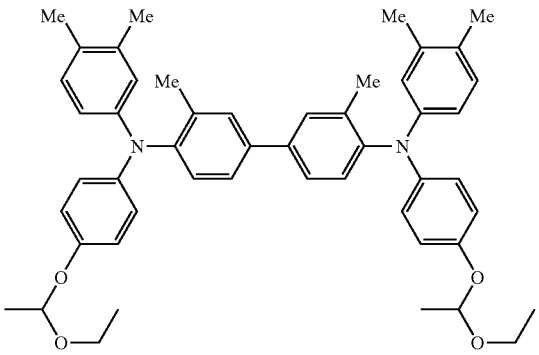
TABLE 40-continued
IV-19
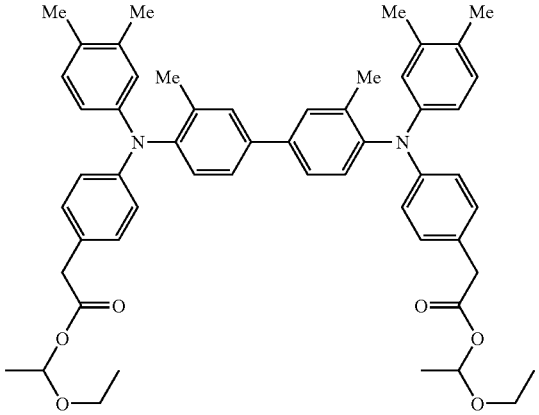
IV-20
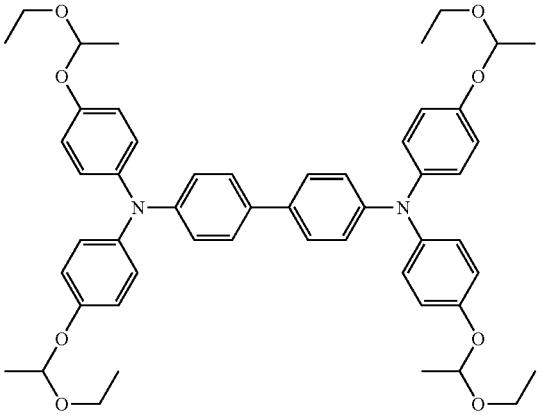

TABLE 41
IV-21
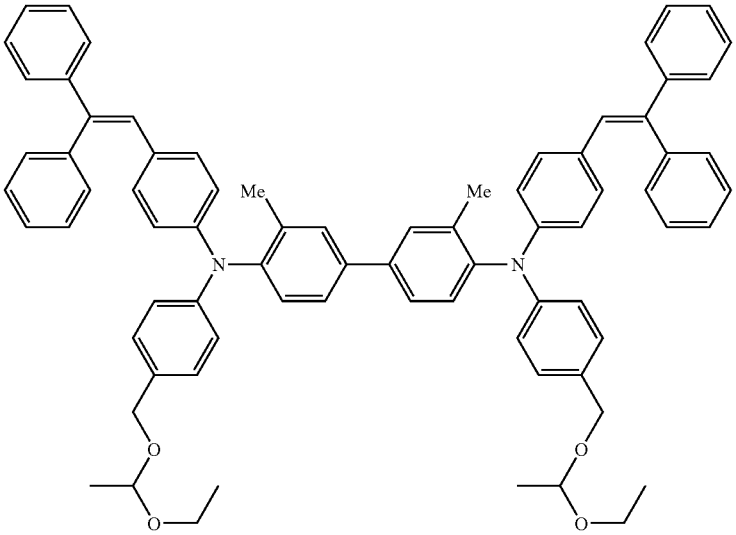
IV-22
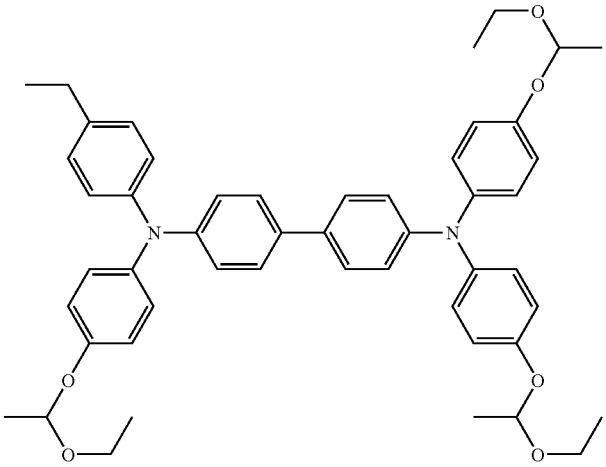
IV-23
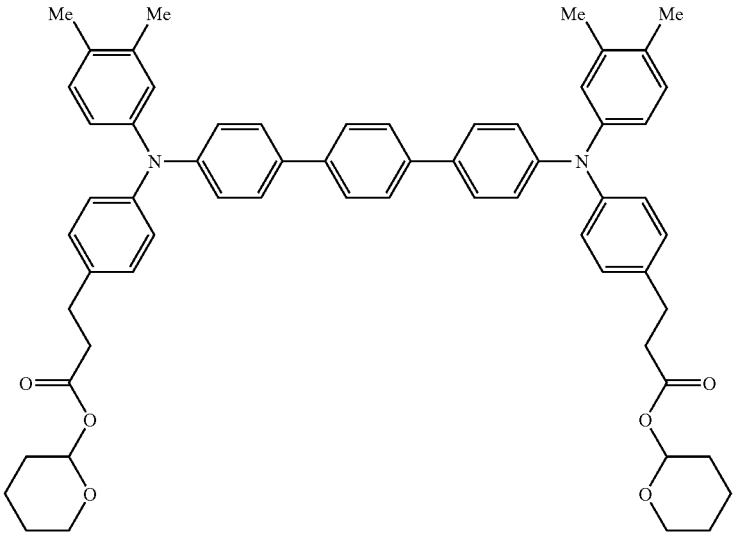

TABLE 41-continued
| | |
|---|---|
| IV-24 | 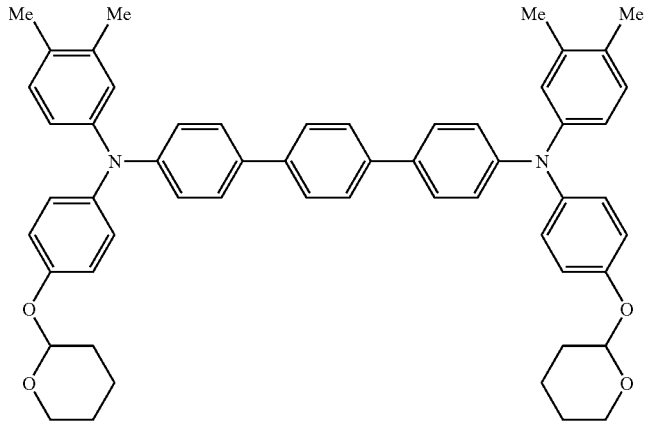 |
TABLE 42
| | |
|---|---|
| IV-25 | 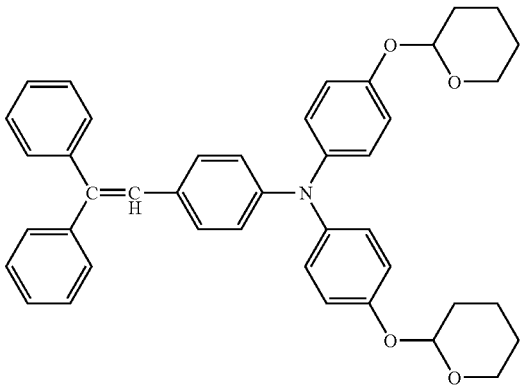 |
| IV-26 | 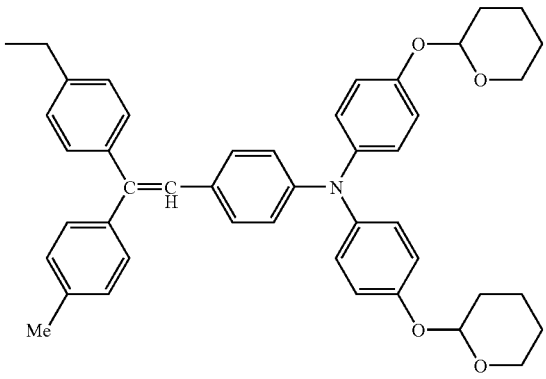 |
TABLE 42-continued
| | |
|---|---|
| IV-27 | 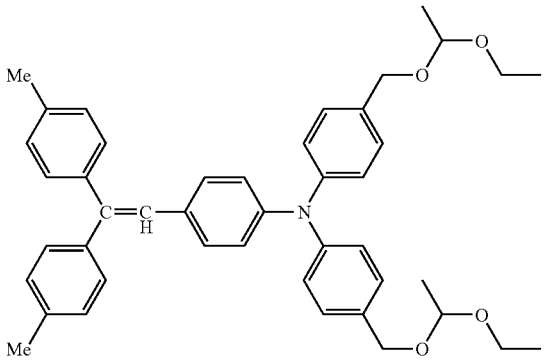 |
| IV-28 | 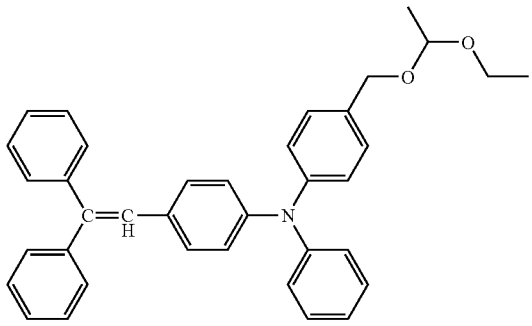 |

TABLE 43
IV-29
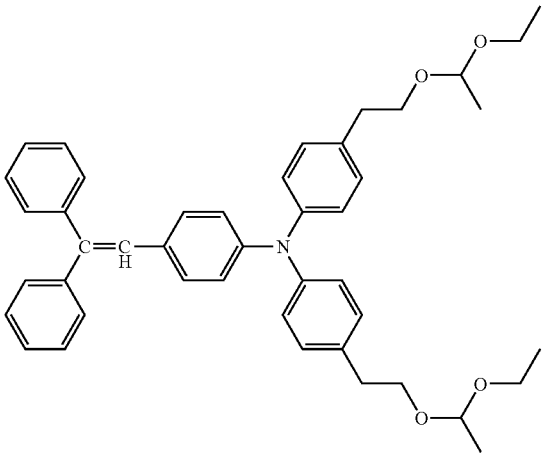
IV-30
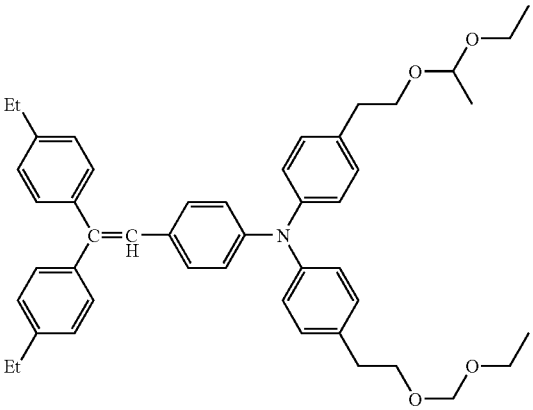
IV-31
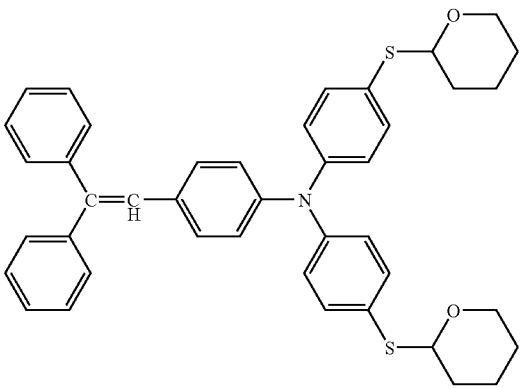
TABLE 43-continued
IV-32
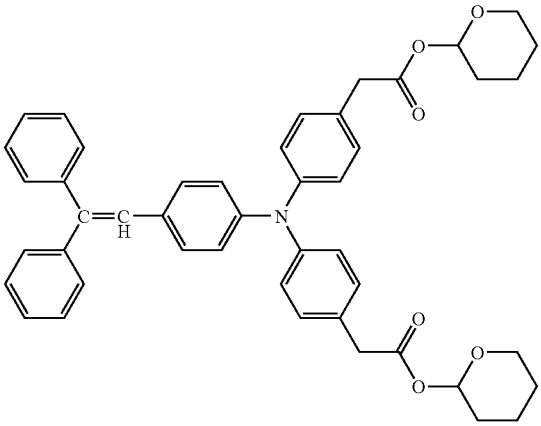
TABLE 44
IV-33
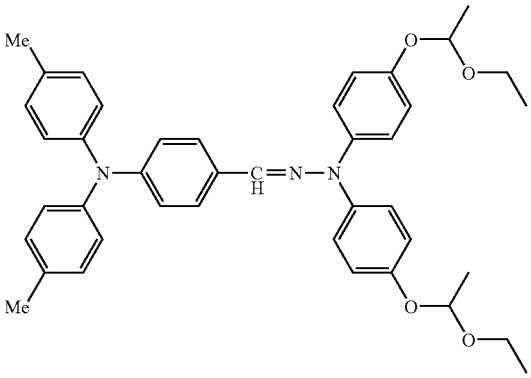
IV-34
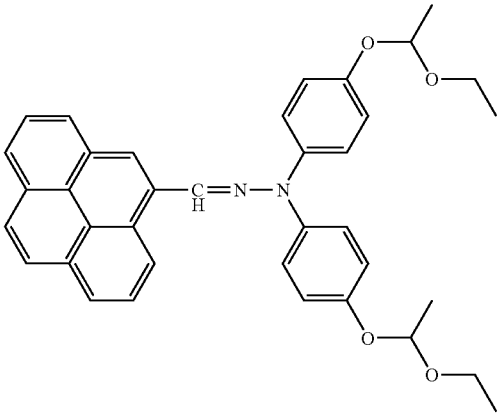

TABLE 44-continued
IV-35
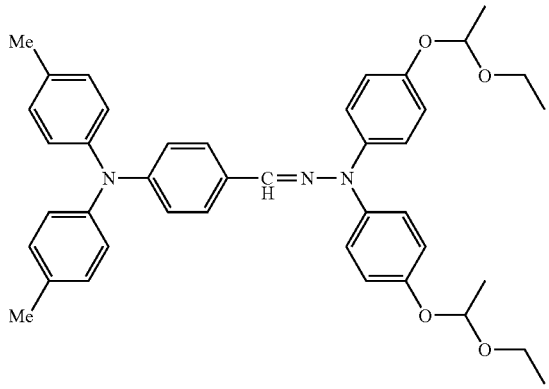
IV-36
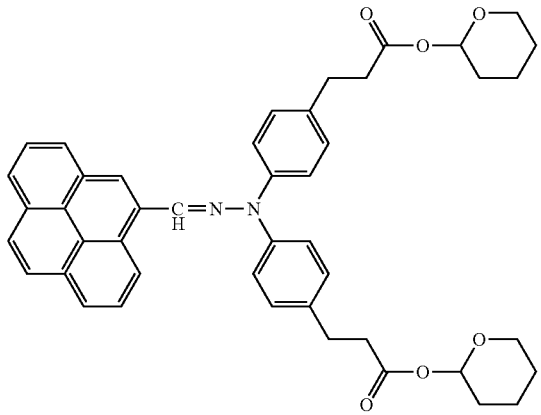
TABLE 45
IV-37
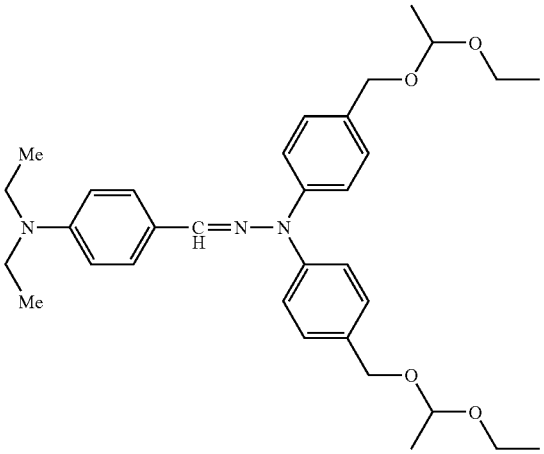
TABLE 45-continued
IV-38
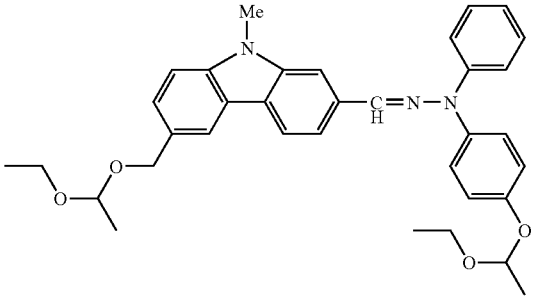
IV-39
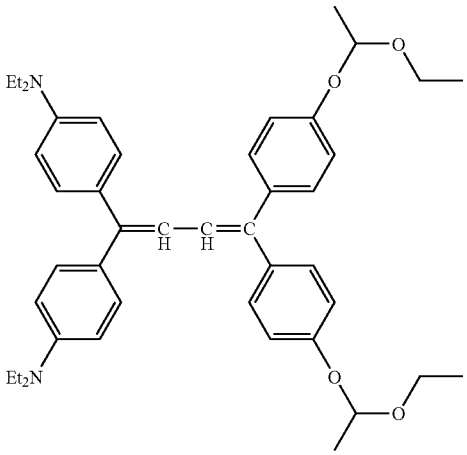
IV-40
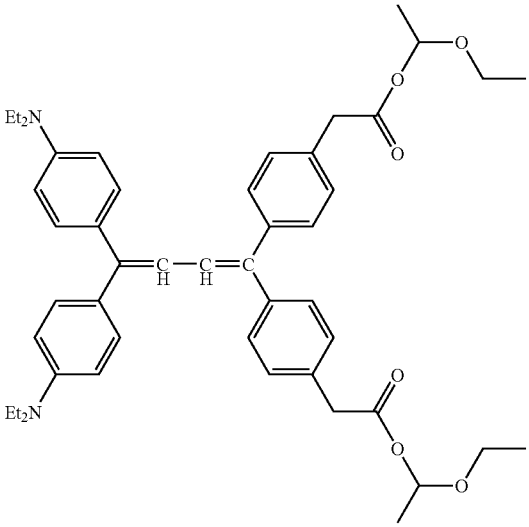
Specific examples of the compound represented by the general formula (V) include the following compounds (V-1) to (V-55). In the compounds (V-1) to (V-55), Me and the bond shown with no substituent each represents a methyl group.

TABLE 46
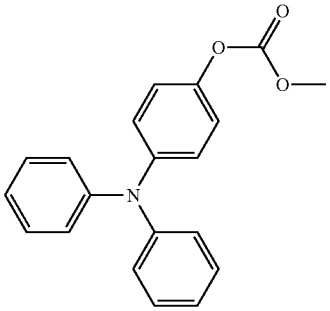
(V-1)
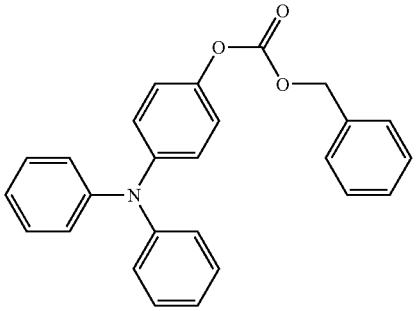
(V-2)
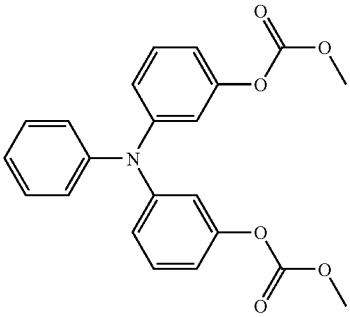
(V-3)
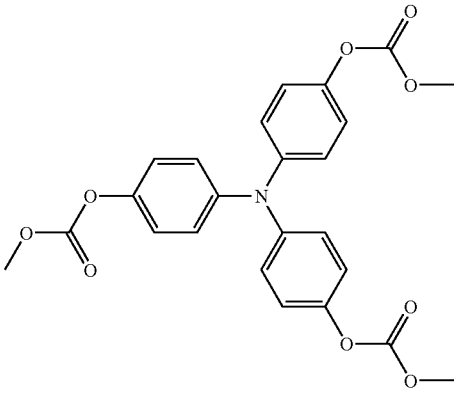
(V-4)
TABLE 46-continued
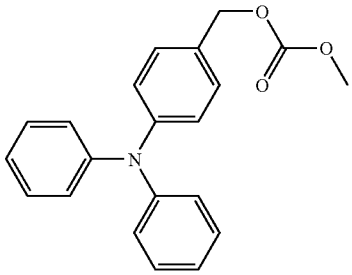
(V-5)
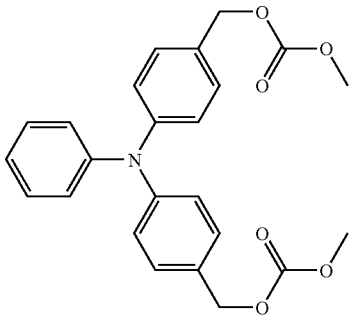
(V-6)
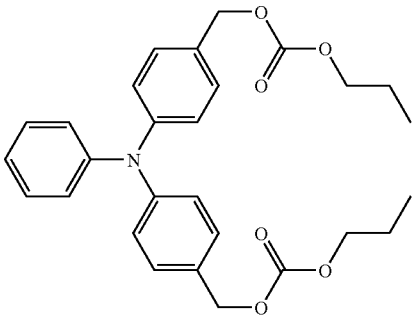
(V-7)
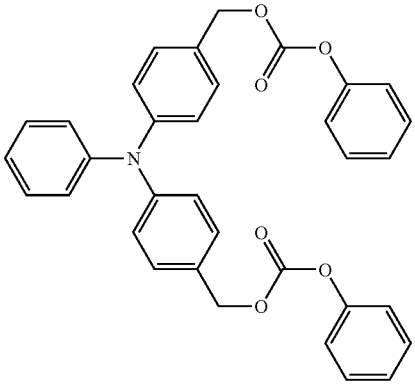
(V-8)

TABLE 47
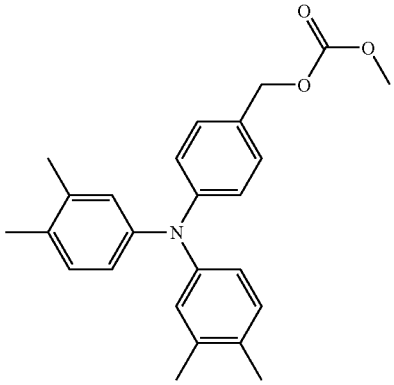
(V-9)
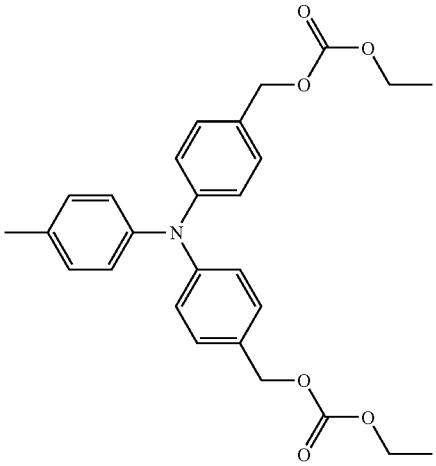
(V-10)
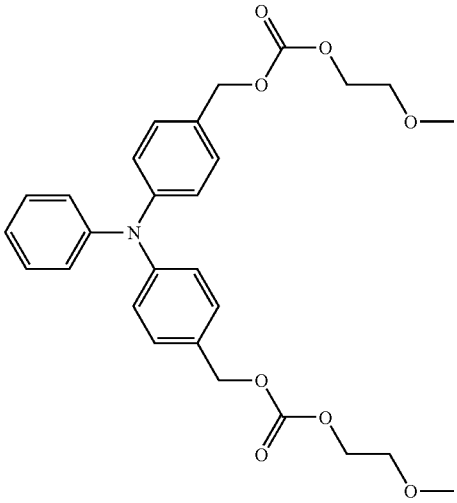
(V-11)
TABLE 47-continued
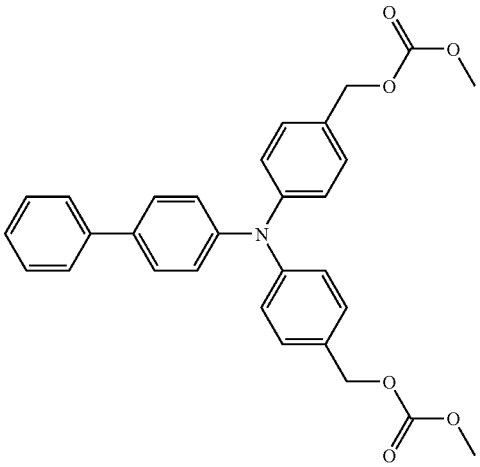
(V-12)
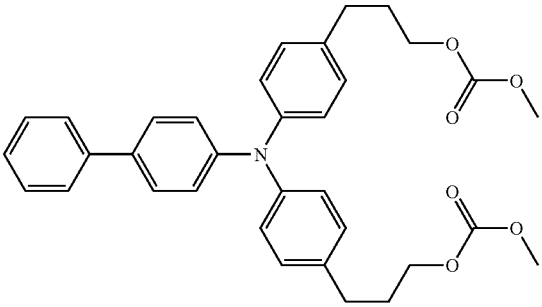
(V-13)
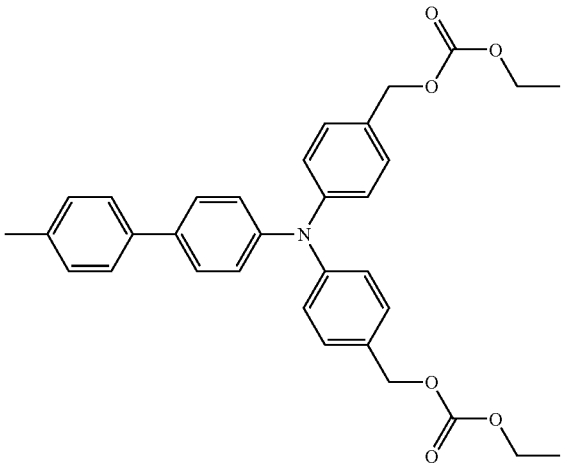
(V-14)

TABLE 48
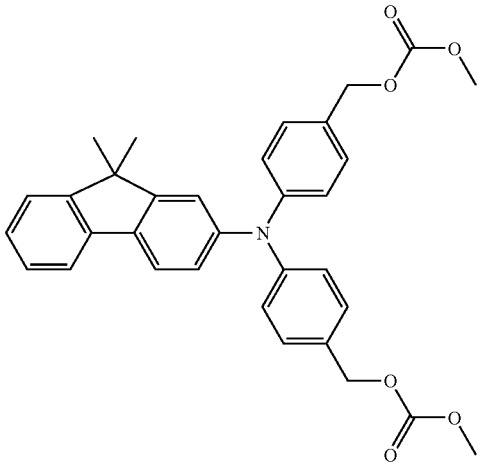
(V-15)
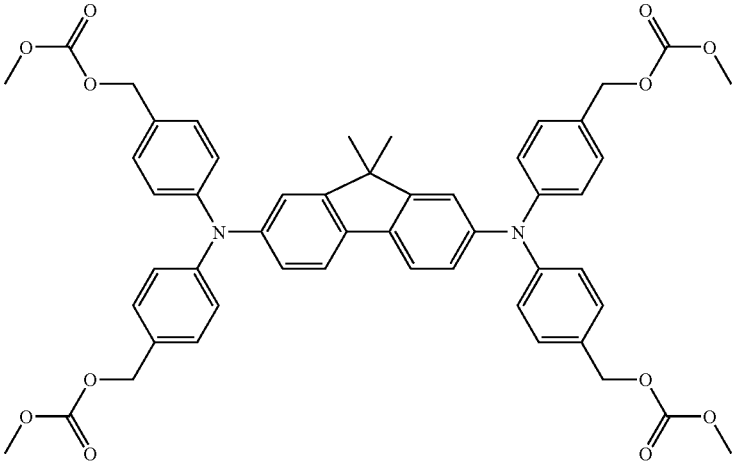
(V-16)
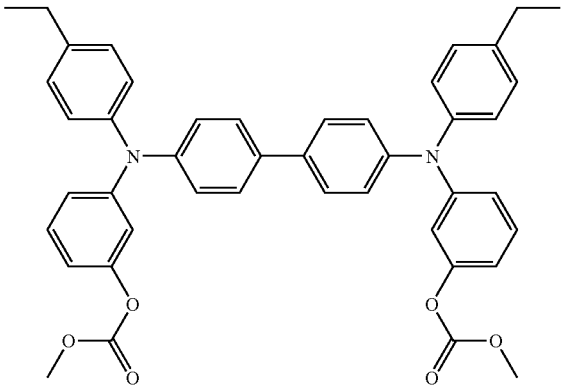
(V-17)

TABLE 48-continued
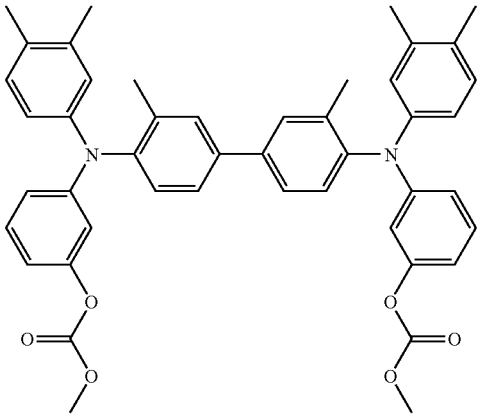
(V-18)
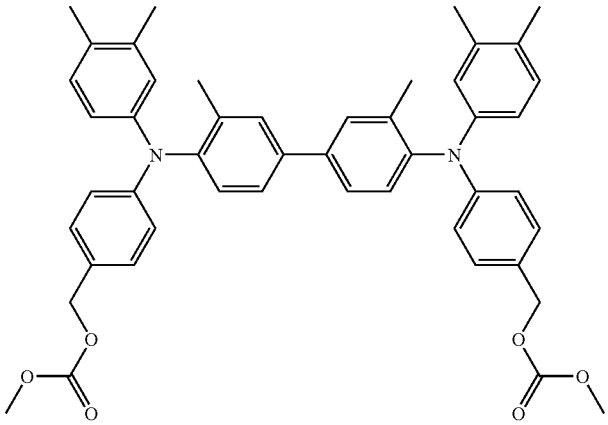
(V-19)
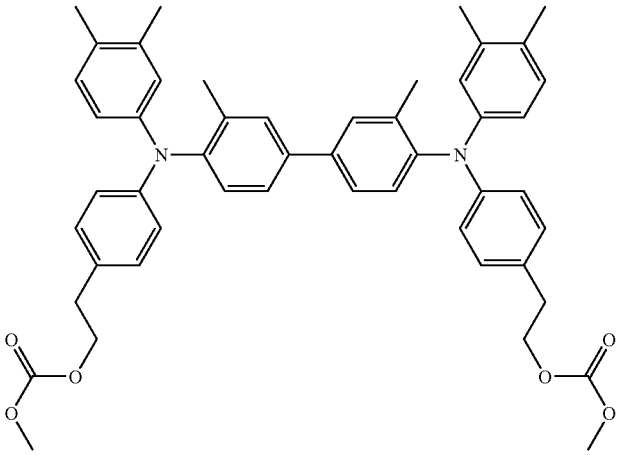
(V-20)

TABLE 49
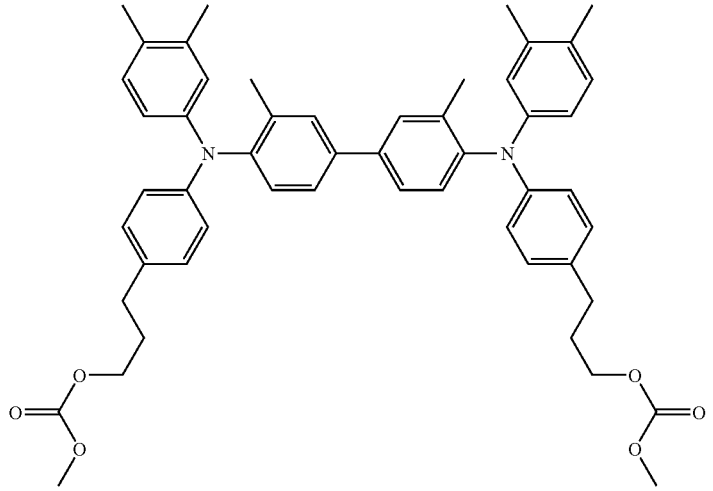
(V-21)
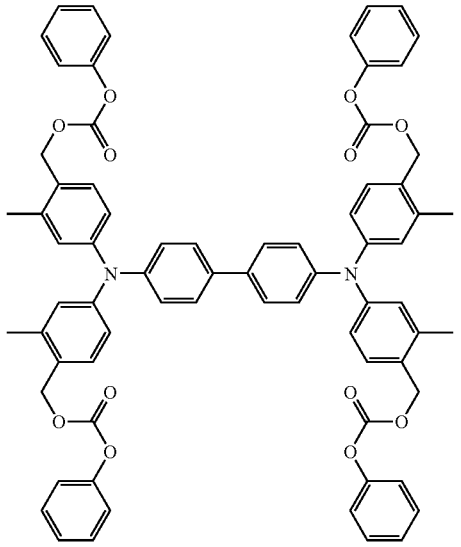
(V-22)
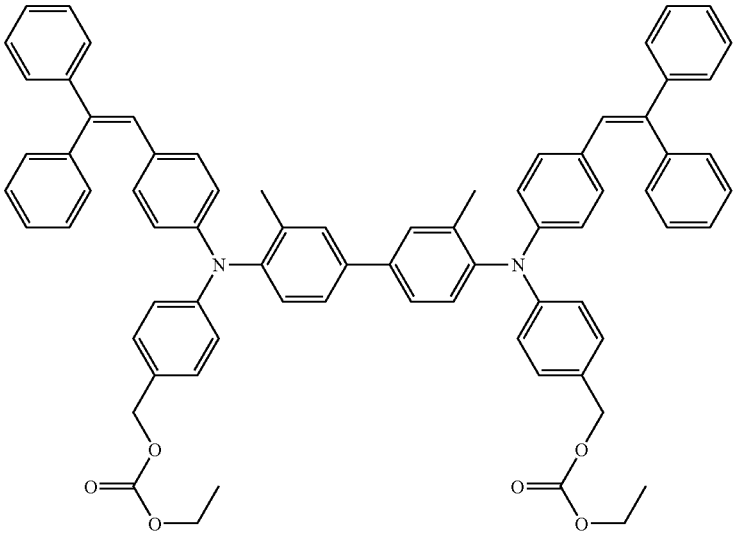
(V-23)

TABLE 49-continued
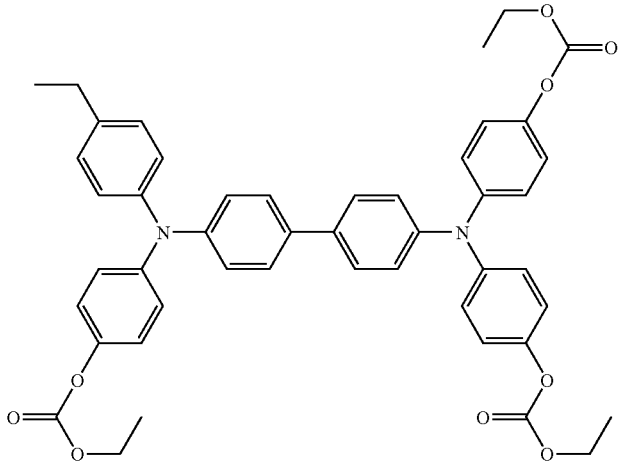
(V-24)
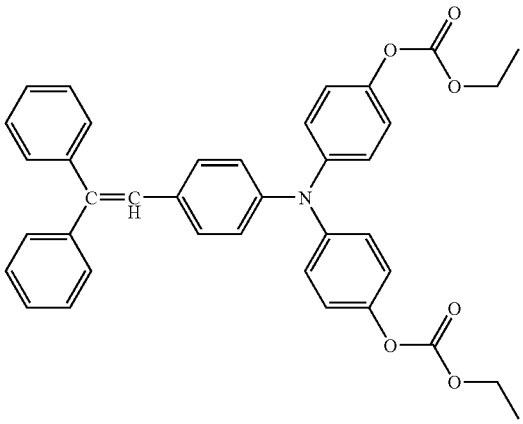
(V-25)
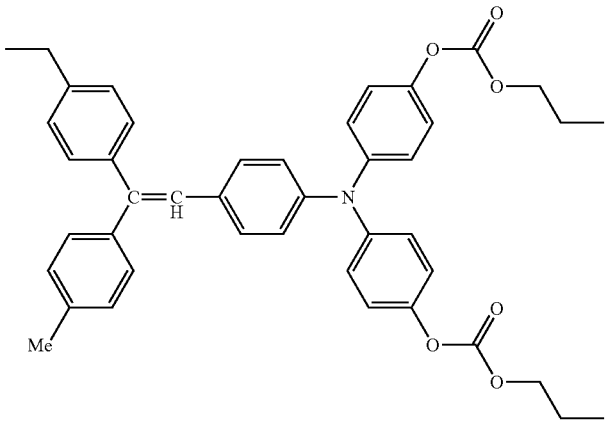
(V-26)

TABLE 50
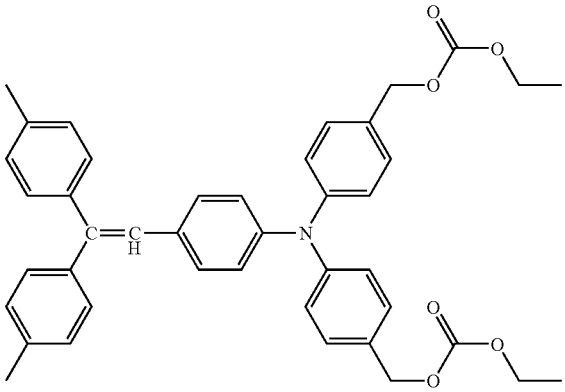
(V-27)
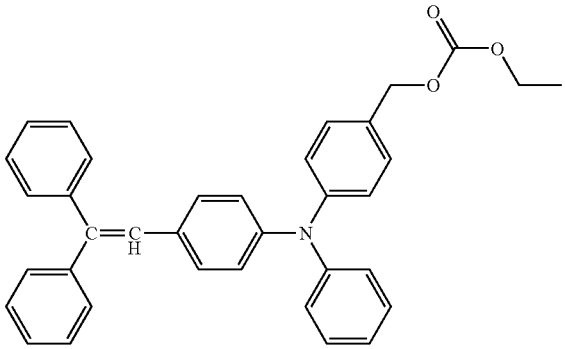
(V-28)
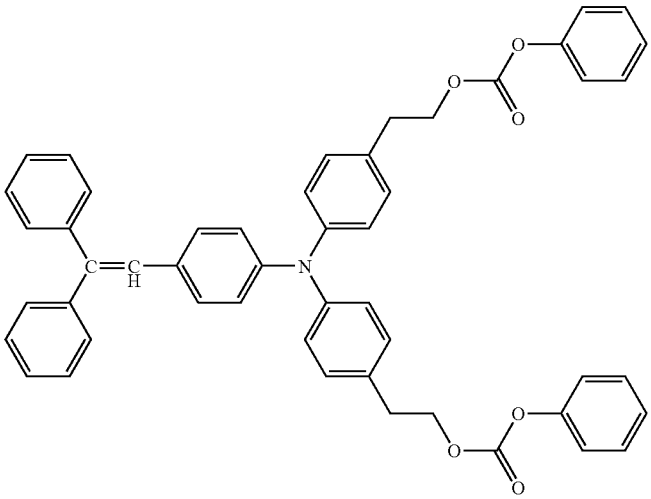
(V-29)

TABLE 50-continued
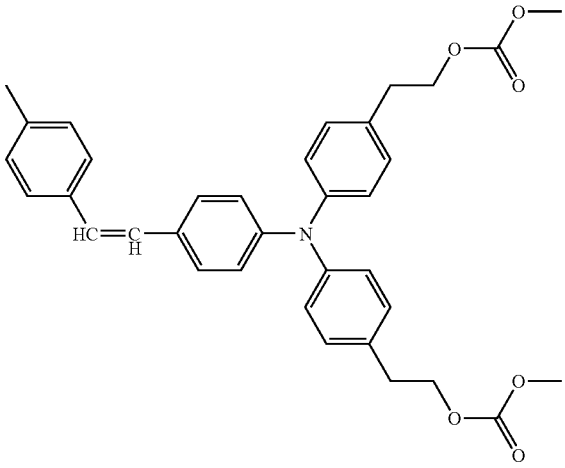
(V-30)
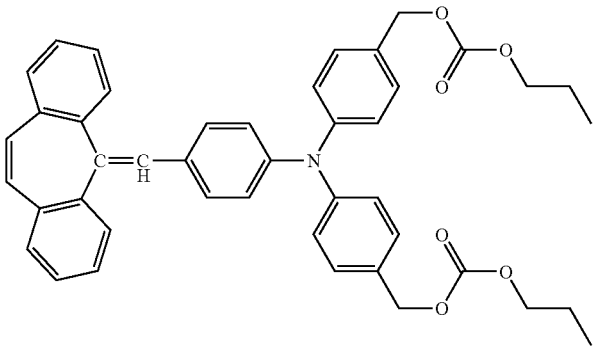
(V-31)
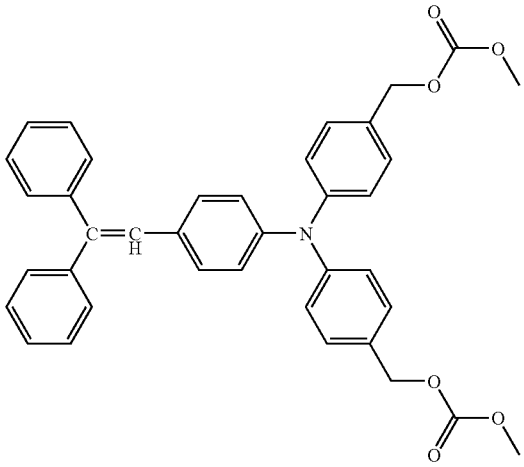
(V-32)

TABLE 51
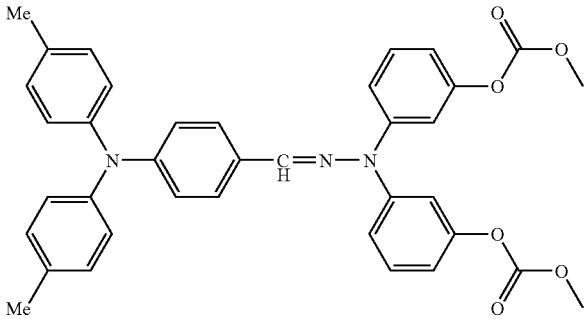
(V-33)
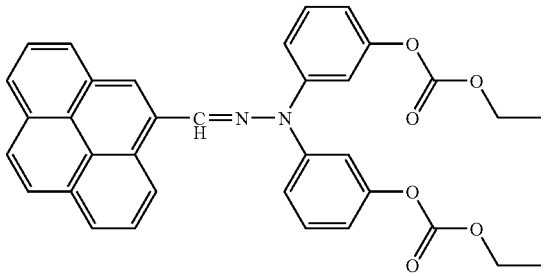
(V-34)
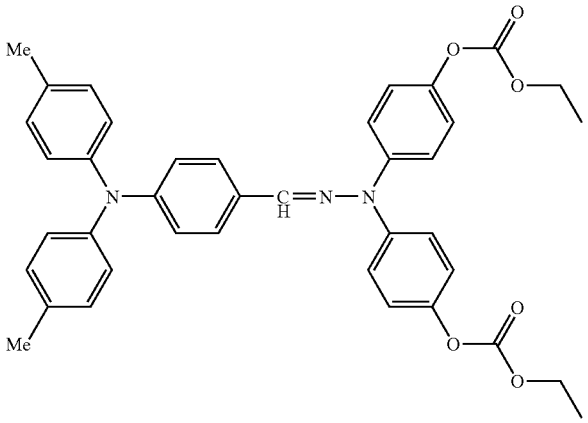
(V-35)
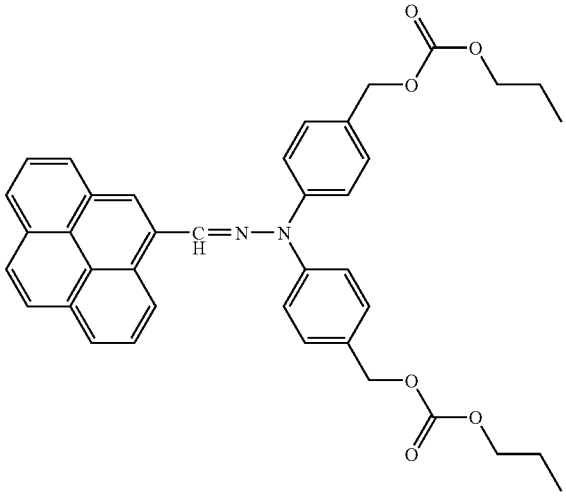
(V-36)

TABLE 51-continued
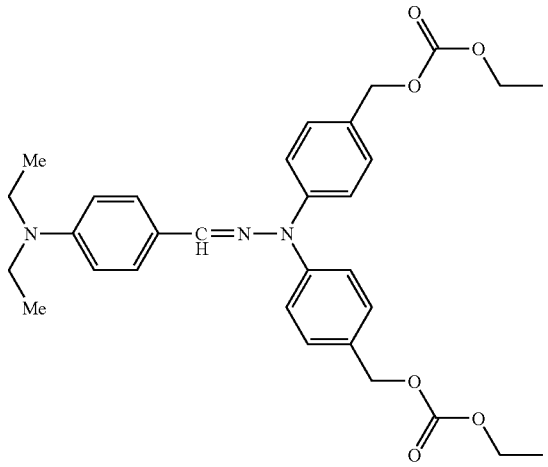
(V-37)
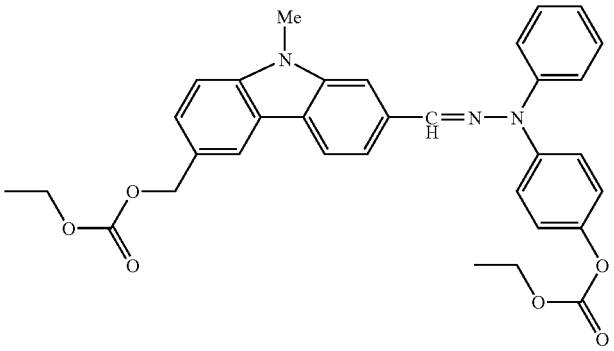
(V-38)
TABLE 52
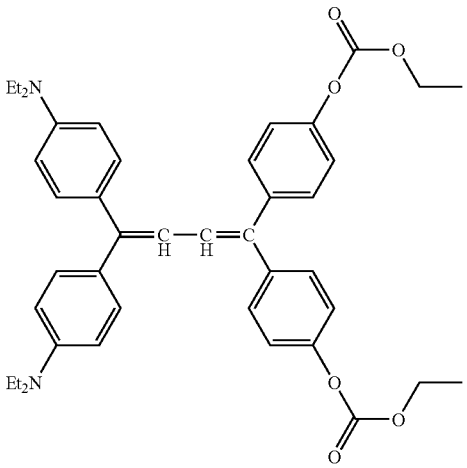
(V-39)

TABLE 52-continued
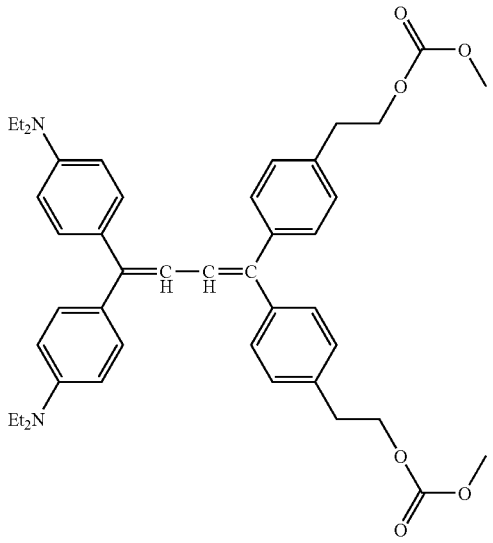
(V-40)
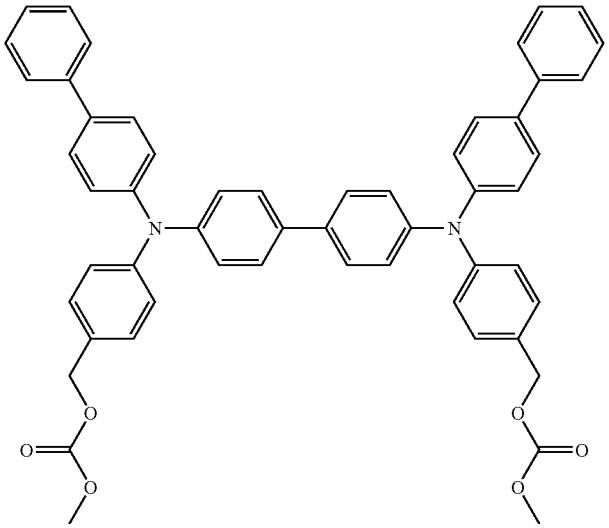
(V-41)

TABLE 52-continued
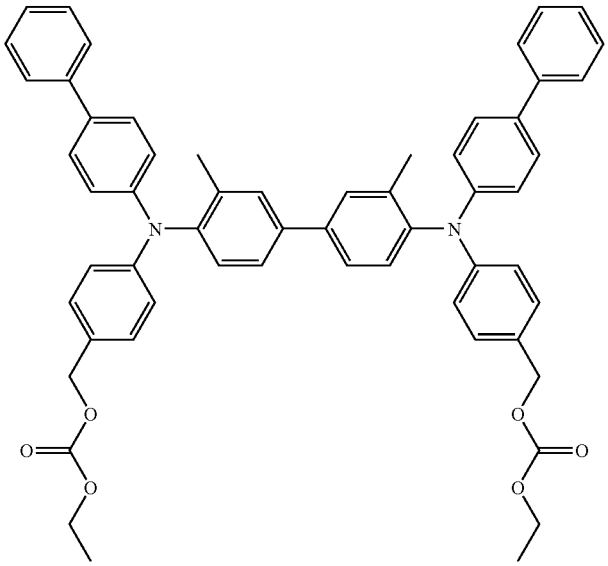
(V-42)
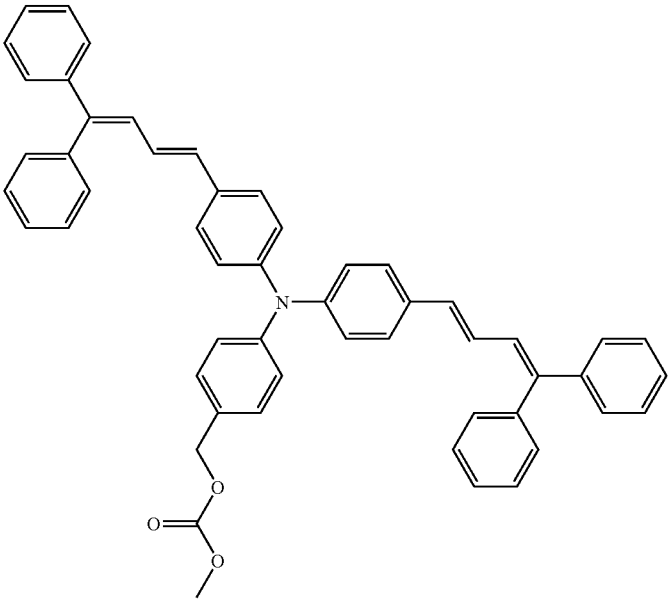
(V-43)

TABLE 52-continued
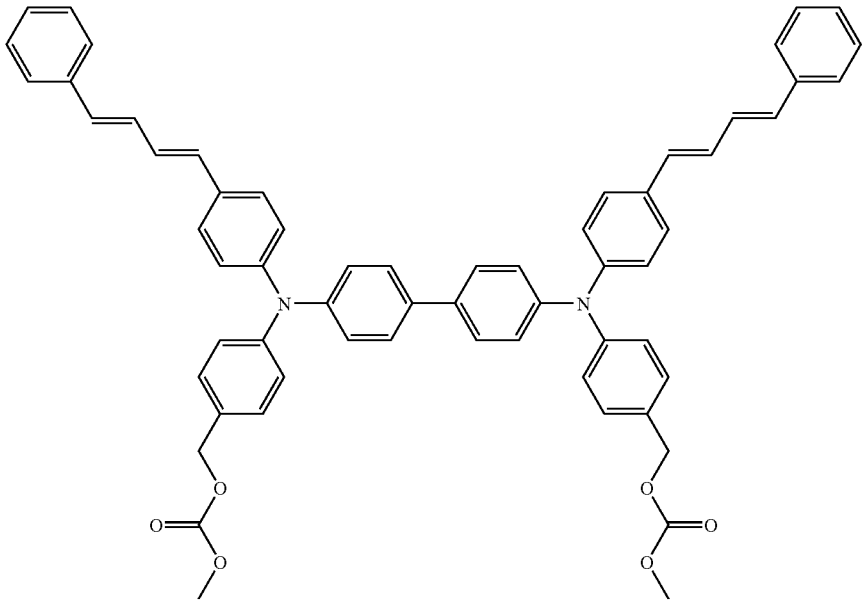
(V-44)
TABLE 53
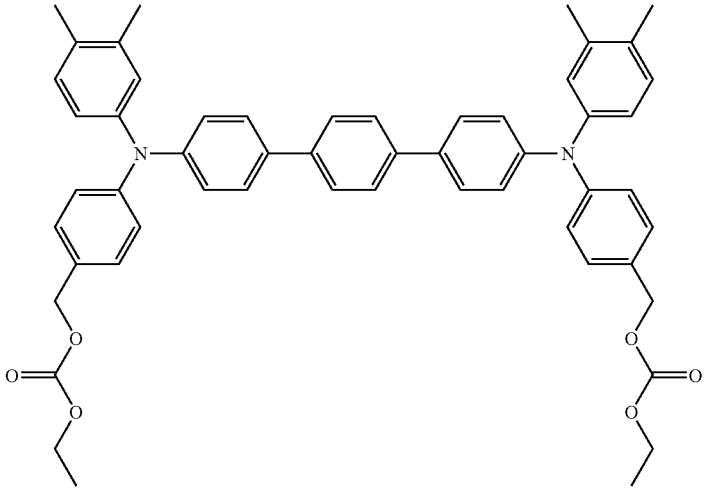
(V-45)

TABLE 53-continued
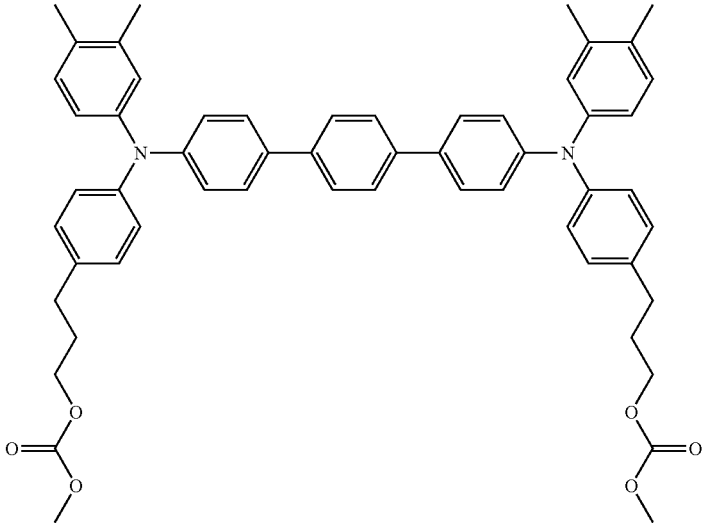
(V-46)
TABLE 54
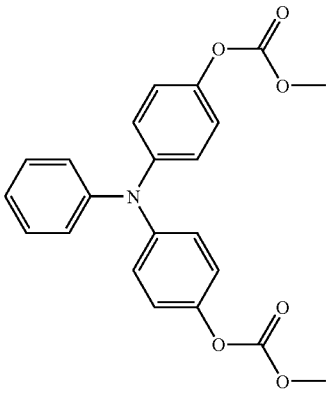
(V-47)
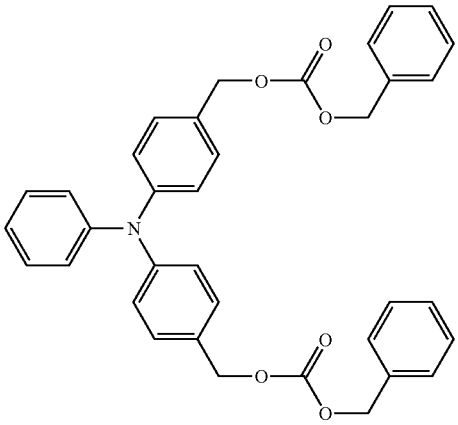
(V-48)
TABLE 54-continued
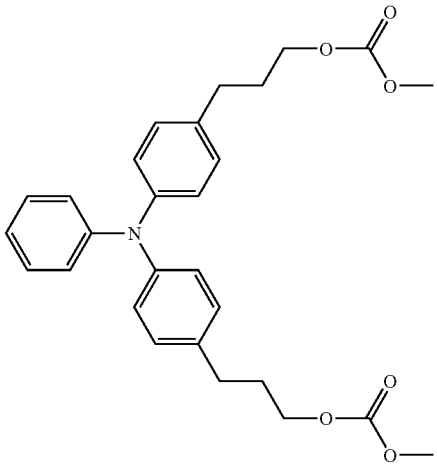
(V-49)
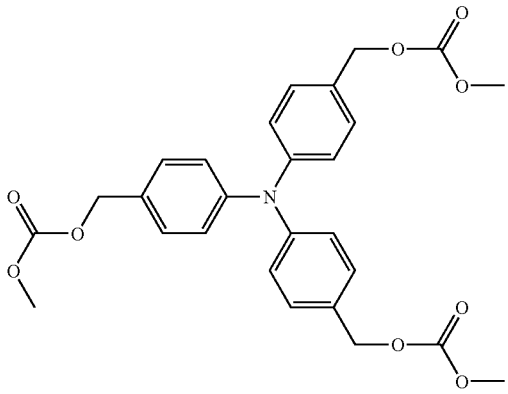
(V-50)

TABLE 55
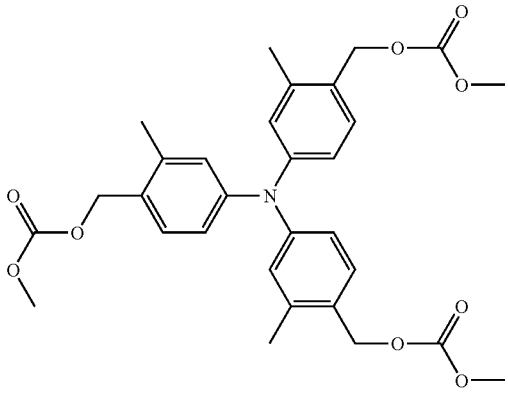
(V-51)
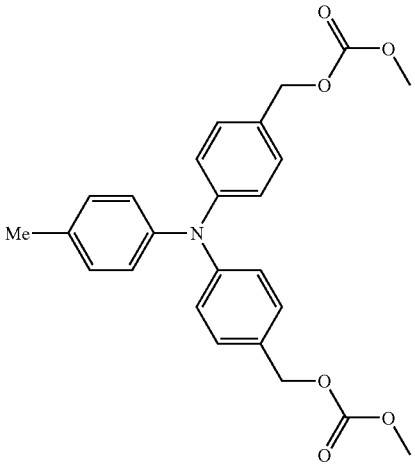
(V-52)
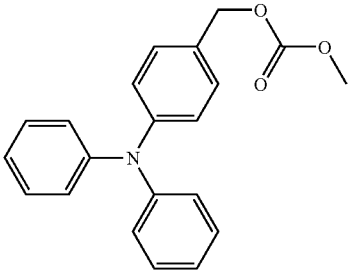
(V-53)
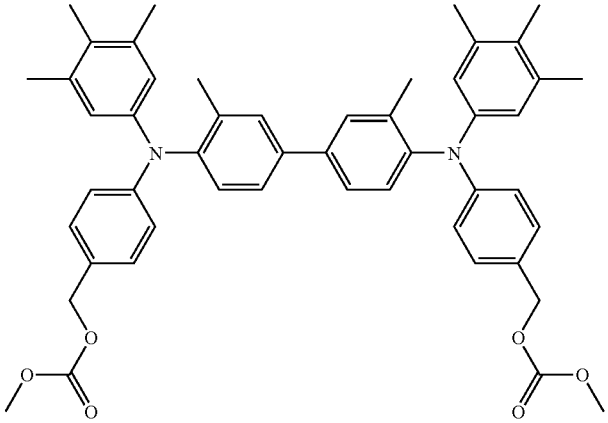

TABLE 55-continued
(V-54)
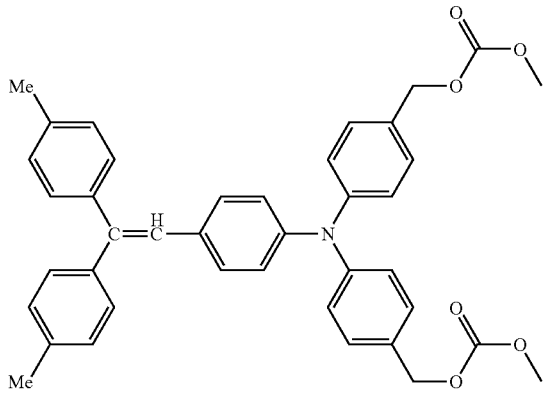
(V-55)
Specific examples of the compound represented by the general formula (VI) include the following compounds (VI-1) to (VI-17). In the compounds (VI-1) to (VI-17), Me represents a methyl group, and Et represents an ethyl group.
TABLE 56
VI-1
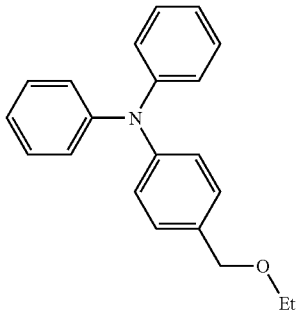
VI-2
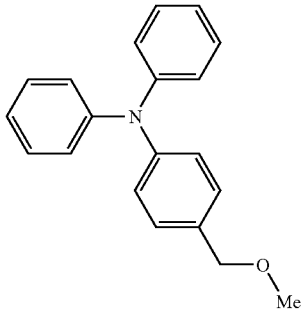
TABLE 56-continued
VI-3
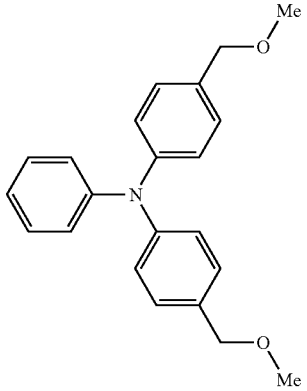
VI-4
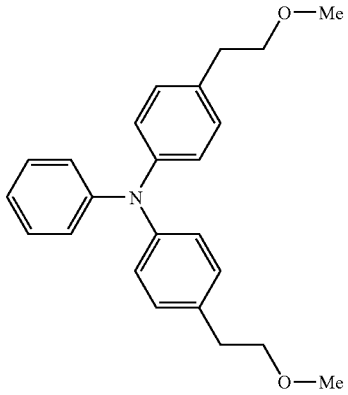

TABLE 56-continued
VI-5
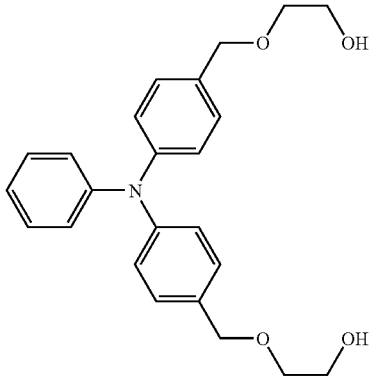
TABLE 57
VI-6
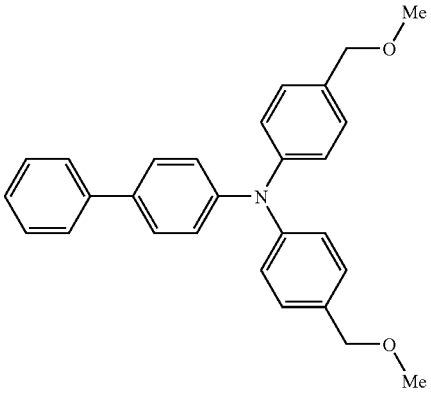
VI-7
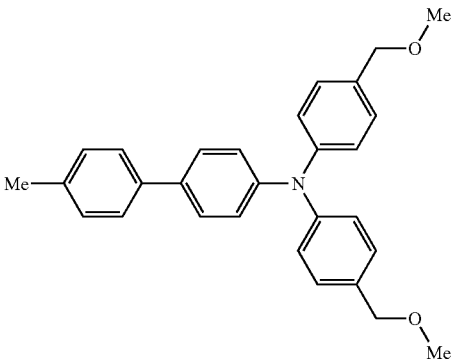
TABLE 57-continued
VI-8
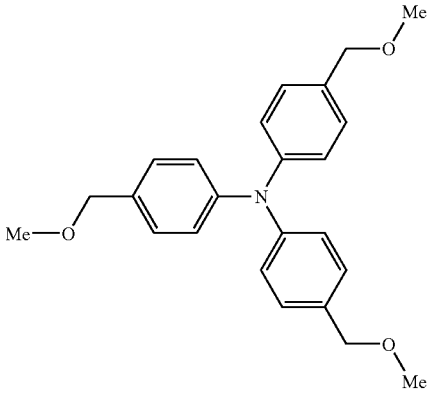
VI-9
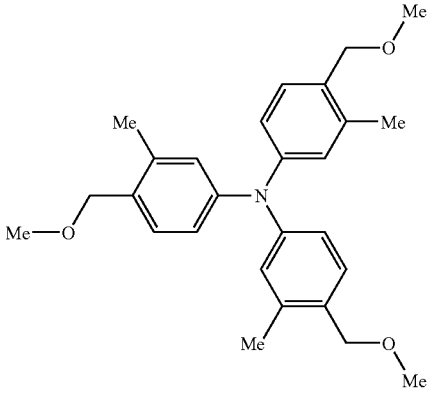

TABLE 58
VI-10
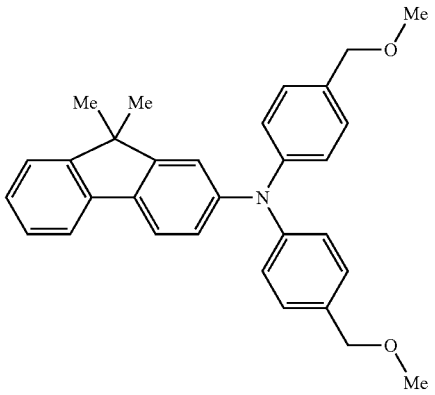
VI-11
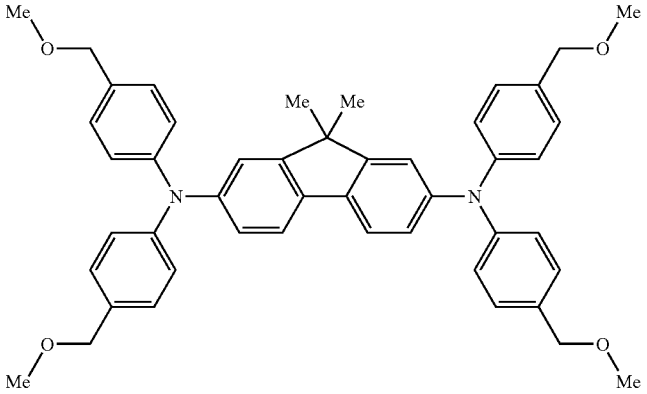
VI-12
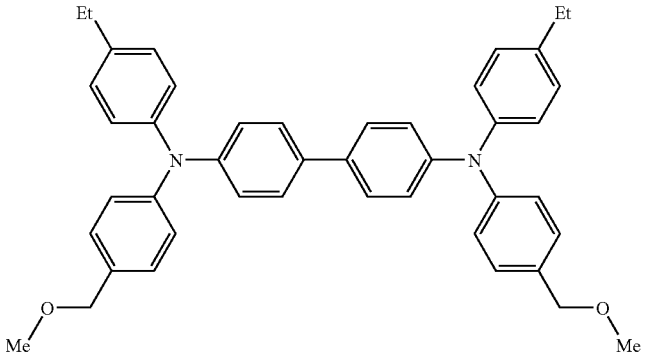
VI-13
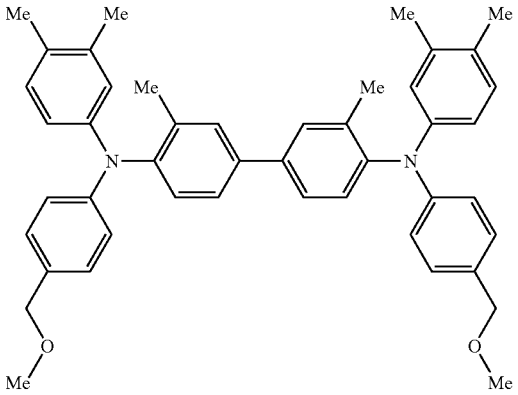

TABLE 59
VI-14
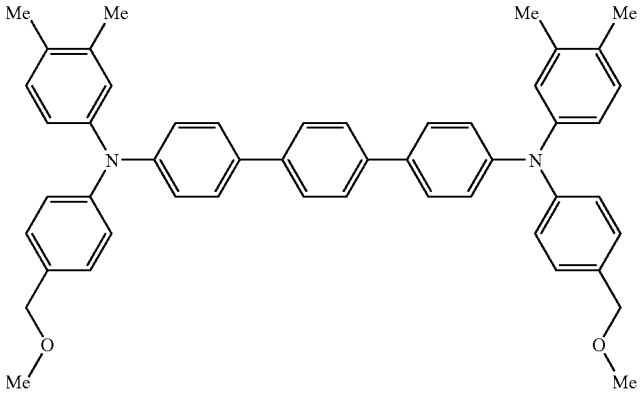
VI-15
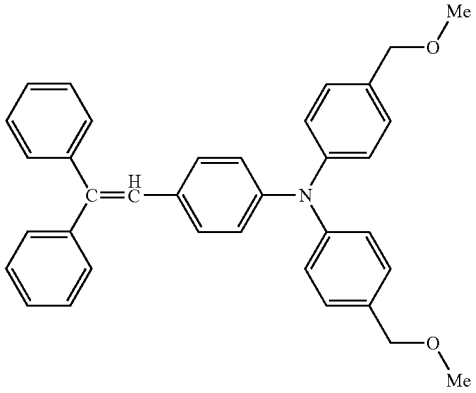
VI-16
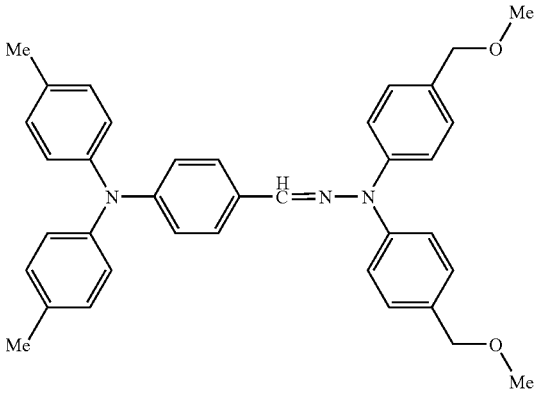
VI-17
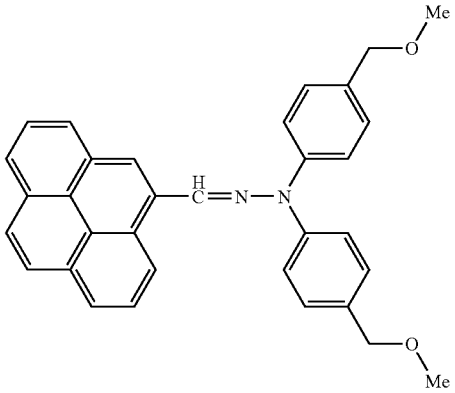

The curable resin composition for forming the protective layer 7 may contain a compound represented by the following general formula (XIV) for controlling the various properties of the protective layer 7, such as the strength and the film resistance.

$$Si(R^{50})_{(4-c)}Q_c \quad (XIV)$$

wherein $R^{50}$ represents a hydrogen atom, an alkyl group or a substituted or unsubstituted aryl group; Q represents a hydrolyzable group; and c represents an integer of from 1 to 4.

Examples of the compound represented by the general formula (XIV) include the following silane coupling agents. Examples of the silane coupling agent include: tetrafunctional alkoxysilane compounds (c=4), such as tetramethoxysilane and tetraethoxysilane; trifunctional alkoxysilane compounds (c=3), such as methyltrimethoxysilane, methyltriethoxysilane, ethyltrimethoxysilane, vinyltrimethoxysilane, vinyltriethoxysilane, phenyltrimethoxysilane, γ-glycidoxypropylmethyldiethoxysilane, γ-glycidoxypropyltrimethoxysilane, γ-glycidoxypropyltrimethoxysilane, γ-aminopropyltriethoxysilane, N-β(aminoethyl)-γ-aminopropyltriethoxysilane, (tridecafluoro-1,1,2,2-tetrahydrooctyl)triethoxysilane, (3,3,3-trifluoropropyl) trimethoxysilane, 3-(heptafluoroisopropoxy) propyltriethoxysilane, 1H,1H,2H,2H-perfluoroalkyltriethoxysilane, 1H,1H,2H,2H-perfluorodecyltriethoxysilane and 1H,1H,2H,2H-perfluorooctyltriethoxysilane; bifunctional alkoxysilane compounds (c=2), such as dimethyldimethoxysilane, diphenyldimethoxysilane and methylphenyldimethoxysilane; and monofunctional alkoxysilane compounds (c=1), such as trimethylmethoxysilane. In order to improve the strength of the film, the trifunctional and tetrafunctional alkoxysilane compounds are preferred, and in order to improve the flexibility and the film forming property, the monofunctional and bifunctional alkoxysilane compounds are preferred.

A silicone hardcoat agent, which is produced mainly from these coupling agents, may also be used. Examples of the commercially available hardcoat agent include KP-85, X-40-9740 and X-40-2239 (all produced by Shin-Etsu Silicone Co., Ltd.), and AY42-440, AY42-441 and AY42-208 (all produced by Toray Dow Corning Corp.).

In the curable resin composition for forming the protective layer 7, it is preferred to use a compound having two or more silicon atoms represented by the following general formula (XV) for improving the strength of the protective layer 7:

$$B—(Si(R^{51})_{(3-d)}Q_d)_2 \quad (XV)$$

wherein B represents a divalent organic group; $R^{51}$ represents a hydrogen atom, an alkyl group or a substituted or unsubstituted aryl group; Q represents a hydrolyzable group; and d represents an integer of from 1 to 3.

Preferred examples of the compound represented by the general formula (XV) include the following compounds (XV-1) to (XV-16).

TABLE 60

| | |
|---|---|
| XV-1 | $(MeO)_3Si—(CH_2)_2—Si(OMe)_3$ |
| XV-2 | $(MeO)_2MeSi—(CH_2)_2—SiMe(OMe)_2$ |
| XV-3 | $(MeO)_2MeSi—(CH_2)_6—SiMe(OMe)_2$ |
| XV-4 | $(MeO)_3Si—(CH_2)_6—Si(OMe)_3$ |
| XV-5 | $(EtO)_3Si—(CH_2)_6—Si(OEt)_3$ |
| XV-6 | $(MeO)_2MeSi—(CH_2)_{10}—SiMe(OMe)_2$ |
| XV-7 | $(MeO)_3Si—(CH_2)_3—NH—(CH_2)_3—Si(OMe)_3$ |
| XV-8 | $(MeO)_3Si—(CH_2)_3—NH—(CH_2)_2—NH—(CH_2)_3—Si(OMe)_3$ |
| XV-9 | 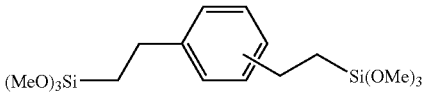 |
| XV-10 | 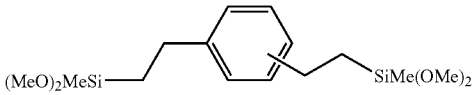 |
| XV-11 | 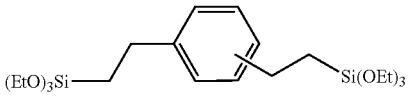 |
| XV-12 | 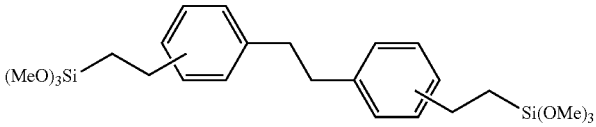 |
| XV-13 | 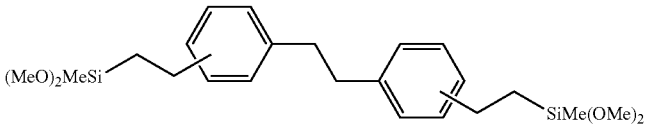 |

TABLE 60-continued

| | |
|---|---|
| XV-14 | 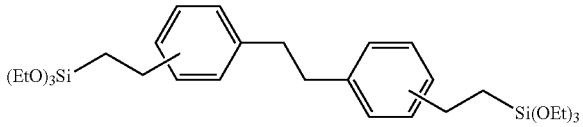 |
| XV-15 | $(MeO)_3SiC_3H_6$—O—$CH_2CH${—O—$C_3H_6Si(OMe)_3$}—$CH_2${—O—$C_3H_6Si(OMe)_3$} |
| XV-16 | $(MeO)_3SiC_2H_4$—$SiMe_2$—O—$SiMe_2$—O—$SiMe_2$—$C_2H_4Si(OMe)_3$ |

Various resins may be added to the protective layer 7 for such purposes as improvement in the resistance to discharge gas, the mechanical strength, the scratch resistance and the particle dispersibility, control of the viscosity, reduction of the torque, control of the wear amount, and prolongation of the pot life. In the exemplary embodiment, a resin soluble in an alcohol is preferably added. Examples of the resin soluble in an alcohol include a polyvinyl butyral resin, a polyvinyl formal resin, a polyvinyl acetal resin, such as a partially acetalized polyvinyl acetal resin, in which a part of butyral is modified with formal or acetoacetal, (e.g., S-Lec B and S-Lec K, produced by Sekisui Chemical Co., Ltd.), a polyamide resin and a cellulose resin. In particular, a polyvinyl acetal resin is preferred from the standpoint of improvement in electric characteristics.

The molecular weight of the resin is preferably from 2,000 to 100,000, and more preferably from 5,000 to 50,000. In the case where the molecular weight is less than 2,000, there is such a tendency that the intended advantage cannot be obtained, and in the case where the molecular weight exceeds 100,000, there is such a tendency that the addition amount is restricted, and film formation failure may occur upon coating. The addition amount of the resin is preferably from 1 to 40% by weight, more preferably from 1 to 30% by weight, and most preferably from 5 to 20% by weight. In the case where the addition amount is less than 1% by weight, there is such a tendency that the intended advantage cannot be obtained, and in the case where the addition amount exceeds 40% by weight, there is such a possibility that image blur tends to occur under a high temperature and high humidity environment. The resin may be used solely or as a mixture thereof.

In order to prolong the pot life and to control the film characteristics, a cyclic compound having a repeating unit represented by the following general formula (XVI) or a derivative of the compound is preferably added:

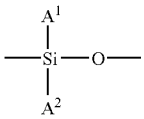

(XVI)

wherein $A^1$ and $A^2$ each independently represents a monovalent organic group.

Examples of the cyclic compound having the repeating unit represented by the general formula (XVI) include commercially available cyclic siloxane compounds. Specific examples thereof include a cyclic dimethylsiloxane compound, such as hexamethylcyclotrisiloxane, octamethylcyclotetrasiloxane, decamethylcyclopentasiloxane and dodecamethylcyclohexasiloxane, a cyclic methylphenylcyclosiloxane compound, such as 1,3,5-trimethyl-1,3,5-triphenylcyclotrisiloxane, 1,3,5,7-tetramethyl-1,3,5,7-tetraphenylcyclotetrasiloxane and 1,3,5,7,9-pentamethyl-1,3,5,7,9-pentaphenylcyclopentasiloxane, a cyclic phenylcyclosiloxane compound, such as hexaphenylcyclotrisiloxane, a fluorine atom-containing cyclosiloxane compound, such as 3-(3,3,3-trifluoropropyl)methylcyclotrisiloxane, a methylhydrosiloxane mixture, a hydrosilyl group-containing cyclosiloxane compound, such as pentamethylcyclopentasiloxane and phenylhydrocyclosiloxane, and a vinyl group-containing cyclosiloxane, such as pentavinylpentamethylcyclopentasiloxane. These cyclic siloxane compounds may be used solely or as a mixture of two or more thereof.

In order to control the resistance to attachment of contaminants, the lubricating property and the hardness of the surface of the electrophotographic photoreceptor, various kinds of particles may be added to the curing composition for forming the protective layer 7.

Examples of the particles include silicon atom-containing particles. The silicon atom-containing particles are particles that contain silicon as a constitutional element, and specific examples thereof include colloidal silica and silicone particles. The colloidal silica used as the silicon atom-containing particles preferably has a volume average particle diameter of from 1 to 100 nm, and more preferably from 10 to 30 nm, and may be selected from those dispersed in an acidic or alkaline aqueous medium or an organic solvent, such as an alcohol, a ketone or an ester, and from commercially available products. The solid content of the colloidal silica in the curable resin composition is not particularly limited, and is preferably from 0.1 to 50% by weight, and more preferably from 0.1 to 30% by weight, based on the total solid content of the curable resin composition, from the standpoint of the film forming property, the electric characteristics and the strength.

The silicone particles used as the silicon atom-containing particles preferably are spherical and have a volume average particle diameter of from 1 to 500 nm, and more preferably from 10 to 100 nm. The silicone particles may be selected from silicone resin particles, silicone rubber particles and silicone surface-treated silica particles, and from commercially available products.

The silicone particles can improve the surface property of the electrophotographic photoreceptor without impairing the crosslinking reaction since the silicone particles are particles having a small diameter that are chemically inert and excellent in dispersibility in a resin, and is small in content required for obtaining sufficient characteristics. In other words, the silicone particles that are uniformly incorporated in the firm crosslinked structure improves the lubricating property and the water repellency of the surface of the electrophotographic photoreceptor, whereby favorable wear resistance and resistance to attachment of contaminants can be maintained for a prolonged period of time. The content of the silicone particles in the curable resin composition is preferably from 0.1 to 30% by weight, and more preferably from 0.5 to 10% by weight, based on the total solid content of the curable resin composition.

Examples of the other particles include fluorine particles, such as tetrafluoroethylene, trifluoroethylene, hexafluoropropylene, vinyl fluoride and vinylidene fluoride, particles formed of a resin obtained by copolymerizing a fluorine resin and a monomer having a hydroxyl group as described in Preprints of the 8th Forum of Polymer Materials, p. 89, and a semi-electroconductive metallic oxide, such as $ZnO—Al_2O_3$, $SnO_2—Sb_2O_3$, $In_2O_3—SnO_2$, $ZnO—TiO_2$, $MgO—Al_2O_3$, $FeO—TiO_2$, $TiO_2$, $SnO_2$, $In_2O_3$, ZnO and MgO.

In order to control the resistance to attachment of contaminants, the lubricating property and the hardness of the surface of the electrophotographic photoreceptor, other silicone oils than a polyether-modified silicone oil may be added. Examples of the silicone oil include a silicone oil, such as dimethylpolysiloxane, diphenylpolysiloxiane and phenylmethylsiloxane, and a reactive silicone oil, such as amino-modified polysiloxane, epoxy-modified polysiloxane, carboxyl-modified polysiloxane, carbinol-modified polysiloxane, a methacrylate-modified polysiloxane, mercapto-modified polysiloxane and phenol-modified polysilixane. These materials may be added in advance to the curable resin composition for forming the protective layer 7, or the photoreceptor thus produced may be subjected to an impregnation process therewith under reduced pressure or increased pressure.

The curable resin composition for forming the protective layer 7 may further contain an additive, such as a plasticizer, a surface modifier, an antioxidant and a light degradation preventing agent. Examples of the plasticizer include biphenyl, biphenyl chloride, terphenyl, dibutyl terephthalate, diethylene glycol phthalate, dioctyl phthalate, triphenyl phosphate, methylnaphthalene, benzophenone, chlorinated paraffin, polypropylene, polystyrene and various kinds of fluorohydrocarbons.

The curable resin composition for forming the protective layer 7 may further contain an antioxidant having a hindered phenol, hindered amine, thioether or phosphite partial structure, which is advantageous for improvement in potential stability and image quality upon fluctuation of environment.

Examples of the antioxidant include hindered phenol antioxidants, such as Sumilizer BHT-R, Sumilizer MDP-S, Sumilizer BBM-S, Sumilizer WX-R, Sumilizer NW, Sumilizer BP-76, Sumilizer BP-101, Sumilizer GA-80, Sumilizer GM and Sumilizer GS, all produced by Sumitomo Chemical Co., Ltd., IRGANOX 1010, IRGANOX 1035, IRGANOX 1076, IRGANOX 1098, IRGANOX 1135, IRGANOX 1141, IRGANOX 1222, IRGANOX 1330, IRGANOX 1425WL, IRGANOX 1520L, IRGANOX 245, IRGANOX 259, IRGANOX 3114, IRGANOX 3790, IRGANOX 5057 and IRGANOX 565, all produced by Ciba Specialty Chemicals, Inc., and Adeka Stab AO-30, Adeka Stab AO-40, Adeka Stab AO-50, Adeka Stab AO-60, Adeka Stab AO-70, Adeka Stab AO-80 and Adeka Stab AO-330, all produced by Asahi Denka Co., Ltd., hindered amine antioxidants, such as Sanol LS2626, Sanol LS756, Sanol LS770 and Sanol LS744, all produced by Sankyo Lifetech Co., Ltd., TINUVIN 144 and TINUVIN 622LD, all produced by Ciba Specialty Chemicals, Inc., MARK LA57, MARK LA67, MARK LA62, MARK LA68 and MARK LA63, all produced by Asahi Denka Co., Ltd., and Sumilizer TPS, produced by Sumitomo Chemical Co., Ltd., thioether antioxidants, such as Sumilizer TPD, produced by Sumitomo Chemical Co., Ltd., and phosphite antioxidants, such as MARK 2112, MARK PEP8, MARK PEP24G, MARK PEP36, MARK 329K and MARK HP10, all produced by Asahi Denka Co., Ltd., and among these, a hindered phenol antioxidant and a hindered amine antioxidant are preferred. These antioxidants may be modified with such a substituent as an alkoxysilyl group capable of undergoing crosslinking reaction with a material forming a crosslinked film.

Upon preparing the curable resin composition for forming the protective layer 7, a catalyst may be added thereto. Examples of the catalyst include an inorganic acid, such as hydrochloric acid, acetic acid and sulfuric acid, an organic acid, such as formic acid, propionic acid, oxalic acid, benzoic acid, phthalic acid and maleic acid, an alkali catalyst, such as potassium hydroxide, sodium hydroxide, calcium hydroxide, ammonia and triethylamine, and a solid catalyst insoluble in the system shown below.

Examples of the solid catalyst insoluble in the system include a cation exchange resin, such as Amberlite 15, Amberlite 200C and Amberlyst 15E, all produced by Rohm & Haas Company, Dowex MWC-1-H, Dowex 88 and Dowex HCR-W2, all produced by Dow Chemical Company, Lewatit SPC-108 and Lewatit SPC-118, produced by Bayer AG, Diaion RCP-150H, produced by Mitsubishi Chemical Corp., Sumikaion KC-470, Duolite C26-C, Duolite C-433 and Duolite 464, all produced by Sumitomo Chemical Co., Ltd., and Nafion H (produced by Du Pont Inc.); an anion exchange resin, such as Amberlite IRA-400 and Amberlite IRA-45, all produced by Rohm & Haas Company; an inorganic solid having a group containing a protonic acid group bonded on the surface thereof, such as $Zr(O_3PCH_2CH_2SO_3H)_2$ and $Th(O_3PCH_2CH_2COOH)_2$; polyorganosiloxane containing a protonic acid group, such as polyorganosiloxane having a sulfonic acid group; a heteropoly acid, such as cobalt tungsten and phosphorous molybdate; an isopoly acid, such as niobic acid, tantalic acid and molybdic acid; a monoelemental metallic oxide, such as silica gel, alumina, chromia, zirconia, CaO and MgO; a complex metallic oxide, such as silica-alumina, silica-magnesia, silica-zirconia and zeolite; a clay mineral, such as acid clay, activated clay, montmorillonite and kaolinite; a metallic sulfate, such as $LiSO_4$ and $MgSO_4$; a metallic phosphate, such as zirconium phosphate and lanthanum phosphate; a metallic nitrate, such as $LiNO_3$ and $Mn(NO_3)_2$; an inorganic solid having a group containing an amino group bonded on the surface thereof, such as a solid obtained by reacting aminopropyltriethoxysilane on silica gel; and polyorganosiloxane containing an amino group, such as amino-modified silicone resin.

Upon preparing the curable resin composition, it is preferred to use a solid catalyst insoluble in the light-functional compound, the reaction product, water and the solvent since the coating composition is improved in stability. The solid catalyst insoluble in the system is not particularly limited as far as the catalyst components are in soluble in the charge transporting organic compound having a reactive functional group, the other additives, water, the solvent and the like.

The using amount of the solid catalyst insoluble in the system is not particularly limited, and is preferably from 0.1 to 100 parts by weight per 100 parts by weight of the charge transporting organic compound having a reactive functional group. The solid catalyst is insoluble in the raw material compounds, the reaction products, the solvent and the like, and therefore, can be easily removed according to the ordinary method after the reaction.

The reaction temperature and the reaction time are appropriately selected depending on the kinds and the using amounts of the raw material compounds and the solid catalyst. The reaction temperature is generally from 0 to 100° C., preferably from 10 to 70° C., and more preferably from 15 to 50° C., and the reaction time is preferably from 10 minutes to 100 hours. In the case where the reaction time exceeds the upper limit, there is such a tendency that gelation is liable to occur.

In the case where the catalyst insoluble in the system is used upon preparing the curable resin composition, a catalyst soluble in the system is preferably further used in combination for the purpose of improving the strength and the storage stability of the composition. Examples of the catalyst include organic aluminum compounds, such as aluminum triethylate, aluminum triisopropylate, aluminum tri(sec-butyrate), mono (sec-butoxy)aluminum diisopropylate, diisopropoxyaluminum(ethylacetoacetate), aluminum tris(ethylacetoacetate), aluminum bis(ethylacetoacetate) monoacetylacetonate, aluminum tris(acetylacetonate), aluminum diisopropoxy(acetylacetonate), aluminum isopropoxy-bis(acetylacetonate), aluminum tris(trifluoroacetylacetonate) and aluminum tris (hexafluoroacetylacetonate).

Other examples of the catalyst than the organic aluminum compounds include an organic tin compound, such as dibutyltin dilaureate, dibutyltin dioctiate and dibutyltin diacetate; an organic titanium compound, such as titanium tetrakis (acetylacetonate), titanium bis(butoxy)bis(acetylacetonate) and titanium bis(isopropoxy)bis(acetylacetonate); and an organic zirconium compound, such as zirconium tetrakis (acetylacetonate), zirconium bis(butoxy)bis(acetylacetonate) and zirconium bis(isopropoxy)bis(acetylacetonate). Among these, the organic aluminum compound is preferably used, and an aluminum chelate compound is more preferably used, from the standpoint of the safety, the cost and the pot life.

The using amount of the catalyst soluble in the system is not particularly limited, and is preferably from 0.1 to 20 parts by weight, and particularly preferably from 0.3 to 10 parts by weight, per 100 parts by weight of the charge transporting organic compound having a reactive functional group.

In the case where an organic metallic compound is used as a catalyst upon forming the protective layer 7, a polydentate ligand is preferably added from the standpoint of the pot life and the curing efficiency. Examples of the polydentate ligand include the compounds shown below and derivatives obtained therefrom, but the invention is not limited thereto.

Specific examples of the polydentate ligand include a bidentate ligand, such as a β-diketone compound, e.g., acetylacetone, trifluoroacetylacetone, hexafluoroacetylacetone and dipivaloylmethylacetone; an acetoacetate ester compound, e.g., methyl acetoacetate and ethyl acetoacetate; bipyridine and a derivative thereof; glycine and a derivative thereof; ethylene diamine and a derivative thereof; 8-oxyquinoline and a derivative thereof; salicylaldehyde and a derivative thereof; catechol and a derivative thereof; and a 2-oxyazo compound; a tridentate ligand, such as diethyltriamine and a derivative thereof; and nitriloacetic acid and a derivative thereof; and a hexadentate ligand, such as ethylenediamine tetraacetic acid (EDTA). In addition to the aforementioned organic ligands, examples thereof further include an inorganic ligand, such as pyrophosphoric acid and triphosphoric acid. As the polydentate ligand, a bidentate ligand is particularly preferred, and specific examples thereof include, in addition to the aforementioned ligands, a bidentate ligand represented by the following general formula (XVII):

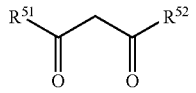

(XVII)

wherein $R^{51}$ and $R^{52}$ each independently represents an alkyl group having from 1 to 10 carbon atoms, a fluorinated alkyl group or an alkoxy group having from 1 to 10 carbon atoms.

As the polydentate ligand, the bidentate ligand represented by the general formula (XVII) is preferably used, and the bidentate ligand represented by formula (XVII) wherein $R^{51}$ and $R^{52}$ are the same as each other is particularly preferably used. In the case where $R^{51}$ and $R^{52}$ are the same as each other, the coordination power of the ligand around room temperature is increased, whereby the curable resin composition can be further stabilized.

The mixing amount of the polydentate ligand may be arbitrarily determined, and is preferably 0.01 mol or more, more preferably 0.1 mol or more, and particularly preferably 1 mol or more, per 1 mol of the organic metallic compound used.

The protective layer 7 is formed by using the curable resin composition containing the aforementioned constitutional components as a coating composition for forming the protective layer.

The curable resin composition containing the aforementioned components may be prepared with no solvent or by using, depending on necessity, a solvent, such as an alcohol, e.g., methanol, ethanol, propanol and butanol; a ketone, such as acetone and methyl ethyl ketone; and an ether, e.g., tetrahydrofuran, diethyl ether and dioxane. The solvent may be used solely or as a mixture of two or more thereof, and preferably has a boiling point of 100° C. or less. The using amount of the solvent may be arbitrarily determined. Since the charge transporting organic compound having a reactive functional group is liable to be deposited when the amount of the solvent is too small, the solvent is preferably used in an amount of from 0.5 to 30 parts by weight, and more preferably from 1 to 20 parts by weight, per 1 part by weight of the charge transporting organic compound having a reactive functional group.

The reaction temperature and the reaction time upon curing the curable resin composition are not particularly limited. From the standpoint of the mechanical strength and the chemical stability of the protective layer 7 formed, the reaction temperature is preferably 60° C. or more, and more preferably from 80 to 200° C., and the reaction time is preferably from 10 minutes to 5 hours. It is effective for stabilizing the characteristics of the protective layer 7 that the protective layer 7 obtained by curing the curable resin composition is maintained at a high temperature and a high humidity. Furthermore, the surface of the protective layer 7 may be subjected, depending on necessity, to a surface treatment using hexamethyldisilazane or trimethylchlorosilane to make the surface thereof hydrophobic.

Examples of the coating method for coating the curable resin composition on the charge generating layer 6 include an ordinary method, such as a blade coating method, a wire bar coating method, a spray coating method, a dip coating method, a bead coating method, an air knife coating method and a curtain coating method.

In the case where the necessary thickness cannot be obtained by coating once, the necessary thickness may be obtained by coating in plural times. In the case where the composition is coated in plural times, the heating treatment may be effected per coating or may be effected after completing the coating operation in plural times.

The thickness of the protective layer 7 is preferably from 0.5 to 15 μm, more preferably from 1 to 10 μm, and further preferably from 1 to 5 μm.

The electrophotographic photoreceptor of the invention is not limited to the aforementioned exemplary embodiment. For example, the undercoating layer 4 may not be necessarily provided in the electrophotographic photoreceptor of the invention.

Figure 2:
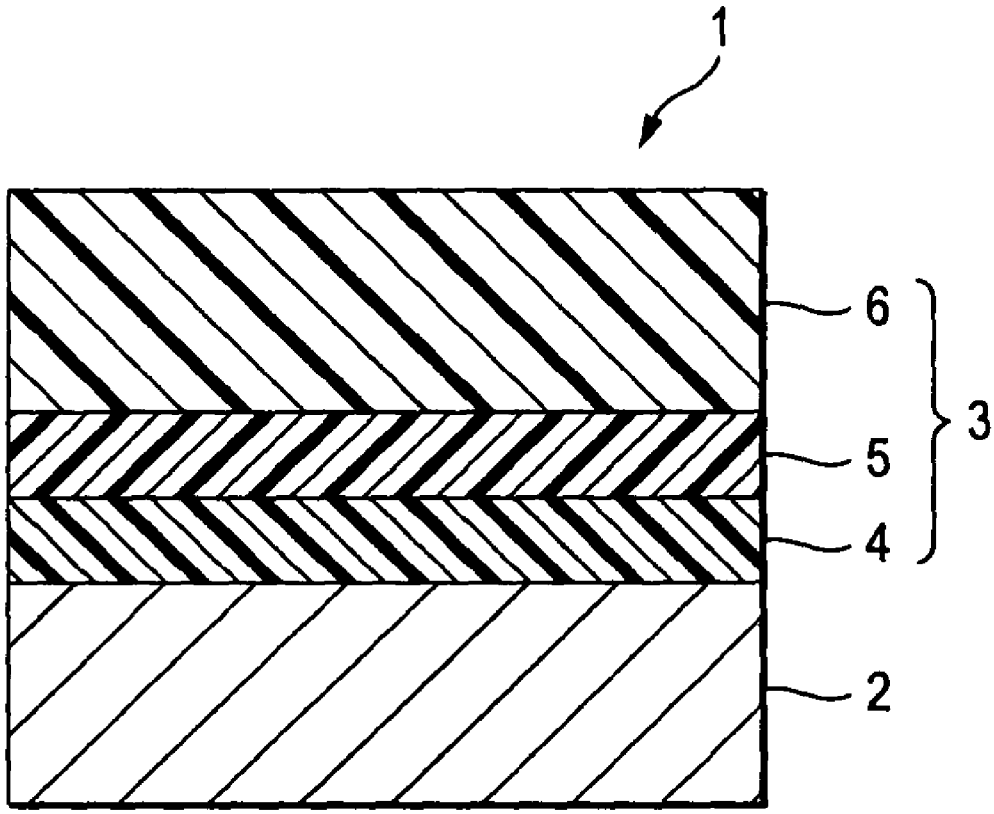
FIG. 2 is a schematic cross sectional view of another exemplary embodiment of the electrophotographic photoreceptor of the invention.

The electrophotographic photoreceptor shown in FIG. 1 has the protective layer 7 containing the compound having a triple bond and a hydroxyl group in a molecule, and the cured product of a curable resin (or the protective layer 7 obtained by curing the curable resin composition containing the compound having a triple bond and a hydroxyl group in a molecule, and the curable resin). In the case where the curable resin composition for forming the protective layer 7 contains the charge transporting organic compound having a reactive functional group, the cured product obtained has excellent mechanical strength and sufficient photoelectric characteristics, and therefore, it can be used as a charge transporting layer of an accumulated photoreceptor by itself. One example of the electrophotographic photoreceptor of this type is shown in FIG. 2. An electrophotographic photoreceptor 1 shown in FIG. 2 has an electroconductive support 2 having accumulated thereon in this order an undercoating layer 4, a charge generating layer 5 and a charge transporting layer 6, and the charge transporting layer 6 is the outermost surface layer obtained by curing the curable resin composition containing the charge transporting organic compound, the compound having a triple bond and a hydroxyl group in a molecule, and the curable resin. The electroconductive support 2, and the undercoating layer 4 and the charge generating layer 5 formed on the electroconductive support 2 are the same as in the electrophotographic photoreceptor shown in FIG. 1 (the rule is also applied in the following embodiments).

Figure 3:
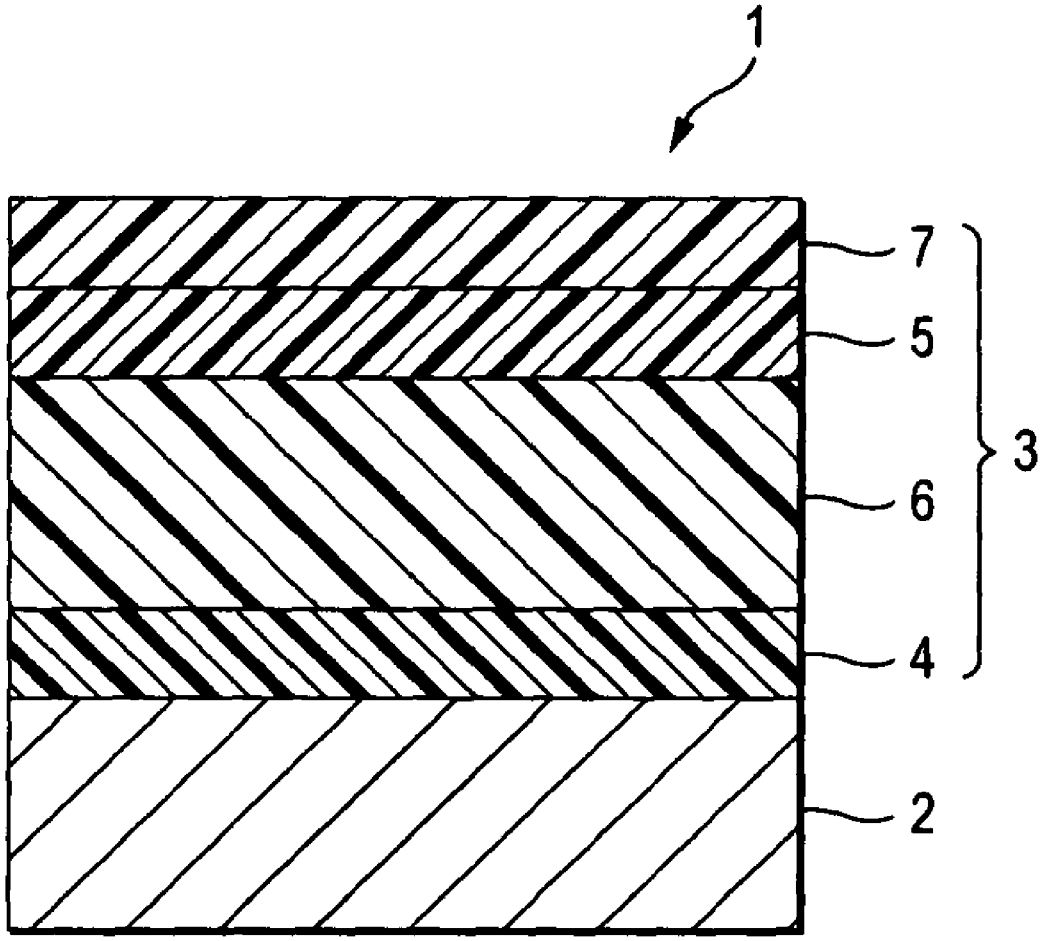
FIG. 3 is a schematic cross sectional view of still another exemplary embodiment of the electrophotographic photoreceptor of the invention.

The order of accumulation of the charge generating layer 5 and the charge transporting layer 6 may be inverted to the aforementioned exemplary embodiment. One example of the electrophotographic photoreceptor of this type is shown in FIG. 3. An electrophotographic photoreceptor 1 shown in FIG. 3 has an electroconductive support 2 having accumulated thereon in this order an undercoating layer 4, a charge transporting layer 6, a charge generating layer 5 and a protective layer 7, and the protective layer 7 is the outermost surface layer containing the compound having a triple bond and a hydroxyl group in a molecule, and the cured product of a curable resin (or the outermost surface layer obtained by curing the curable resin composition containing the compound having a triple bond and a hydroxyl group in a molecule, and the curable resin).

While the electrophotographic photoreceptor shown in FIG. 1 is a function-separated photoreceptor, the electrophotographic photoreceptor of the invention may be a single-layer photoreceptor having a layer containing both a charge generating substance and a charge transporting substance (i.e., a charge generating and charge transporting layer). One example of an electrophotographic photoreceptor having the single-layer photosensitive layer is shown in FIGS. 4 and 5.

Figure 4:
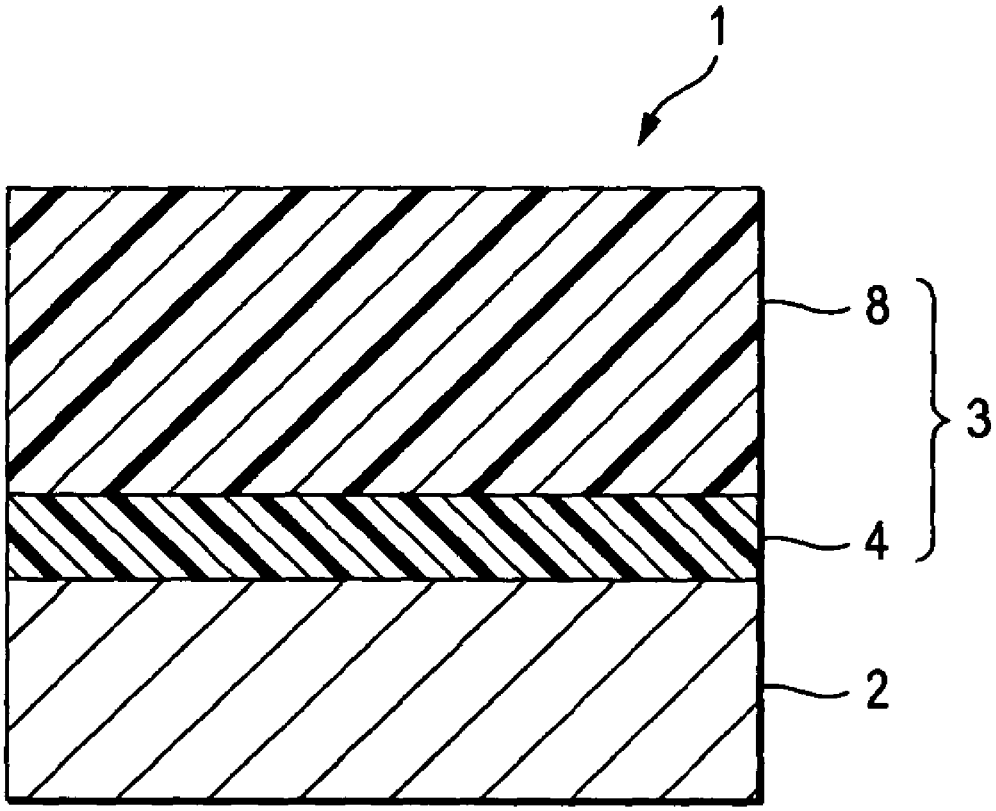
FIG. 4 is a schematic cross sectional view of a further exemplary embodiment of the electrophotographic photoreceptor of the invention.

An electrophotographic photoreceptor 1 shown in FIG. 4 has an electroconductive support 2 having accumulated thereon in this order an undercoating layer 4 and a charge generating and charge transporting layer 8, and the charge generating and charge transporting layer 8 is the outermost surface layer. The charge generating and charge transporting layer 8 can also be formed by using a coating composition containing the curable resin composition containing the compound having a triple bond and a hydroxyl group in a molecule, and a curable resin, to which a charge generating substance and a charge transporting substance (and preferably a compound having a reactive functional group), and depending on necessity, other binder resin than the curable resin, and other additive are added. The charge generating substance used may be the same as those used in the charge generating layer of the function-separated photosensitive layer. In the case where the curable resin is a curable resin soluble in an alcohol, examples of the other binder resin include a polyvinyl butyral resin, a polyvinyl formal resin, a polyvinyl acetal resin, such as a partially acetalized polyvinyl acetal resin, in which a part of butyral is modified with formal or acetoacetal, (e.g., S-Lec B and K, produced by Sekisui Chemical Co., Ltd.), a polyamide resin and a cellulose resin. The content of the charge generating substance in the charge generating and charge transporting layer 8 is preferably from 10 to 85% by weight, and more preferably from 20 to 50% by weight, based on the total solid content of the charge generating and charge transporting layer 8. The charge generating and charge transporting layer 8 may contain a charge transporting material and a polymer charge transporting material for the purpose of improving the photoelectric characteristics. The addition amount thereof is preferably from 5 to 50% by weight based on the total solid content of the charge generating and charge transporting layer 8. The solvent and the coating method using upon coating may be the same as those as in the aforementioned layers. The thickness of the charge generating and charge transporting layer 8 is preferably about from 5 to 50 μm, and more preferably from 10 to 40 μm.

Figure 5:
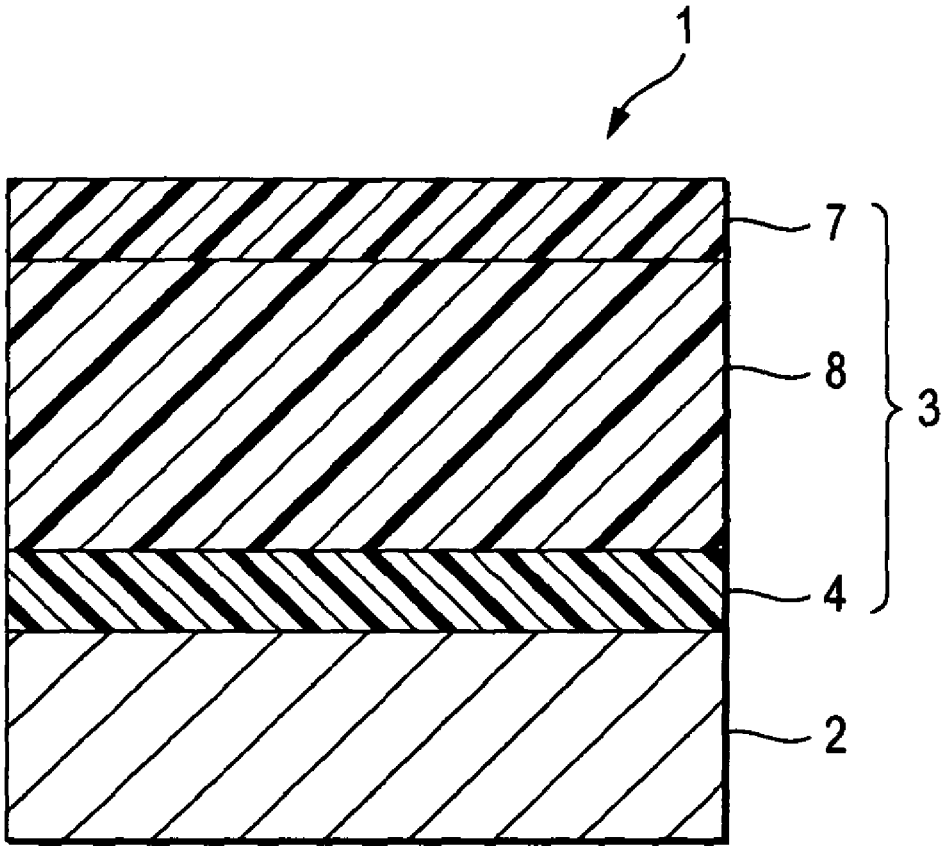
FIG. 5 is a schematic cross sectional view of a still further exemplary embodiment of the electrophotographic photoreceptor of the invention.

An electrophotographic photoreceptor 1 shown in FIG. 5 has an electroconductive support 2 having accumulated thereon in this order an undercoating layer 4, a charge generating and charge transporting layer 8 and a protective layer 7, and the protective layer 7 is the outermost surface layer containing the compound having a triple bond and a hydroxyl group in a molecule, and the cured product of a curable resin (or the outermost surface layer obtained by curing the curable resin composition containing the compound having a triple bond and a hydroxyl group in a molecule, and the curable resin).

(Image Forming Apparatus, Process Cartridge and Method for Forming Image)

Figure 6:
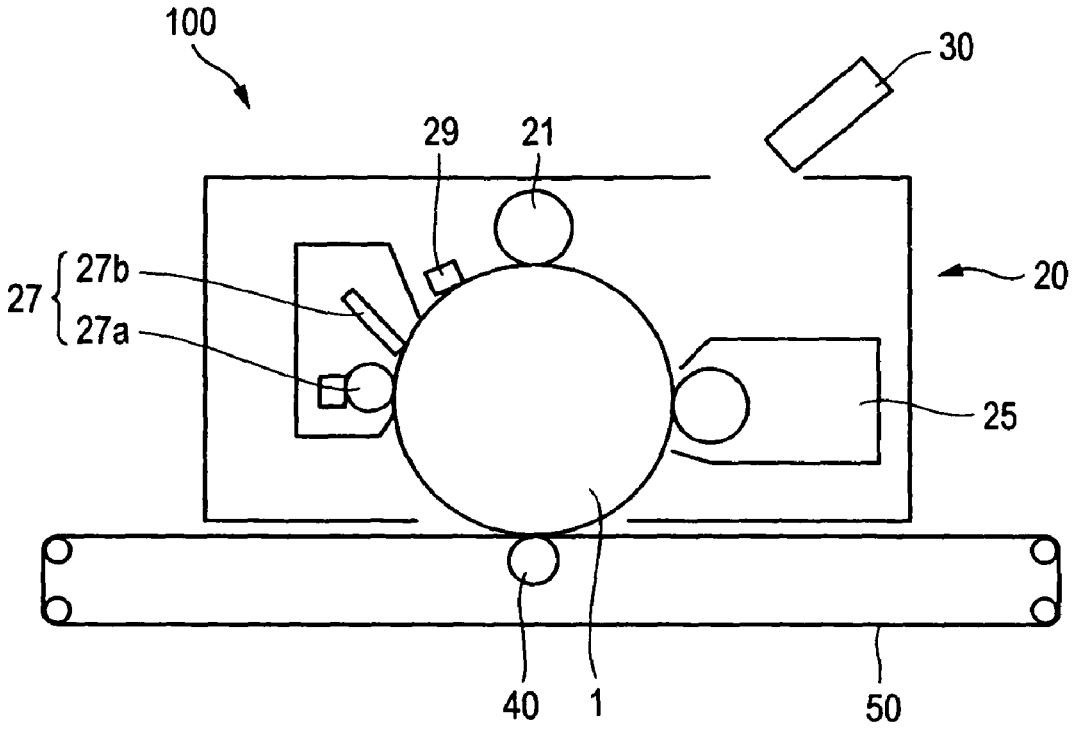
FIG. 6 is a schematic illustration showing an exemplary embodiment of the image forming apparatus according to an aspect of the invention.

FIG. 6 is a schematic illustration showing an exemplary embodiment of the image forming apparatus according to an aspect of the invention. An image forming apparatus 100 shown in FIG. 6 has an image forming apparatus main body (which is not shown in the figure), a process cartridge 20 having the electrophotographic photoreceptor 1 according to an aspect of the invention, an exposing device 30, a transferring device 40 and an intermediate transfer material 50. In the image forming apparatus 100, the exposing device 30 is disposed at a position capable of exposing the electrophotographic photoreceptor 1 through an opening of the process cartridge 20, the transferring device 40 is disposed at a position facing the electrophotographic photoreceptor 1 through the intermediate transfer material 50, and the intermediate transfer material 50 is disposed in such a manner that a part thereof is made in contact with the electrophotographic photoreceptor 1.

The process cartridge 20 has a chassis having therein a charging device 21, a developing device 25, a cleaning device 27 and a fibrous member 29 (having a toothbrush form), which are combined and integrated with the electrophotographic photoreceptor 1 by using a mounting rail. The chassis has an opening for exposure.

The charging device 21 charges the electrophotographic photoreceptor 1 by a contact method. The developing device 25 develops an electrostatic latent image on the electrophotographic photoreceptor 1 to form a toner image.

A toner used in the developing device 25 will be described. The toner preferably has an average shape factor ($ML^2/A$) of from 100 to 150, and more preferably from 100 to 140. The toner preferably has an average particle diameter of from 2 to 12 μm, more preferably from 3 to 12 μm, and further preferably from 3 to 9 μm. The use of the toner satisfying the average shape factor and the average particle diameter provides high developing property, high transferring property and an image with high quality.

The toner is not particularly limited in production method thereof as far as the toner satisfies the average shape factor and the average particle diameter, and for example, toners produced by the following production methods may be used. Examples of the production method include: a kneading and pulverizing method, in which a binder resin, a colorant, a releasing agent, and depending on necessity, a charge controlling agent and the like are mixed, kneaded, pulverized and classified; a method, in which particles obtained by the kneading and pulverizing method are changed in shape with mechanical impact or heat energy; an emulsion polymerization and aggregation method, in which a dispersion liquid obtained by emulsion polymerization of a polymerizable monomer of a binder resin and dispersion liquids of a colorant, a releasing agent, and depending on necessity, a charge controlling agent and the like are mixed, aggregated, and fused by heating to obtain toner particles; a suspension polymerization method, in which a solution of a polymerizable monomer for obtaining a binder resin, a colorant, a releasing agent, and depending on necessity, a charge controlling agent and the like is suspended in an aqueous medium and then polymerized; and a dissolution and suspension method, in which a solution of a binder resin, a colorant, a releasing agent, and depending on necessity, a charge controlling agent and the like is suspended in an aqueous medium and then granulated.

Other known methods may be applied, for example, a toner produced by the aforementioned methods as a core may be attached with aggregated particles, followed by fusing under heating, to obtain a core/shell structure. The production method of the toner is preferably a suspension polymerization method, an emulsion polymerization and aggregation method or a dissolution and suspension method, and particularly preferably an emulsion polymerization and aggregation method, from the standpoint of controlling the shape and the particle size distribution thereof.

The toner mother particles are formed of a binder resin, a colorant and a releasing agent, and may further contain silica and a charge controlling agent depending on necessity.

Examples of the binder resin used in the toner mother particles include a homopolymer and a copolymer of a styrene compound, such as styrene and chlorostyrene, a monoolefin compound, such as ethylene, propylene, butylene and isoprene, a vinyl ester compound, such as vinyl acetate, vinyl propionate, vinyl benzoate and vinyl butyrate, an α-methylene aliphatic monocarboxylate ester, such as methyl acrylate, ethyl acrylate, butyl acrylate, dodecyl acrylate, octyl acrylate, phenyl acrylate, methyl methacrylate, ethyl methacrylate, butyl methacrylate and dodecyl methacrylate, a vinyl ether compound, such as vinyl methyl ether, vinyl ethyl ether and vinyl butyl ether, and a vinyl ketone compound, such as vinyl methyl ketone, vinyl hexyl ketone and vinyl isopropenyl ketone, and a polyester resin obtained by copolymerization of a dicarboxylic acid and a diol.

Representative examples of the binder resin include polystyrene, a styrene-alkyl acrylate copolymer, a styrene-alkyl methacrylate copolymer, a styrene-acrylonitrile copolymer, a styrene-butadiene copolymer, a styrene-maleic anhydride copolymer, polyethylene, polypropylene and a polyester resin. Examples thereof further include polyurethane, an epoxy resin, a silicone resin, polyamide, modified rosin and paraffin wax.

Representative examples of the colorant include magnetic powder, such as magnetite and ferrite, carbon black, Aniline Blue, Calco Oil Blue, Chrome Yellow, Ultramarine Blue, Du Pont Oil Red, Quinoline Yellow, Methylene Blue Chloride, Phthalocyanine Blue, Malachite Green Oxalate, Lamp Black, Rose Bengal, C.I. Pigment Red 48:1, C.I. Pigment Red 122, C.I. Pigment Red 57:1, C.I. Pigment Yellow 97, C.I. Pigment Yellow 17, C.I. Pigment Blue 15:1 and C.I. Pigment Blue 15:3.

Examples of the releasing agent include low molecular weight polyethylene, low molecular weight polypropylene, Fischer-Tropsch wax, montan wax, carnauba wax, rice wax and candelilla wax.

As the charge controlling agent, known products may be used, and an azo metallic complex compound, a metallic complex compound of salicylic acid, and a resin type charge controlling agent containing a polar group may be used. In the case where the toner is produced by a wet method, a material that is hardly soluble in water is preferably used from the standpoint of controlling the ionic strength and reducing contamination of waste water. The toner may be a magnetic toner containing a magnetic material or a non-magnetic toner containing no magnetic material.

The toner used in the developing device 25 can be produced by mixing the toner mother particles with the external additive with a Henschel mixer or a V blender. In the case where the toner is produced by a wet method, the external additive may be added by a wet method.

Lubricating particles may be added to the toner used in the developing device 25. Examples of the lubricating particles include a solid lubricant, such as graphite, molybdenum disulfide, talc, a fatty acid and a fatty acid metallic salt; low molecular weight polyolefin, such as polypropylene, polyethylene and polybutene; a silicone compound exhibiting a softening point upon heating; an aliphatic amide compound, such as oleic amide, erucic amide, ricinoleic amide and stearic amide; vegetable wax, such as carnauba wax, rice wax, candelilla wax, haze wax and jojoba oil; animal wax, such as bees wax; mineral or petroleum wax, such as montan wax, ozokerite, ceresin, paraffin wax, microcrystalline wax and Fischer-Tropsch wax; and modified products thereof. These materials may be used solely or in combination of two or more thereof. The average particle diameter of the lubricating particles is preferably from 0.1 to 10 μm, and the materials may be pulverized and then uniformized in diameter. The addition amount thereof to the toner is preferably from 0.05 to 2.0% by weight, and more preferably from 0.1 to 1.5% by weight.

The toner used in the developing device 25 may contain inorganic particles, organic particles and composite particles containing the organic particles having the inorganic particles attached thereto for the purpose of removing attachments and degraded materials from the surface of the electrophotographic photoreceptor.

Preferred examples of the inorganic particles include various kinds of inorganic oxides, nitrides and borides, such as silica, alumina, titania, zirconia, barium titanate, aluminum titanate, strontium titanate, magnesium titanate, zinc oxide, chromium oxide, cerium oxide, antimony oxide, tungsten oxide, tin oxide, tellurium oxide, manganese oxide, boron oxide, silicon carbide, boron carbide, titanium carbide, silicon nitride, titanium nitride and boron nitride.

The inorganic particles may be treated with a titanium coupling agent, such as tetrabutyl titanate, tetraoctyl titanate, isopropyltriisostearoyl titanate, isopropyltridecylbenzenesulfonyl titanate and bis (dioctylpyrophosphate) oxyacetate titanate, and a silane coupling agent, such as γ-(2-aminoethyl) aminopropyltrimethoxysilane, γ-(2-aminoethyl)aminopropylmethyldimethoxysilane, γ-methacryloxypropyltrimethoxysilane, N-β-(N-vinylbenzylaminoethyl) γ-aminopropyltrimethoxysilane hydrochloride, hexamethyldisilazane, methyltrimethoxysilane, butyltrimethoxysilane, isobutyltrimethoxysilane, hexyltriethoxysilane, octyltrimethoxysilane, decyltrimethoxysilane, dodecyltrimethoxysilane, phenyltrimethoxysilane, o-methylphenyltrimethoxysilane and p-methylphenyltrimethoxysilane. The inorganic particles having been subjected to a hydrophobic treatment with a silicone oil or a higher fatty acid metallic salt, such as aluminum stearate, zinc stearate and calcium stearate, are also preferably used.

Examples of the organic particles include styrene resin particles, styrene-acrylate resin particles, polyester resin particles and urethane resin particles.

The average particle diameter of the particles is preferably from 5 to 1,000 nm, more preferably from 5 to 800 nm, and further preferably from 5 to 700 nm. In the case where the average particle diameter is less than the lower limit, there is such a tendency that the polishing function is insufficient, and in the case where the average particle diameter exceeds the upper limit, there is such a tendency that the surface of the electrophotographic photoreceptor is liable to be damaged. The total addition amount of the particles and the lubricating particles is preferably 0.6% by weight or more.

As another inorganic oxide added to the toner, an inorganic oxide having a small diameter of 40 nm or less in terms of primary particle diameter is preferably added for controlling the powder flowability and the charging property, and an inorganic oxide having a larger diameter than the small diameter is preferably added for decreasing the adhering force and controlling the charging property. Known materials may be used as these kinds of inorganic oxide particles, and silica and titanium oxide are preferably used in combination for controlling the charging property precisely. The inorganic particles having a small diameter can be improved in dispersibility by a surface treatment, whereby the particles are improved in effect of increasing the powder flowability. The addition of a carbonate salt, such as magnesium carbonate, and an inorganic mineral, such as hydrotalcite, is also preferred for removing discharge products.

An electrophotographic color toner is used after mixing with a carrier, and examples of the carrier include iron powder, glass beads, ferrite powder, nickel powder, and these kinds of powder having a resin coating on the surface thereof. The mixing ratio of the toner and the carrier may be appropriately determined.

The cleaning device 27 has a fibrous member 27*a* (having a roll form) and a cleaning blade (blade member) 27*b*.

The cleaning device 27 has the fibrous member 27*a* and the cleaning blade (blade member) 27*b*, and may have only one of them. The fibrous member 27*a* may have a toothbrush form instead of the roll form. The fibrous member 27*a* may be fixed to the cleaning device main body, may be supported thereon rotationally, or may be supported thereon in a manner capable of oscillating in the axial direction of the photoreceptor. Examples of the fibrous member 27*a* include a cloth formed of polyester, nylon, acrylate or ultrafine fibers, such as Toraysee, produced by Toray Industries, Inc., and a brush obtained by implanting resin fibers, such as nylon, acrylate, polyolefin and polyester, on a base material or in the form of carpet. The fibrous member 27*a* may be the aforementioned members having been mixed with electroconductive powder or an ionic conducting agent to attain electroconductivity, or having been formed with an electroconductive layer inside or outside the respective fibers. In the case where electroconductivity is attained, the resistance is preferably from $10^2$ to $10^9\Omega$ per one fiber. The thickness of the fibers of the fibrous member 27*a* is preferably 30 d (denier) or less, and more preferably 20 d or less, and the density of the fibers is preferably 20,000 per square inch or more, and more preferably 30,000 per square inch or more.

The cleaning device 27 is demanded to remove attachments (such as discharge products) on the surface of the photoreceptor with a cleaning blade or a cleaning brush. In order to attain the demand for a prolonged period of time and to stabilize the function of the cleaning member, a lubricating substance (lubricating component), such as a metallic soap, a higher alcohol, wax and a silicone oil, is preferably fed to the cleaning member.

For example, in the case where the fibrous member 27*a* having a roll form is used, the member is preferably made in contact with a lubricating substance, such as a metallic soap and wax, to feed the lubricating component to the surface of the electrophotographic photoreceptor. As the cleaning blade 27*b*, an ordinary rubber blade may be used. In the case where a rubber blade is used as the cleaning blade 27*b*, feeding of a lubricating component to the surface of the electrophotographic photoreceptor is particularly effective for suppressing cracking and wear of the blade.

The process cartridge having been described is freely detachable to the image forming apparatus main body, and constitutes the image forming apparatus with the image forming apparatus main body.

The exposing device 30 can expose the charged electrophotographic photoreceptor 1 to form an electrostatic latent image. The light source of the exposing device 30 is preferably a multi-beam plane emission laser.

The transferring device 40 can transfer a toner image on the electrophotographic photoreceptor 1 to a transfer material intermediate transfer material 50), and may be, for example, an ordinary one having a roll form.

The intermediate transfer material 50 may be a belt (intermediate transfer belt) of polyimide, polyamideimide, polycarbonate, polyarylate, polyester or rubber, to which semi-electroconductivity is imparted. The form of the intermediate transfer belt 50 may be a drum form instead of the belt form. While there is an image forming apparatus of a direct transfer system that has no intermediate transfer material, and the electrophotographic photoreceptor of the invention is preferably applied to the image forming apparatus of this type. This is because in the image forming apparatus of a direct transfer system, paper powder and talc are formed from printing paper and are liable to be attached to the electrophotographic photoreceptor, which brings about such a tendency that image defects occur due to the attachments. According to the electrophotographic photoreceptor of the invention, however, paper powder and talc can be easily removed owing the excellent cleaning property, whereby a stable image can be obtained even with the image forming apparatus of a direct transfer system.

The transfer material in the invention is not particularly limited as far as it is such a medium that the toner image formed on the electrophotographic photoreceptor 1 can be transferred to. In the case where a toner image is transferred directly from the electrophotographic photoreceptor 1 to paper or the like, for example, the paper or the like is the transfer material, and in the case where the intermediate transfer material 50 is used, the intermediate transfer material is the transfer material.

Figure 7:
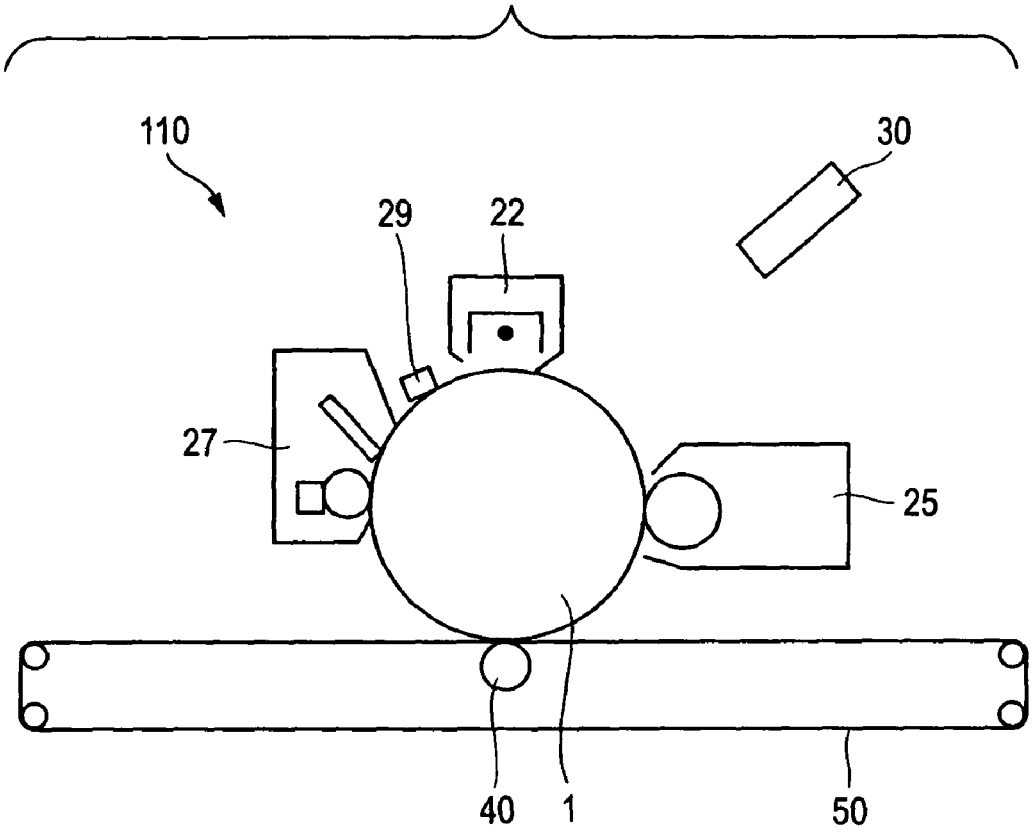
FIG. 7 is a schematic illustration showing another exemplary embodiment of the image forming apparatus according to an aspect of the invention.

FIG. 7 is a schematic illustration showing another exemplary embodiment of the image forming apparatus according to an aspect of the invention. An image forming apparatus 110 shown in FIG. 7 has an electrophotographic photoreceptor 1 fixed to an image forming apparatus main body, and a charging device 22, a developing device 25 and a cleaning device 27, which are formed into cartridges, respectively, to form a charging cartridge, a developing cartridge and a cleaning cartridge, independently. The charging device 22 has a charging device that charges by a corona discharge system.

In the image forming apparatus 110, the electrophotographic photoreceptor 1 and the other devices are separated, and the charging device 22, the developing device 25 and the cleaning device 27 are detachable to the image forming apparatus main body by a drawing or pressing operation, without fixation by screwing, crimping, adhering or welding.

There are cases where the electrophotographic photoreceptor of the invention may not be necessarily formed into a cartridge owing to the excellent wear resistance. Accordingly, the charging device 22, the developing device 25 and the cleaning device 27 are detachable by a drawing or pressing operation, without fixation by screwing, crimping, adhering or welding, whereby the cost of the members per one sheet of printing can be decreased. Furthermore, two or more of the devices can be integrated and formed into one cartridge, whereby the cost of the members per one sheet of printing can be further decreased.

The image forming apparatus 110 has the same constitution as the image forming apparatus 100 except that the charging device 22, the developing device 25 and the cleaning device 27 are formed into cartridges.

Figure 8:
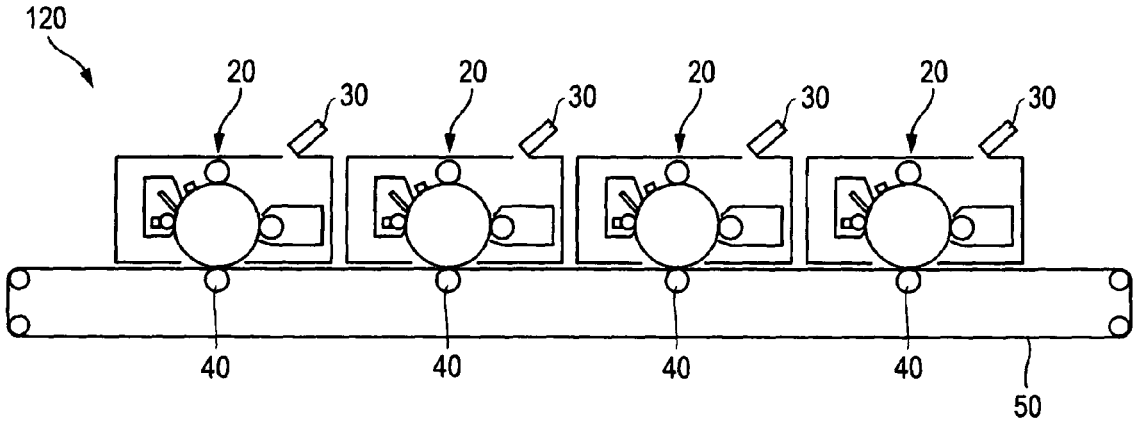
FIG. 8 is a schematic illustration showing still another exemplary embodiment of the image forming apparatus according to an aspect of the invention.

FIG. 8 is a schematic illustration showing still another exemplary embodiment of the image forming apparatus according to an aspect of the invention. An image forming apparatus 120 shown in FIG. 8 is a full color image forming apparatus of a tandem system having four process cartridges 20. In the image forming apparatus 120, four process cartridges 20 are disposed in parallel on an intermediate transfer material 50, and one electrophotographic photoreceptor can be used per one color. The image forming apparatus 120 has the same constitution as the image forming apparatus 100 except that the image forming apparatus 120 has the tandem system.

In the image forming apparatus 120 of the tandem system, the wear amounts of the electrophotographic photoreceptors are different from each other due to the using ratios of the colors, which brings about such a tendency of causing difference in electric characteristics among the electrophotographic photoreceptors. According to the phenomenon, there is such a tendency that the color tone of printed images are changed due to gradual change of the toner developing characteristics from the initial state, so as to fail to obtain stable images. In particular, an electrophotographic photoreceptor having a small diameter is being liable to be used for reducing the size of the image forming apparatus, and the tendency becomes conspicuous when an electrophotographic photoreceptor having a diameter of 30 mm or less is used. In the case where the electrophotographic photoreceptor of the invention is employed as the electrophotographic photoreceptor having a small diameter, the surface thereof can be sufficiently prevented from being worn even when the diameter thereof is 30 mm or less. Accordingly, the electrophotographic photoreceptor of the invention is particularly effective in an image forming apparatus of a tandem system.

Figure 9:
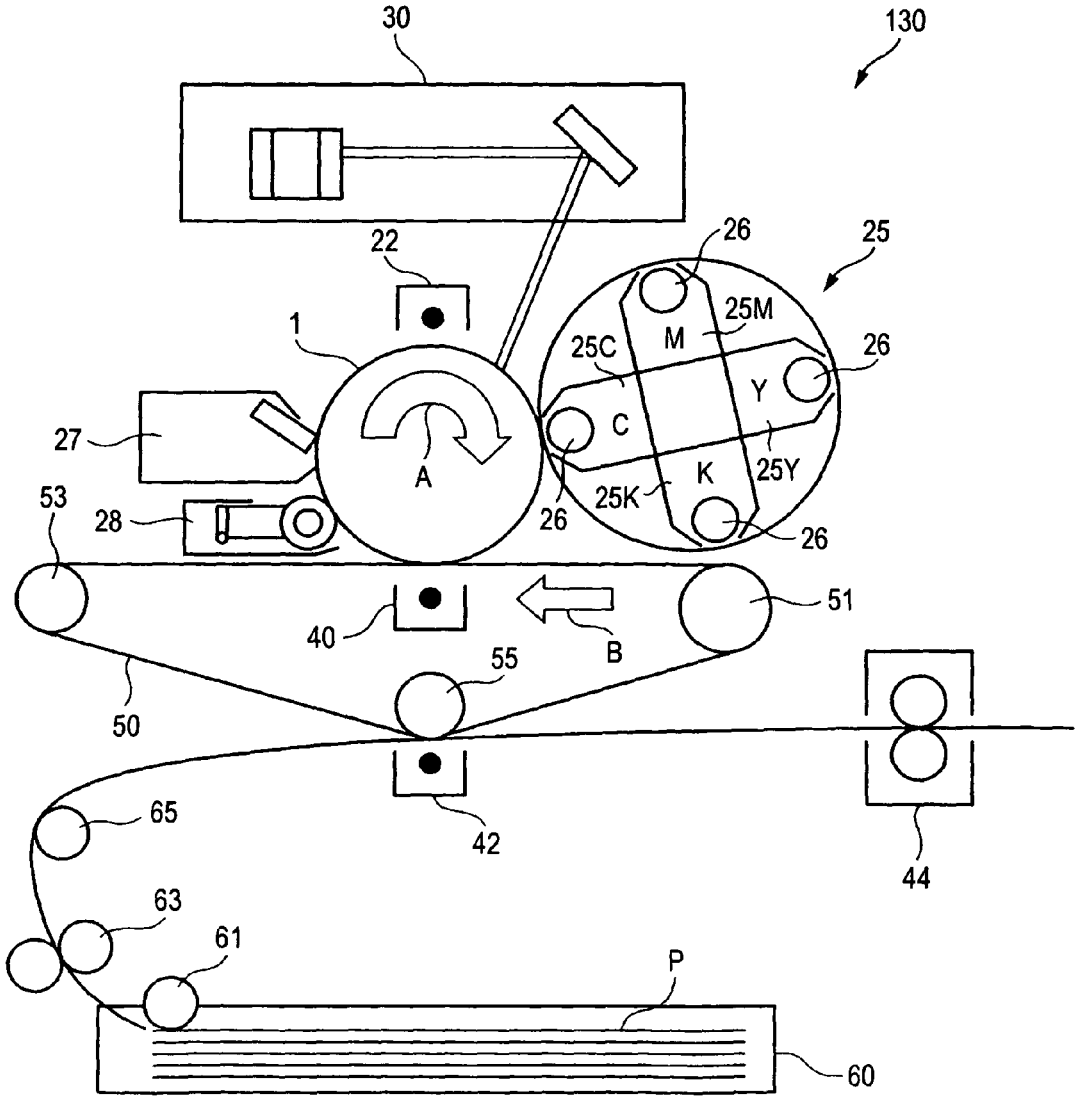
FIG. 9 is a schematic illustration showing a further exemplary embodiment of the image forming apparatus according to an aspect of the invention.

FIG. 9 is a schematic illustration showing a further exemplary embodiment of the image forming apparatus according to an aspect of the invention. An image forming apparatus 130 shown in FIG. 9 is a so-called image forming apparatus of a four-cycle system, in which toner images of plural colors are formed with one electrophotographic photoreceptor. The image forming apparatus 130 has a photoreceptor drum 1 that is rotated in the direction shown by the arrow A in the figure at a prescribed rotation speed with a driving device (which is not shown in the figure), and above the photoreceptor drum 1, a charging device 22 that charges the outer peripheral surface of the photoreceptor drum 1 is provided.

An exposing device 30 having a plane emission laser array as an exposing light source is disposed above the charging device 22. The exposing device 30 modulates plural laser beams emitted from the light source according to an image to be formed, and polarizes the laser beams in the main scanning direction, and the outer peripheral surface of the photoreceptor drum 1 is scanned with the laser beams in parallel to the axial direction of the photoreceptor drum 1. According to the operation, an electrostatic latent image is formed on the charged outer peripheral surface of the photoreceptor drum 1.

A developing device 25 is disposed on the side of the photoreceptor drum 1. The developing device 25 has a housing having a roller form disposed rotatably. Four housing portions are formed inside the housing, and developing members 25Y, 25M, 25C and 25K are disposed in the housing portions, respectively. The developing members 25Y, 25M, 25C and 25K each has a developing roller 26, and contains toners of Y, M, C and K colors stored inside.

The formation of a full color image in the image forming apparatus 130 is carried out through four image formations of the photoreceptor drum 1. During the four image formations of the photoreceptor drum 1, the outer peripheral surface of the photoreceptor drum 1 is charged by the charging device, and then scanned by the exposing device 30 with a laser beam modulated by one of Y, M, C and K image data according to a full color image to be formed, and the charging and exposing operations are repeated by switching the image data used for modulating a laser beam per one image formation of the photoreceptor drum 1. In the state where the developing roller 26 of one of the developing members 25Y, 25M, 25C and 25K is made in contact with the outer peripheral surface of the photoreceptor drum 1, the developing device 25 operates the developing member that is made in contact with the outer peripheral surface, so as to develop the electrostatic latent image formed on the outer peripheral surface of the photoreceptor drum 1 to a specific color. The developing operation is repeated by rotating the housing to switch the developing member used for developing an electrostatic latent image per one image formation of the photoreceptor drum 1 by one color. According to the operations, toner images of Y, M, C and K colors are sequentially formed on the outer peripheral surface of the photoreceptor drum 1.

An endless intermediate transfer belt 50 is disposed substantially under the photoreceptor drum 1. The intermediate transfer belt 50 is wound and stretched on rollers 51, 53 and 55, and disposed to be in contact with the outer peripheral surface of the photoreceptor drum 1. The rollers 51, 53 and 55 are rotated with a driving force of a motor, which is not shown in the figure, to rotate the intermediate transfer belt in the direction shown by the arrow B in FIG. 9.

A transferring device (transferring member) 40 is disposed opposite to the photoreceptor drum 1 with the intermediate transfer belt 50 intervening therebetween, the toner image formed on the outer peripheral surface of the photoreceptor drum 1 is, by one color, transferred to the image forming surface of the intermediate transfer belt 50 by the transferring device 40, and all of the four-color images are finally accumulated.

A lubricant feeding device 28 and a cleaning device 27 for the outer peripheral surface of the photoreceptor drum 1 are disposed opposite to the developing device 25 with the photoreceptor drum 1 intervening therebetween. After transferring the toner image formed on the outer peripheral surface of the photoreceptor drum 1 to the intermediate transfer belt 50, a lubricant is fed to the outer peripheral surface of the photoreceptor drum 1 by the lubricant feeding device 28, and the area of the outer peripheral surface that has supported the transferred toner image is cleaned by the cleaning device 27.

A tray 60 is disposed under the intermediate transfer belt 50, and plural sheets of paper P accumulated as a recording material are housed in the tray 60. A pickup roller 60 is disposed at an obliquely upper left side of the tray 60, and a pair of rollers 63 and a roller 65 are disposed on the downstream side of the pickup direction of the paper P by the pickup roller 60. The uppermost sheet of the accumulated recording paper is picked up from the tray 60 through rotation of the pickup roller 60, and conveyed with the pair of rollers 63 and the roller 65.

A transferring device 42 is disposed opposite to the roller 55 with the intermediate transfer belt 50 intervening therebetween. The paper P conveyed with the pair of rollers 63 and the roller 65 is inserted between the intermediate transfer belt 50 and the transferring device 42, and the toner image formed on the image forming surface of the intermediate transfer belt 50 is transferred thereon by the transferring device 42. A fixing device 44 having a pair of fixing rollers is disposed on the downstream side of the conveying direction of the paper P. The toner image having been transferred to the paper P is melt-fixed by the fixing device 44, and the paper P is then delivered outside the image forming apparatus 130 and stacked on a paper delivery tray (which is not shown in the figure).

Figure 10:
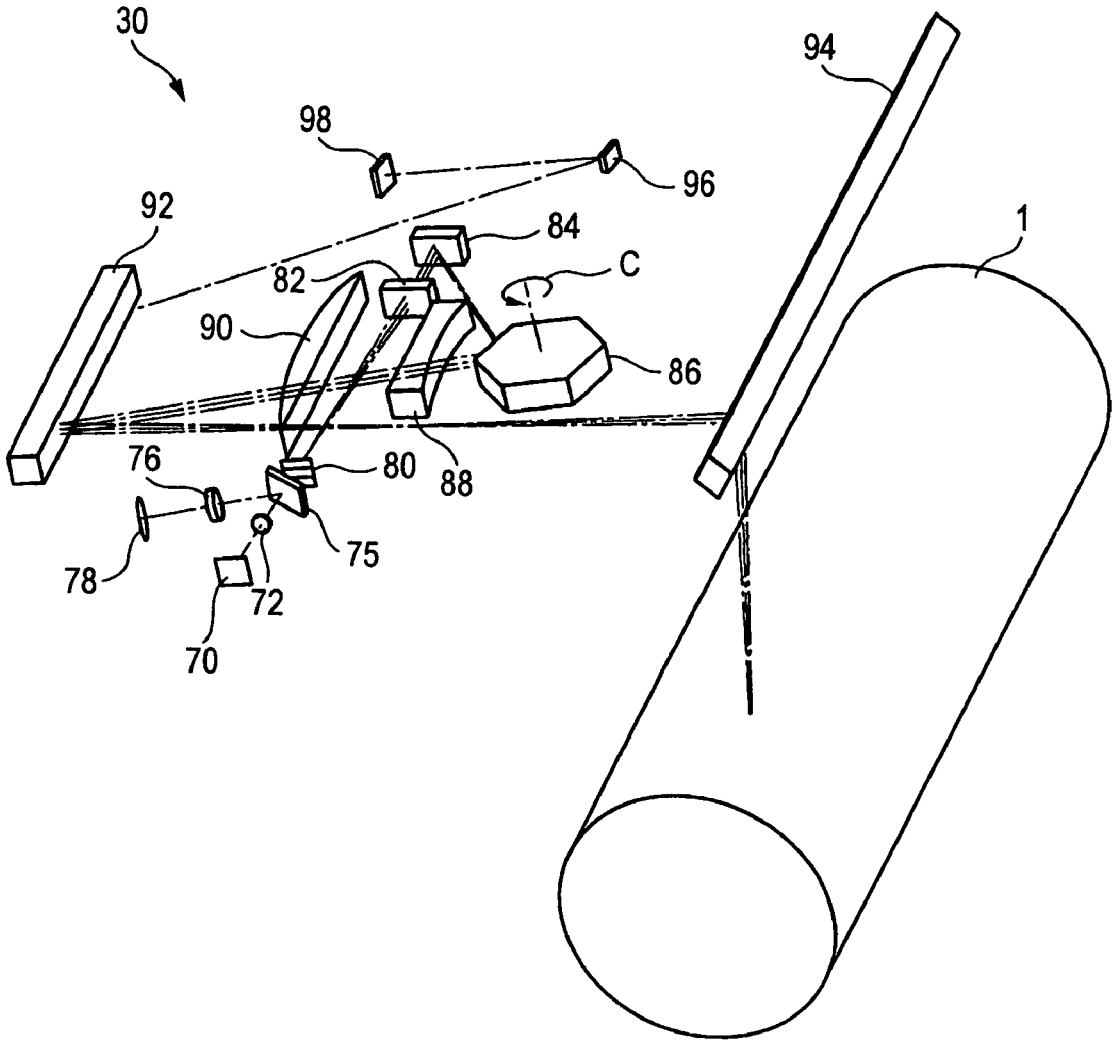
FIG. 10 is a schematic illustration showing an exemplary embodiment of an exposing device (light scanning device) having a plane emission laser array as an exposing light source.

An exemplary embodiment of the exposing device 30 having a plane emission laser array as an exposing light source will be described with reference to FIG. 10. An exposing device 30 shown in FIG. 10 has a plane emission laser array 70 emitting m of laser beams (wherein m is 3 or more). While only three laser beams are shown in FIG. 10 for simplicity, the laser array may be constituted to be able to several tens of laser beams, and the arrangement of the plane emission lasers (i.e., the arrangement of the laser beams emitted from the plane emission laser array 70) may also be a two-dimensional form (e.g., a matrix form) instead of a linear arrangement.

A collimate lens 72 and a half mirror 75 are disposed sequentially on the emission side of the plane emission laser array 70. The laser beams emitted from the plane emission laser array 70 are formed into substantially parallel beams with the collimate lens 72 and are incident on the half mirror 75, whereby a part thereof is separated and reflected by the half mirror 75. A lens 76 and a light intensity sensor 78 are disposed sequentially on the laser beam reflection side of the half mirror 75, and the part of the laser beams thus separated and reflected from the main laser beams (i.e., the laser beams to be used for exposure) by the half mirror 75 is incident on the light intensity sensor 78 through the lens 76 to detect the light intensity thereof by the light intensity sensor 78.

The plane emission laser emits no laser beam from the side opposite to the emission side, from which laser beams used for exposure are emitted (whereas an edge emission laser emits laser beams from both sides thereof). Accordingly, in order to detect and control the light intensity of the laser beams, it is necessary to separate a part of the laser beams used for exposure for detection of the light intensity, as shown above.

An aperture 80, a cylinder lens 82 having power only in the subscanning direction and a return mirror 84 are disposed sequentially on the side of the half mirror 75 emitting the main laser beams. The main laser beams emitted from the half mirror 75 are shaped by the aperture 80, then refracted by the cylinder lens 82 to form an image in a linear form along the main scanning direction near a reflection surface of a rotation polygonal mirror 86, and reflected by the return mirror 84 toward the rotation polygonal mirror 86. In order to shape the plural laser beams uniformly, the aperture 80 is preferably disposed near the focal point of the collimate lens 72.

The rotation polygonal mirror 86 is rotated in the direction shown by the arrow C in FIG. 10 with a driving force of a motor, which is not shown in the figure, and polarizes and reflects, in the main scanning direction, the laser beams incident thereon through reflection by the return mirror 84. Fθ lenses 88 and 90 having power only in the main scanning direction are disposed on the laser beam emission side of the rotation polygonal mirror 86, and the laser beams polarized and reflected by the rotation polygonal mirror 86 are refracted by the Fθ lenses 88 and 90, whereby the laser beams move at a substantially constant velocity on the outer peripheral surface of the electrophotographic photoreceptor 1, and the image forming location in the main scanning direction agrees with the outer peripheral surface of the electrophotographic photoreceptor 1.

Cylinder mirrors 92 and 94 having power only in the subscanning direction are disposed sequentially on the laser beam emission side of the Fθ lenses 88 and 90. The laser beams passing through the Fθ lenses 88 and 90 are reflected by the cylinder mirrors 92 and 94, whereby the image forming location in the subscanning direction agrees with the outer peripheral surface of the electrophotographic photoreceptor 1, and the laser beams are incident on the outer peripheral surface of the photoreceptor drum 1. The cylinder mirrors 92 and 94 also have an optical face tangle correction function of making the rotation polygonal mirror 86 and the outer peripheral surface of the electrophotographic photoreceptor 1 conjugated in the subscanning direction.

A pickup mirror 96 is disposed on the laser beam emission side of the cylinder mirror 92 at a position corresponding to an end where scanning is started (SOS: start of scan) within the scanning area of the laser beams, and a beam position sensor 98 is disposed on the laser beam emission side of the pickup mirror 96. The laser beams emitted from the plane emission laser array 70 are reflected by the pickup mirror 96 when the plane reflecting the laser beams among the reflection planes of the rotation polygonal mirror 86 is directed to the direction where the incident beams are reflected toward the direction corresponding to SOS (see also the imaginary lines in FIG. 10).

Upon forming an electrostatic latent image by modulating laser beams scanning on the outer peripheral surface of the electrostatic photoreceptor 1 associated with rotation of the rotation polygonal mirror 86, a signal output from the beam position sensor 98 is used for synchronizing the modulation initiating timing in main scanning of the respective scanning operations.

In the developing device 30, the collimate lens 72, and the cylinder lens 82 and the two cylinder mirrors 92 and 94 are disposed to be a focal in the subscanning direction, respectively. This is to suppress fluctuation in distance of the scanning lines of the plural laser beams due to the difference in bow of scanning lines of the plural laser beams.

Figure 11:
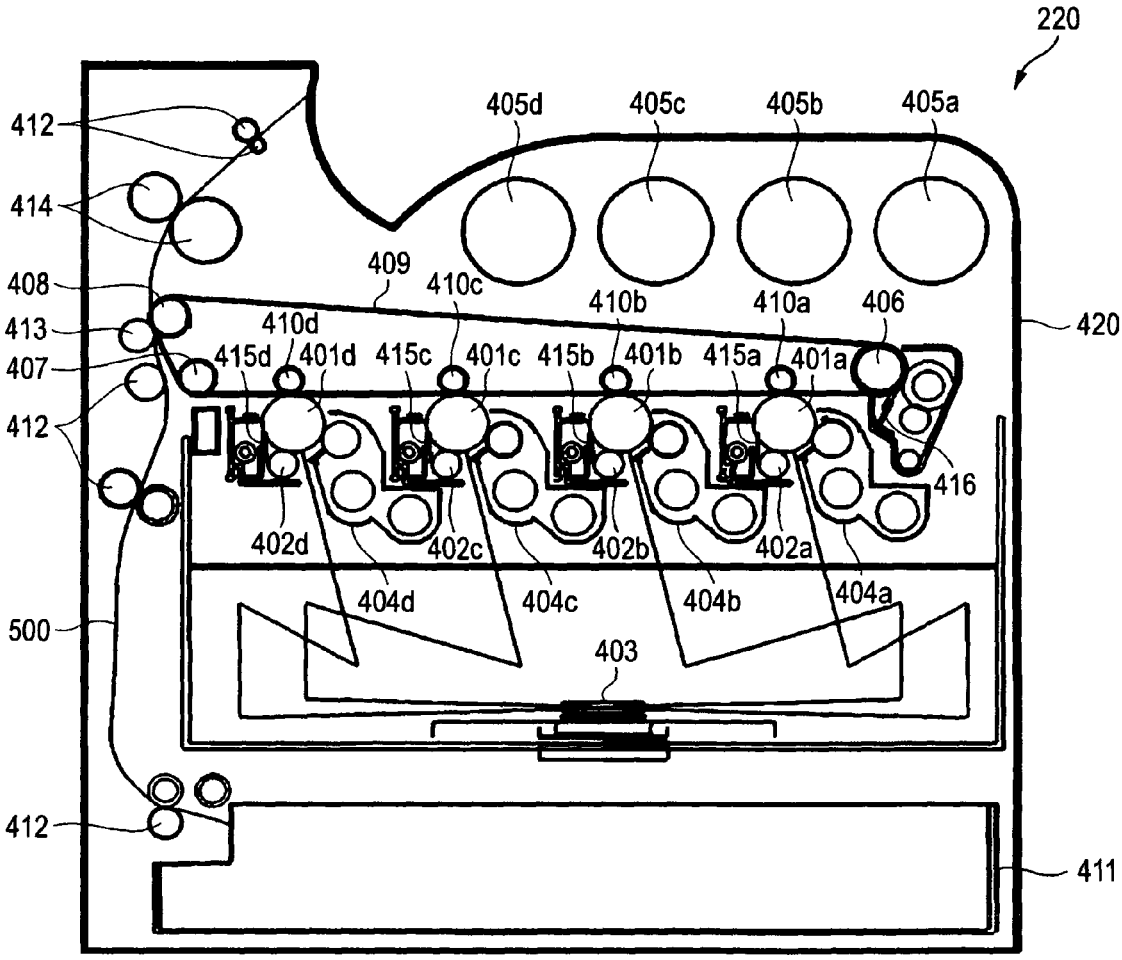
FIG. 11 is a schematic illustration showing a still further exemplary embodiment of the image forming apparatus according to an aspect of the invention.

FIG. 11 is a schematic constitutional view showing a basic constitution of an exemplary embodiment of an electrophotographic apparatus according to an aspect of the invention. An electrophotographic apparatus 220 shown in FIG. 11 is an electrophotographic apparatus of an intermediate transfer system, in which four electrophotographic photoreceptors 401*a* to 401*d* (for example, an electrophotographic photoreceptor 401*a* is capable of forming a yellow image, an electrophotographic photoreceptor 401*b* is capable of forming a magenta image, an electrophotographic photoreceptor 401*c* is capable of forming a cyan image, and an electrophotographic photoreceptor 401*d* is capable of forming a black image) are disposed in parallel along an intermediate transfer belt 409 in a housing 400.

The electrophotographic photoreceptors 401*a* to 401*d* installed in the electrophotographic apparatus 220 are the electrophotographic photoreceptors of the invention (for example, the electrophotographic photoreceptor 1).

The electrophotographic photoreceptors 401*a* to 401*d* are rotatable in a prescribed direction (the anticlockwise direction in the figure), and charging rolls 402*a* to 402*d*, developing devices 404*a* to 404*d*, primary transfer rolls 410*a* to 410*d* and cleaning blades 415*a* to 415*d* are disposed along the rotation direction. Four toners of black, yellow, magenta and cyan colors housed in toner cartridges 405*a* to 405*d* can be fed to the developing devices 404*a* to 404*d*, respectively. The primary transfer rolls 410*a* to 410*d* are made in contact with the electrophotographic photoreceptors 401*a* to 401*d*, respectively, through the intermediate transfer belt 409.

A laser light source (exposing device) 403 is disposed at a prescribed position in the housing 400, whereby laser light emitted from the laser light source 403 can be incident on the surfaces of the electrophotographic photoreceptors 401*a* to 401*d* after charging. According to the constitution, the charging, exposing, developing, primarily transferring and cleaning steps can be sequentially carried out along with rotation of the electrophotographic photoreceptors 401*a* to 401*d*, whereby toner images of respective colors are transferred and accumulated on the intermediate transfer belt 409.

The intermediate transfer belt 409 is supported with a prescribed tension by a driving roll 406, a backup roll 408 and a tension roll 407, and is rotatable without deflection through rotation of the rolls. A secondary transfer roll 413 is disposed to be in contact with the backup roll 408 through the intermediate transfer belt 409. The intermediate transfer belt 409 passing between the backup roll 408 and the secondary transfer roll 413 is subjected to surface cleaning with a cleaning blade 416 disposed, for example, near the driving roll 406, and then devoted to the next image forming process.

A tray (transfer medium tray) 411 is provided at a prescribed position in the housing 400. A transfer medium 417, such as paper, in the tray 411 is conveyed by a conveying roll 412 to between the intermediate transfer belt 409 and the secondary transfer roll 413, and between two fixing rolls 414 made in contact with each other, and then delivered outside the housing 400.

EXAMPLE

The invention will be described more specifically with reference to the following examples and comparative examples, but the invention is not construed as being limited to the examples.

Example 1

A cylindrical aluminum base material is prepared as an electroconductive support.

100 parts by weight of zinc oxide (SMZ-017N, produced by Tayca Corp.) is mixed and agitated with 500 parts by weight of toluene, to which 2 parts by weight of a silane coupling agent (A1100, produced by Nippon Unicar Co., Ltd.) is added, followed by agitating for 5 hours. Thereafter, toluene is distilled off by distillation under reduced pressure, and the mixture is baked at 120° C. for 2 hours. The resulting surface-treated zinc oxide is analyzed with fluorescent X-ray, and it is found that the ratio of the intensity of Si element to the intensity of lead element is $1.8\times10^{-4}$.

35 parts by weight of the surface-treated zinc oxide is mixed with 15 parts by weight of a curing agent (blocked isocyanate, Sumidur 3175, produced by Sumitomo Bayer Urethane Co., Ltd.), 6 parts by weight of a butyral resin (S-Lec BM-1, produced by Sekisui Chemical Co., Ltd.) and 44 parts by weight of methyl ethyl ketone, and dispersed in a sand mill using glass beads having a diameter of 1 mm for 2 hours to obtain a dispersion liquid. 0.005 part by weight of dioctyltin dilaurate as a catalyst and 17 parts by weight of silicone particles (Tospearl 130, produced by GE Toshiba Silicone Co., Ltd.) are added to the resulting dispersion liquid to obtain a coating composition for an undercoating layer. The coating composition is coated on the aluminum base material by a dip coating method, and dried and cured at 160° C. for 100 minutes to obtain an undercoating layer having a thickness of 20 μm. The surface roughness of the undercoating layer is measured by using a surface roughness measuring apparatus, Surfcom 570A, produced by Tokyo Seimitsu Co., Ltd. with a measuring distance of 2.5 mm and a scanning speed of 0.3 mm/sec, and it is found that the ten point average roughness(Rz) value is 0.24.

1 part by weight of hydroxygallium phthalocyanine having distinct diffraction peaks at a Bragg angles (2θ±0.2°) of 7.5°, 9.9°, 12.5°, 16.3°, 18.6°, 25.1° and 28.3° in an X-ray diffraction spectrum is mixed with 1 part by weight of polyvinyl butyral (S-Lec BM-S, produced by Sekisui Chemical Co., Ltd.) and 100 parts by weight of n-butyl acetate, and dispersed with glass beads in a paint shaker for 1 hour to obtain a coating composition for forming a charge generating layer. The coating composition is coated on the undercoating layer by a dip coating method and dried by heating to 100° C. for 10 minutes to form a charge generating layer having a thickness of about 0.15 μm.

2 parts by weight of a benzidine compound represented by the following formula (XVIII-1) and 2.5 parts by weight of a polymer compound having a structural unit represented by the following formula (XIX-1) (having a viscosity average molecular weight of 50,000) are dissolved in 20 parts by weight of chlorobenzene to obtain a coating composition for forming a charge transporting layer.

(XVIII-1)

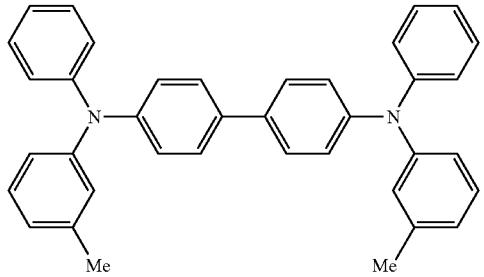

(XIX-1)

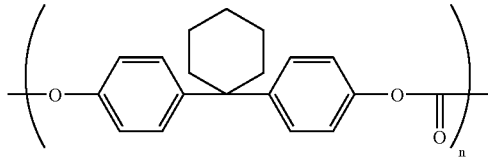

The resulting coating composition is coated on the charge generating layer by a dip coating method and dried by heating to 120° C. for 40 minutes to form a charge transporting layer having a thickness of 20 μm.

2.5 parts by weight of the compound (I-19) in Table 9, 3 parts by weight of a phenol resin (PL-2215, produced by Gunei Chemical Industry Co., Ltd.), 0.2 part by weight of 2,5-dimethyl-3-hexyn-2,5-diol (produced by Tokyo Chemical Industry Co., Ltd.) and 4.5 parts by weight of n-butanol are mixed to obtain a coating composition for forming a protective layer. The coating composition is coated on the charge transporting layer by a dip coating method, and the coated film is air-dried at room temperature for 30 minutes and then cured at 150° C. for 45 minutes to form a protective layer having a thickness of about 5 μm, whereby a target electrophotographic photoreceptor is obtained, which is hereinafter referred to as a photoreceptor 1.

The same operation is repeated in five times to obtain five photoreceptors 1, which are visually observed for surface state of the protective layer. The defective fraction (the number of photoreceptors that has a defect in the coated film, which is hereinafter the same) is shown in Table 61. In the table, the expression "0/5" means all the photoreceptors 1 have no defect in the coated film (which is hereinafter the same).

Example 2

An undercoating layer, a charge generating layer and a charge transporting layer are formed on an electroconductive support in the same manner as in Example 1.

3 parts by weight of the compound (II-3) in Table 14, 3 parts by weight of a phenol resin (PL-4852, produced by Gunei Chemical Industry Co., Ltd.), 0.2 part by weight of Surfynol 440 (produced by Shin-Etsu Chemical Co., Ltd., a compound represented by the general formula (XX-1)) and 4.0 parts by weight of n-butanol are mixed to obtain a coating composition for forming a protective layer. The coating composition is coated on the charge transporting layer by a dip coating method, and the coated film is air-dried at room temperature for 30 minutes and then cured at 140° C. for 45 minutes to form a protective layer having a thickness of about 5 μm, whereby a target electrophotographic photoreceptor is obtained, which is hereinafter referred to as a photoreceptor 2.

The same operation is repeated in five times to obtain five photoreceptors 2, which are visually observed for surface state of the protective layer. The defective fraction is shown in Table 61.

Example 3

An undercoating layer, a charge generating layer and a charge transporting layer are formed on an electroconductive support in the same manner as in Example 1.

3 parts by weight of the compound (III-1) in Table 28, 0.5 part by weight of methyltrimethoxysilane, 0.2 part by weight of colloidal silica, 0.5 part by weight of $Me(MeO)_2$—Si—$(CH_2)_4$—Si-$Me(OMe)_2$, 5 parts by weight of methyl alcohol and 0.5 part by weight of an ion exchange resin (Amberlyst 15E, produced by Rohm & Haas Company) ) are mixed and agitated to effect exchange reaction of the protective group for 1 hour. Thereafter, 10 parts by weight of n-butanol and 0.3 part by weight of distilled water are added to the reaction solution to effect hydrolysis reaction for 15 minutes. The ion exchange resin is separated by filtration from the reaction solution after the hydrolysis reaction, and 0.1 part by weight of aluminum trisacetylacetonate ($Al(aqaq)_3$), 0.1 part by weight of acetylacetone, 0.4 part by weight of 3,5-di-tert-butyl-4-hydroxytoluene (BHT), 3 parts by weight of a phenol resin (PL-4852, produced by Gunei Chemical Industry Co., Ltd.) and 0.2 part by weight of 4-trimethylsilyl-3-butyn-2-ol (produced by Tokyo Kasei Kogyo Co., Ltd.) are added to the filtrate to obtain a coating composition for forming a protective layer.

The resulting coating composition is coated on the charge transporting layer by a dip coating method, and the coated film is air-dried at room temperature for 30 minutes and then cured at 140° C. for 1 hour to form a protective layer having a thickness of about 4 μm, whereby a target electrophotographic photoreceptor is obtained, which is hereinafter referred to as a photoreceptor 3.

The same operation is repeated in five times to obtain five photoreceptors 3, which are visually observed for surface state of the protective layer. The defective fraction is shown in Table 61.

Example 4

An undercoating layer, a charge generating layer and a charge transporting layer are formed on an electroconductive support in the same manner as in Example 1.

2.5 parts by weight of the compound (IV-3) in Table 36, 3 parts by weight of a phenol resin (PL-4852, produced by Gunei Chemical Industry Co., Ltd.), 0.2 part by weight of 2,4-hexadiyn-1,6-diol (produced by Tokyo Kasei Kogyo Co., Ltd.) and 4.0 parts by weight of cyclohexanone are mixed to obtain a coating composition for forming a protective layer. The coating composition is coated on the charge transporting layer by a dip coating method, and the coated film is air-dried at room temperature for 30 minutes and then cured at 140° C. for 45 minutes to form a protective layer having a thickness of about 5 μm, whereby a target electrophotographic photoreceptor is obtained, which is hereinafter referred to as a photoreceptor 4.

The same operation is repeated in five times to obtain five photoreceptors 4, which are visually observed for surface state of the protective layer. The defective fraction is shown in Table 61.

Example 5

An undercoating layer, a charge generating layer and a charge transporting layer are formed on an electroconductive support in the same manner as in Example 1.

2.5 parts by weight of the compound (V-8) in Table 46, 3 parts by weight of a phenol resin (PL-4852, produced by Gunei Chemical Industry Co., Ltd.), 0.2 part by weight of 3,5-dimethyl-1-hexyn-3-ol (produced by Tokyo Kasei Kogyo Co., Ltd.) and 4.0 parts by weight of cyclohexanone are mixed to obtain a coating composition for forming a protective layer. The coating composition is coated on the charge transporting layer by a dip coating method, and the coated film is air-dried at room temperature for 30 minutes and then cured at 140° C. for 45 minutes to form a protective layer having a thickness of about 5 μm, whereby a target electrophotographic photoreceptor is obtained, which is hereinafter referred to as a photoreceptor 5.

The same operation is repeated in five times to obtain five photoreceptors 5, which are visually observed for surface state of the protective layer. The defective fraction is shown in Table 61.

Example 6

An undercoating layer, a charge generating layer and a charge transporting layer are formed on an electroconductive support in the same manner as in Example 1.

2.5 parts by weight of the compound (VI-3) in Table 56, 3 parts by weight of a phenol resin (PL-4852, produced by Gunei Chemical Industry Co., Ltd.), 0.2 part by weight of 2,4,7,9-tetramethyl-5-decyn-4,7-diol (produced by Tokyo Kasei Kogyo Co., Ltd.) and 4.0 parts by weight of n-butanol are mixed to obtain a coating composition for forming a protective layer. The coating composition is coated on the charge transporting layer by a dip coating method, and the coated film is air-dried at room temperature for 30 minutes and then cured at 140° C. for 45 minutes to form a protective layer having a thickness of about 5 μm, whereby a target electrophotographic photoreceptor is obtained, which is hereinafter referred to as a photoreceptor 6.

The same operation is repeated in five times to obtain five photoreceptors 6, which are visually observed for surface state of the protective layer. The defective fraction is shown in Table 61.

Example 7

An undercoating layer, a charge generating layer and a charge transporting layer are formed on an electroconductive support in the same manner as in Example 1.

2.0 parts by weight of the compound (VI-3) in Table 56, 0.5 part by weight of the compound (VI-2) in Table 56, 3 parts by weight of a phenol resin (PL-4852, produced by Gunei Chemical Industry Co., Ltd.), 0.2 part by weight of 2,4,7,9-tetramethyl-5-decyn-4,7-diol (produced by Tokyo Kasei Kogyo Co., Ltd.) and 4.0 parts by weight of n-butanol are mixed to obtain a coating composition for forming a protective layer. The coating composition is coated on the charge transporting layer by a dip coating method, and the coated film is air-dried at room temperature for 30 minutes and then cured at 140° C. for 45 minutes to form a protective layer having a thickness of about 5 μm, whereby a target electrophotographic photoreceptor is obtained, which is hereinafter referred to as a photoreceptor 7.

The same operation is repeated in five times to obtain five photoreceptors 7, which are visually observed for surface state of the protective layer. The defective fraction is shown in Table 61.

Example 8

A cylindrical aluminum base material having been subjected to a honing treatment is prepared as an electroconductive support. 100 parts by weight of a zirconium compound (Orgatics ZC540, produced by Matsumoto Chemical Co., Ltd.), 10 parts by weight of a silane compound (S-Lec BM-S, produced by Sekisui Chemical Co., Ltd.), 380 parts by weight of isopropanol and 200 parts by weight of butanol are mixed to obtain a coating composition for forming an undercoating layer. The coating composition is coated on the outer peripheral surface of the aluminum base material and dried by heating to 150° C. for 10 minutes to obtain an undercoating layer having a thickness of about 0.17 μm.

1 part by weight of chlorogallium phthalocyanine having distinct diffraction peaks at a Bragg angles (2θ±0.2°) of 7.4°, 16.6°, 25.5° and 28.3° in an X-ray diffraction spectrum, 1 part by weight of polyvinyl butyral (S-Lec BM-S, produced by Sekisui Chemical Co., Ltd.) and 100 parts by weight of n-butyl acetate are mixed and dispersed with glass beads in a paint shaker for 1 hour to obtain a coating composition for forming a charge generating layer. The coating composition is coated on the undercoating layer by a dip coating method and dried by heating to 100° C. for 10 minutes to form a charge generating layer having a thickness of about 0.15 μm.

2 parts by weight of a benzidine compound represented by the formula (XVIII-1) and 2.5 parts by weight of a polymer compound having a structural unit represented by the formula (XIX-1) (having a viscosity average molecular weight of 39,000) are dissolved in 25 parts by weight of chlorobenzene to obtain a coating composition for forming a charge transporting layer. The resulting coating composition is coated on the charge generating layer by a dip coating method and dried by heating to 125° C. for 40 minutes to form a charge transporting layer having a thickness of 20 μm.

2.0 parts by weight of the compound (VI-3) in Table 56, 0.5 part by weight of the compound (VI-2) in Table 56, 3 parts by weight of a phenol resin (PL-4852, produced by Gunei Chemical Industry Co., Ltd.), 0.2 part by weight of 2,4,7,9-tetramethyl-5-decyn-4,7-diol (produced by Tokyo Kasei Kogyo Co., Ltd.) and 4.0 parts by weight of n-butanol are mixed to obtain a coating composition for forming a protective layer. The coating composition is coated on the charge transporting layer by a dip coating method, and the coated film is air-dried at room temperature for 30 minutes and then cured at 140° C. for 45 minutes to form a protective layer having a thickness of about 5 μm, whereby a target electrophotographic photoreceptor is obtained, which is hereinafter referred to as a photoreceptor 8.

The same operation is repeated in five times to obtain five photoreceptors 8, which are visually observed for surface state of the protective layer. The defective fraction is shown in Table 61.

Example 9

A cylindrical aluminum base material is polished with a centerless polishing machine to obtain a surface roughness Rz of 0.6 μm. The aluminum base material having been subjected to the centerless polishing treatment is cleaned by subjecting to a degreasing treatment, an etching treatment with a 2% by weight sodium hydroxide aqueous solution for 1 minute, a neutralizing treatment and a washing treatment with pure water, in this order. On the surface of the aluminum base material, an anodic oxidation film is formed with a 10% by weight sulfuric acid solution (electric current density: 1.0 A/dm$^2$). After washing with water, the aluminum base material is immersed in a 1% by weight nickel acetate solution at 80° C. for 20 minutes to seal the pores. The aluminum base material is then washed with pure water and then dried. According to the operation, an electroconductive support having an anodic oxidation film having a thickness of 7 μm formed on the surface thereof is obtained.

1 part by weight of titanyl phthalocyanine having a distinct diffraction peak at a Bragg angles (2θ≅0.2°) of 27.2° in an X-ray diffraction spectrum, 1 part by weight of polyvinyl butyral (S-Lec BM-S, produced by Sekisui Chemical Co., Ltd.) and 100 parts by weight of n-butyl acetate are mixed and dispersed with glass beads in a paint shaker for 1 hour to obtain a coating composition for forming a charge generating layer. The coating composition is coated on the undercoating layer by a dip coating method and dried by heating to 100° C. for 10 minutes to form a charge generating layer having a thickness of about 0.15 μm.

2 parts by weight of a benzidine compound represented by the following formula (XVIII-2) and 3 parts by weight of a polymer compound having a structural unit represented by the following formula (XIX-2) (having a viscosity average molecular weight of 50,000) are dissolved in 20 parts by weight of chlorobenzene to obtain a coating composition for forming a charge transporting layer.

mixed to obtain a coating composition for forming a protective layer. The coating composition is coated on the charge transporting layer by a dip coating method, and the coated film is air-dried at room temperature for 30 minutes and then cured at 140° C. for 45 minutes to form a protective layer having a thickness of about 5 μm, whereby a target electrophotographic photoreceptor is obtained, which is hereinafter referred to as a photoreceptor 9.

The same operation is repeated in five times to obtain five photoreceptors 9, which are visually observed for surface state of the protective layer. The defective fraction is shown in Table 61.

Example 10

An undercoating layer, a charge generating layer and a charge transporting layer are formed on an electroconductive support in the same manner as in Example 9.

10 parts by weight of tin oxide particles (S-2000, produced by Mitsubishi Materials Corp.), 0.5 part by weight of trifluoropropyltrimethoxysilane and 50 parts by weight of toluene are mixed and agitated under heating to 90° C. for 2 hours, and after distilling off toluene, heated to 130° C. for 1 hour, to surface-treat the tin oxide particles.

2.5 parts by weight of the compound (VI-3) in Table 56, 3 parts by weight of a phenol resin (PL-4852, produced by Gunei Chemical Industry Co., Ltd.), 0.2 part by weight of 2,4,7,9-tetramethyl-5-decyn-4,7-diol (produced by Tokyo Kasei Kogyo Co., Ltd.) and 4.0 parts by weight of n-butanol (XVIII-2)

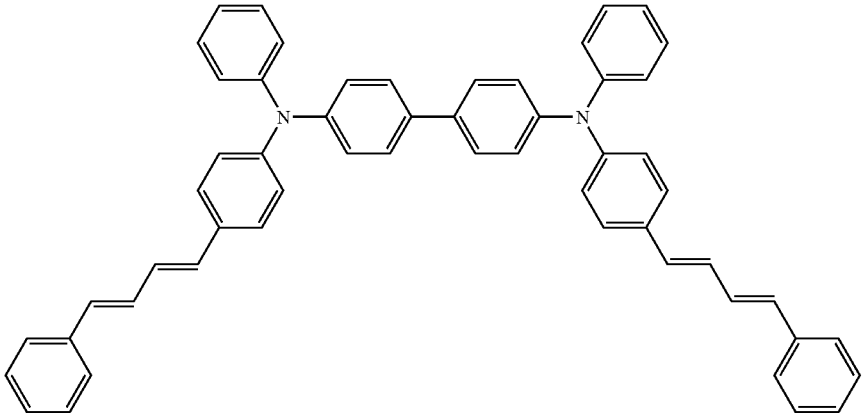

(XIX-2)

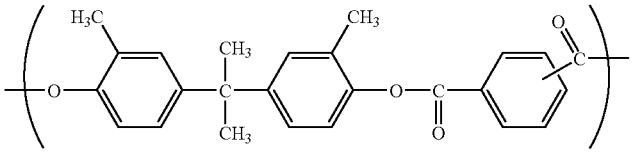

The resulting coating composition is coated on the charge generating layer by a dip coating method and dried by heating to 120° C. for 45 minutes to form a charge transporting layer having a thickness of 20 μm.

2.0 parts by weight of the compound (VI-3) in Table 56, 0.5 part by weight of the compound (VI-2) in Table 56, 3 parts by weight of a phenol resin (PL-4852, produced by Gunei Chemical Industry Co., Ltd.), 0.2 part by weight of 2,4,7,9-tetramethyl-5-decyn-4,7-diol (produced by Tokyo Kasei Kogyo Co., Ltd.) and 4.0 parts by weight of n-butanol are are mixed. 1 part by weight of the surface-treated tin oxide particles are mixed with the resulting mixture, which is dispersed with glass beads in a paint shaker for 1 hour. The glass beads are filtered off from the mixture having been subjected to the dispersion treatment to obtain a coating composition for forming a protective layer. The coating composition is coated on the charge transporting layer by a dip coating method, and the coated film is air-dried at room temperature for 30 minutes and then cured at 140° C. for 45 minutes to form a protective layer having a thickness of about 5 μm, whereby a target electrophotographic photoreceptor is obtained, which is hereinafter referred to as a photoreceptor 10.

The same operation is repeated in five times to obtain five photoreceptors 10, which are visually observed for surface state of the protective layer. The defective fraction is shown in Table 61.

Example 11

A photoreceptor is produced in the same manner as in Example 1 except that 0.2 part by weight of 2-propyn-1-ol (produced by Tokyo Chemical Industry Co., Ltd.) is added to the coating composition for forming a protective layer instead of 2,5-dimethyl-3-hexyn-2,5-diol, which is hereinafter referred to as a photoreceptor 11.

The same operation is repeated in five times to obtain five photoreceptors 11, which are visually observed for surface state of the protective layer. The defective fraction is shown in Table 61.

Comparative Example 1

A photoreceptor is produced in the same manner as in Example 1 except that 0.2 part by weight of 2,5-dimethyl-3-hexyn-2,5-diol (produced by Tokyo Chemical Industry Co., Ltd.) is not added to the coating composition for forming a protective layer, which is hereinafter referred to as a comparative photoreceptor 1.

The same operation is repeated in five times to obtain five comparative photoreceptors 1, which are visually observed for surface state of the protective layer. The defective fraction is shown in Table 61.

Comparative Example 2

A photoreceptor is produced in the same manner as in Example 1 except that 0.2 part by weight of ethylene glycol (produced by Tokyo Chemical Industry Co., Ltd.) is added to the coating composition for forming a protective layer instead of 2,5-dimethyl-3-hexyn-2,5-diol, which is hereinafter referred to as a comparative photoreceptor 2.

The same operation is repeated in five times to obtain five comparative photoreceptors 2, which are visually observed for surface state of the protective layer. The defective fraction is shown in Table 61.

TABLE 61

| | Photoreceptor | Defective fraction of coated film |
|---|---|---|
| Example 1 | photoreceptor 1 | 0/5 |
| Example 2 | photoreceptor 2 | 0/5 |
| Example 3 | photoreceptor 3 | 0/5 |
| Example 4 | photoreceptor 4 | 0/5 |
| Example 5 | photoreceptor 5 | 0/5 |
| Example 6 | photoreceptor 6 | 0/5 |
| Example 7 | photoreceptor 7 | 0/5 |
| Example 8 | photoreceptor 8 | 0/5 |
| Example 9 | photoreceptor 9 | 0/5 |
| Example 10 | photoreceptor 10 | 0/5 |
| Example 11 | photoreceptor 11 | 0/5 |
| Comparative Example 1 | comparative photoreceptor 1 | 4/5 |
| Comparative Example 2 | comparative photoreceptor 2 | 3/5 |

Examples 12 to 22 and Comparative Examples 3 to 6

In Examples 12 to 22 and Comparative Examples 3 to 6, image forming apparatuses having the constitution shown in FIG. 1 are produced by using the photoreceptors 1 to 11 and the comparative photoreceptors 1 and 2, respectively. In Comparative Examples 3 and 4, a photoreceptor having no defect in the coated film among the comparative photoreceptors 1 obtained in Comparative Example 1 (which is hereinafter referred to as a comparative photoreceptor 1*a*) and a photoreceptor having defects in the coated film among them (which is hereinafter referred to as a comparative photoreceptor 1*b*) are used, respectively. Similarly, in Comparative Examples 5 and 6, a photoreceptor having no defect in the coated film among the comparative photoreceptors 2 obtained in Comparative Example 2 (which is hereinafter referred to as a comparative photoreceptor 2*a*) and a photoreceptor having defects in the coated film among them (which is hereinafter referred to as a comparative photoreceptor 2*b*) are used, respectively. The other constitutional elements of the apparatus than the electrophotographic photoreceptor are the same as in DocuCentre Color 400CP, a printer, produced by Fuji Xerox Co., Ltd.

The image forming apparatuses are subjected to an image formation test (image density: ca. 10%) of 5,000 sheets under a high temperature and high humidity environment (27° C., 85% RH), and then subjected to an image formation test (image density: ca. 10%) of 5,000 sheets under a low temperature and low humidity environment (10° C., 25% RH). After completing the test, the presence of scratches and attachments on the surface of the electrophotographic photoreceptor (surface of the protective layer) is evaluated. The cleaning property of the toner (contamination of the charging device and deterioration in image quality due to cleaning failure) and the image quality (reproducibility of 45° oblique 1-dot thin lines) are evaluated under the environments. The results obtained are shown in Table 62.

The presence of scratches on the photoreceptor is determined visually and evaluated based on the following evaluation standard.

A: no scratch

B: scratches found partially (with no problem in image quality)

C: scratches found (with problem in image quality)

The presence of attachments on the photoreceptor is determined visually and evaluated based on the following evaluation standard.

A: no attachment

B: attachments found partially (with no problem in image quality)

C: attachments found (with problem in image quality)

the cleaning property is determined visually and evaluated based on the following evaluation standard.

A: good

B: image defects, e.g., lines, found partially (with no problem in image quality)

C: image defects found broadly (with problem in image quality)

The image quality is determined with a magnifying glass and evaluated based on the following evaluation standard.

A: good

B: defects found partially (with no problem in image quality)

C: defects found (with problem in image quality)

TABLE 62

| | | High temperature and high humidity | | | Low temperature and low humidity | | | | |
|---|---|---|---|---|---|---|---|---|---|
| | | Image quality | | | Image quality | | | | |
| | Photoreceptor | Initial | After 5,000 sheets | Cleaning property | Initial | After 5,000 sheets | Cleaning property | Scratches on photo-receptor | Attachments on photo-receptor |
| Example 12 | photoreceptor 1 | A | A | A | A | A | B | B | A |
| Example 13 | photoreceptor 2 | A | A | A | A | A | A | A | A |
| Example 14 | photoreceptor 3 | A | A | A | A | A | A | B | B |
| Example 15 | photoreceptor 4 | A | A | A | A | A | A | B | B |
| Example 16 | photoreceptor 5 | A | A | A | A | A | A | A | A |
| Example 17 | photoreceptor 6 | A | A | A | A | A | A | A | A |
| Example 18 | photoreceptor 7 | A | A | A | A | A | A | A | A |
| Example 19 | photoreceptor 8 | A | A | A | A | A | A | A | A |
| Example 20 | photoreceptor 9 | A | A | A | A | A | A | A | A |
| Example 21 | photoreceptor 10 | A | A | A | A | A | A | A | A |
| Example 22 | photoreceptor 11 | A | A | B | A | A | B | B | B |
| Comparative Example 3 | comparative photoreceptor 1a | A | C | B | B | B | B | B | B |
| Comparative Example 4 | comparative photoreceptor 1b | B | C | C | B | C | C | C | C |
| Comparative Example 5 | comparative photoreceptor 2a | A | C | B | B | B | B | B | B |
| Comparative Example 6 | comparative photoreceptor 2b | B | B | C | B | C | C | C | C |

What is claimed is:

1. An electrophotographic photoreceptor comprising: an electroconductive support; and a photosensitive layer on the electroconductive support, wherein the photosensitive layer comprises a functional layer, the functional layer comprising: a compound having a triple bond and a hydroxyl group in a molecule; and a cured product of a curable resin, wherein the compound having a triple bond and a hydroxyl group is at least one compound selected from the group consisting of 2-propyn-1-ol, 1-butyn-3-ol, 2-butyn-1-ol, 3-butyn-1-ol, 1-pentyn-3-ol, 2-pentyn-1-ol, 3-pentyn-1-ol, 4-pentyn-1-ol, 4-pentyn-2-ol, 1-hexyn-3-ol, 2-hexyn-1-ol, 3-hexyn-1-ol, 5-hexyn-1-ol, 5-hexyn-3-ol, 1-heptyn-3-ol, 2-heptyn-1-ol, 3-heptyn-1-ol, 4-heptyn-2-ol, 5-heptyn-3-ol, 1-octyn-3-ol, 3-octyn-1-ol, 3-nonyn-1-ol, 2-decyn-1-ol, 3-decyn-1-ol, 10-undecyn-1-ol, 3-methyl-1-butyn-3-ol, 3-methyl-1-penten-4-yn-3-ol, 3-methyl-1-pentyn-3-ol, 5-methyl-1-hexyn-3-ol, 3-ethyl-1-pentyn-3-ol, 3-ethyl-1-heptyn-3-ol, 4-ethyl-1-octyn-3-ol, 3,4-dimethyl-1-pentyn-3-ol, 3,5-dimethyl-1-hexyn-3-ol, 3,6-dimethyl-1-heptyn-3-ol, 2,2,8,8-tetramethyl-3,6-nonadiyn-5-ol, 4,6-nonadecadiyn-1-ol, 10,12-pentacosadiyn-1-ol, 2-butyn-1,4-diol, 3-hexyn-2,5-diol, 2,4-hexadiyn-1,6-diol, 2,5-dimethyl-3-hexyn-2,5-diol, 3,6-dimethyl-4-octyn-3,6-diol, 2,4,7,9-tetramethyl-5-decyn-4,7-diol, (+)-1,6-bis(2-chlorophenyl)-1,6-diphenyl-2,4-hexadiyn-1,6-diol, (−)-1,6-bis(2-chlorophenyl)-1,6-diphenyl-2,4-hexadiyn-1,6-diol, 2-butyn-1,4-diol bis(2-hydroxyethyl), 1,4-diacetoxy-2-butyn-4-diethylamino-2-butyn-1-ol, 1,1-diphenyl-2-propyn-1-ol, 1-ethynyl-1-cyclohexanol, 9-ethynyl-9-fluorenol, 2,4-hexadiyndiyl-1,6-bis(4-phenylazobenzene sulfonate), ethyl 2-hydroxy-3-butynoate, 2-methyl-4-phenyl-3-butyn-2-ol, methyl propargyl ether, 5-phenyl-4-pentyn-1-ol, 1-phenyl-1-propyn-3-ol, 1-phenyl-2-propyn-1-ol, 4-trimethylsilyl-3-butyn-2-ol, 3-trimethylsilyl-2-propyn-1-ol and a compound represented by fomula (XX-1) or (XX-2):

(XX-1)

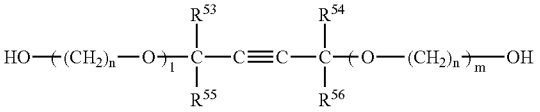

(XX-2)

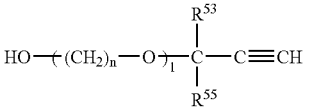

wherein $R^{53}$, $R^{54}$, $R^{55}$ and $R^{56}$ each independently represents a monovalent organic group, and 1, m and n each independently represents an integer.

2. The electrophotographic photoreceptor as claimed in claim 1, wherein the compound having a triple bond and a hydroxyl group is at least one compound selected from the group consisting of 2-propyn-1-ol, 3,5-dimethyl-1-hexyn-3-ol, 2,4-hexadiyn-1,6-diol, 2,5-dimethyl-3-hexyn-2,5-diol, 2,4,7,9-tetramethyl-5-decyn-4,7-diol and 4-trimethylsilyl-3-butyn-2-ol.

3. The electrophotographic photoreceptor as claimed in claim 1, wherein the compound having a triple bond and a hydroxyl group is a compound represented by formula (XX-1) or (XX-2):

(XX-1)

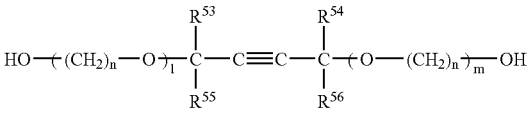

-continued (XX-2)

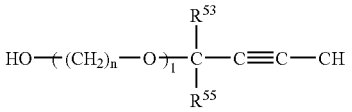

wherein $R^{53}$, $R^{54}$, $R^{55}$ and $R^{56}$ each independently represents a monovalent organic group, and l, m and n each independently represents an integer.

4. The electrophotographic photoreceptor as claimed in claim 1, wherein the curable resin is a phenol resin.

5. The electrophotographic photoreceptor as claimed in claim 1, wherein the functional layer further comprises electroconductive inorganic particles or a charge transporting organic compound.

6. The electrophotographic photoreceptor as claimed in claim 5, wherein the functional layer comprises, as the charge transporting organic compound, a compound having a structure represented by one of formulae (I) to (VI):

$$F—((X^1)_{n1}R^1—Z^1H)_{m1} \quad (I)$$

wherein F represents an organic group derived from a compound having a hole transporting function; $R^1$ represents an alkylene group; $Z^1$ represents an oxygen atom, a sulfur atom, NH or COO; $X^1$ represents an oxygen atom or a sulfur atom; m1 represents an integer of from 1 to 4; and n1 represents 0 or 1, $$F—((X^2)_{n2}—(R^2)_{n3}—(Z^2)_{n4}G)_{n5} \quad (II)$$

wherein F represents an organic group derived from a compound having a hole transporting function; $X^2$ represents an oxygen atom or a sulfur atom; $R^2$ represents an alkylene group; $Z^2$ represents an oxygen atom, a sulfur atom, NH or COO; G represents an epoxy group; n2, n3 and n4 each independently represents 0 or 1; and n5 represents an integer of from 1 to 4, $$F(\text{-}D\text{-}Si(R^3)_{(3-a)}Q_a)_b \quad (III)$$

wherein F represents a b-valent organic group derived from a compound having a hole transporting function; D represents a divalent group having flexibility; $R^3$ represents a hydrogen atom, a substituted or unsubstituted alkyl group or a substituted or unsubstituted aryl group; Q represents a hydrolyzable group; a represents an integer of from 1 to 3; and b represents an integer of from 1 to 4, (IV)

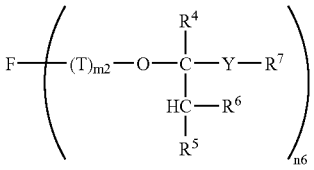

wherein F represents an organic group derived from a compound having a hole transporting function; T represents a divalent group; Y represents an oxygen atom or a sulfur atom; $R^4$, $R^5$ and $R^6$ each independently represents a hydrogen atom or a monovalent organic group; $R^7$ represents a monovalent organic group; m2 represents 0 or 1; n6 represents an integer of from 1 to 4, provided that $R^6$ and $R^7$ may be bonded to each other to form a heterocyclic ring containing Y as a heteroatom, (V)

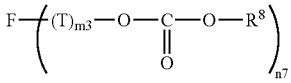

wherein F represents an organic group derived from a compound having a hole transporting function; T represents a divalent group; $R^8$ represents a monovalent organic group; m3 represents 0 or 1; and n7 represents an integer of from 1 to 4, and (VI)

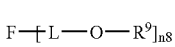

wherein F represents an organic group derived from a compound having a hole transporting function; L represents an alkylene group; $R^9$ represents a monovalent organic group; and n8 represents an integer of from 1 to 4.

7. An electrophotographic photoreceptor comprising: an electroconductive support; and a photosensitive layer on the electroconductive support, wherein the photosensitive layer comprises a functional layer, the functional layer being obtained by curing a curable resin composition comprising a compound having a triple bond and a hydroxyl group in a molecule and a curable resin, wherein the compound having a triple bond and a hydroxyl group is at least one compound selected from the group consisting of 2-propyn-1-ol, 1-butyn-3-ol, 2-butyn-1-ol, 3-butyn-1-ol, 1-pentyn-3-ol, 2-pentyn-1-ol, 3-pentyn-1-ol, 4-pentyn-1-ol, 4-pentyn-2-ol, 1-hexyn-3-ol, 2-hexyn-1-ol, 3-hexyn-1-ol, 5-hexyn-1-ol, 5-hexyn-3-ol, 1-heptyn-3-ol, 2-heptyn-1-ol, 3-heptyn-1-ol, 4-heptyn-2-ol, 5-heptyn-3-ol, 1-octyn-3-ol, 3-octyn-1-ol, 3-nonyn-1-ol, 2-decyn-1-ol, 3-decyn-1-ol, 10-undecyn-1-ol, 3-methyl-1-butyn-3-ol, 3-methyl-1-penten-4-yn-3-ol, 3-methyl-1-pentyn-3-ol, 5-methyl-1-hexyn-3-ol, 3-ethyl-1-pentyn-3-ol, 3-ethyl-1-heptyn-3-ol, 4-ethyl-1-octyn-3-ol, 3,4-dimethyl-1-pentyn-3-ol, 3,5-dimethyl-1-hexyn-3-ol, 3,6-dimethyl-1-heptyn-3-ol, 2,2,8,8-tetramethyl-3,6-nonadiyn-5-ol, 4,6-nonadecadiyn-1-ol, 10,12-pentacosadiyn-1-ol, 2-butyn-1,4-diol, 3-hexyn-2,5-diol, 2,4-hexadiyn-1,6-diol, 2,5-dimethyl-3-hexyn-2,5-diol, 3,6-dimethyl-4-octyn-3,6-diol, 2,4,7,9-tetramethyl-5-decyn-4,7-diol, (+)-1,6-bis(2-chlorophenyl)-1,6-diphenyl-2,4-hexadiyn-1,6-diol, (−1,6-bis(2-chlorophenyl)-1,6-diphenyl-2,4-hexadiyn-1,6-diol, 2-butyn-1,4-diol bis(2-hydroxyethyl), 1,4-diacetoxy-2-butyn-4-diethylamino-2-butyn-1-ol, 1,1-diphenyl-2-propyn-1-ol, 1-ethynyl-1-cyclohexanol, 9-ethynyl-9-fluorenol, 2,4-hexadiyndiyl-1,6-bis(4-phenylazobenzene sulfonate), ethyl 2-hydroxy-3-butynoate, 2-methyl-4-phenyl-3-butyn-2-ol, methyl propargyl ether, 5-phenyl-4-pentyn-1-ol, 1-phenyl-1-propyn-3-ol, 1-phenyl-2-propyn-1-ol, 4-trimethylsilyl-3-butyn-2-ol, 3-trimethylsilyl-2-propyn-1-ol and a compound represented by fomula (XX-1) or (XX-2):

(XX-1)

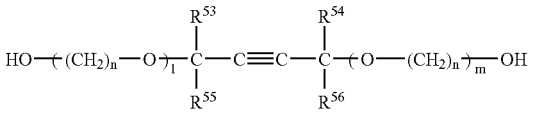

(XX-2)

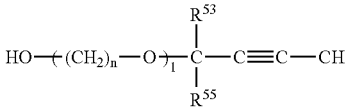

wherein $R^{53}$, $R^{54}$, $R^{55}$ and $R^{56}$ each independently represents a monovalent organic group, and l, m and n each independently represents an integer.

8. The electrophotographic photoreceptor as claimed in claim 7, wherein the compound having a triple bond and a hydroxyl group is at least one compound selected from the group consisting of 2-propyn-1-ol, 3,5-dimethyl-1-hexyn-3-ol, 2,4-hexadiyn-1,6-diol, 2,5-dimethyl-3-hexyn-2,5-diol, 2,4,7,9-tetramethyl-5-decyn-4,7-diol and 4-trimethylsilyl-3-butyn-2-ol.

9. The electrophotographic photoreceptor as claimed in claim 7, wherein the compound having a triple bond and a hydroxyl group is a compound represented by formula (XX-1) or (XX-2):

(XX-1)

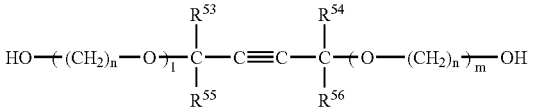

(XX-2)

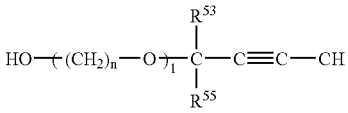

wherein $R^{53}$, $R^{54}$, $R^{55}$ and $R^{56}$ each independently represents a monovalent organic group, and l, m and n each independently represents an integer.

10. The electrophotographic photoreceptor as claimed in claim 7, wherein the curable resin is a phenol resin.

11. The electrophotographic photoreceptor as claimed in claim 7, wherein the functional layer further comprises electroconductive inorganic particles or a charge transporting organic compound.

12. The electrophotographic photoreceptor as claimed in claim 11, wherein the functional layer comprises, as the charge transporting organic compound, a compound having a structure represented by one of formulae (I) to (VI):

$$F-((X^1)_{n1}R^1-Z^1H)_{m1} \quad (I)$$

wherein F represents an organic group derived from a compound having a hole transporting function; $R^1$ represents an alkylene group; $Z^1$ represents an oxygen atom, a sulfur atom, NH or COO; $X^1$ represents an oxygen atom or a sulfur atom; m1 represents an integer of from 1 to 4; and n1 represents 0 or 1, $$F-((X^2)_{n2}-(R^2)_{n3}-(Z^2)_{n4}G)_{n5} \quad (II)$$

wherein F represents an organic group derived from a compound having a hole transporting function; $X^2$ represents an oxygen atom or a sulfur atom; $R^2$ represents an alkylene group; $Z^2$ represents an oxygen atom, a sulfur atom, NH or COO; G represents an epoxy group; n2, n3 and n4 each independently represents 0 or 1; and n5 represents an integer of from 1 to 4, $$F(-D-Si(R^3)_{(3-a)}Q_a)_b \quad (III)$$

wherein F represents a b-valent organic group derived from a compound having a hole transporting function; D represents a divalent group having flexibility; $R^3$ represents a hydrogen atom, a substituted or unsubstituted alkyl group or a substituted or unsubstituted aryl group; Q represents a hydrolyzable group; a represents an integer of from 1 to 3; and b represents an integer of from 1 to 4, (IV)

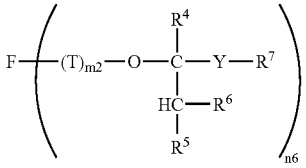

wherein F represents an organic group derived from a compound having a hole transporting function; T represents a divalent group; Y represents an oxygen atom or a sulfur atom; $R^4$, $R^5$ and $R^6$ each independently represents a hydrogen atom or a monovalent organic group; $R^7$ represents a monovalent organic group; m2 represents 0 or 1; n6 represents an integer of from 1 to 4, provided that $R^6$ and $R^7$ may be bonded to each other to form a heterocyclic ring containing Y as a heteroatom, (V)

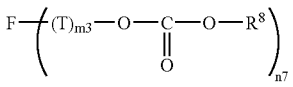

wherein F represents an organic group derived from a compound having a hole transporting function; T represents a divalent group; $R^8$ represents a monovalent organic group; m3 represents 0 or 1; and n7 represents an integer of from 1 to 4, and (VI)

wherein F represents an organic group derived from a compound having a hole transporting function; L represents an alkylene group; $R^9$ represents a monovalent organic group; and n8 represents an integer of from 1 to 4.

13. An image forming apparatus comprising: an electrophotographic photoreceptor comprising: an electroconductive support; and a photosensitive layer on the electroconductive support, wherein the photosensitive layer comprises a functional layer, the functional layer comprising: a compound having a triple bond and a hydroxyl group in a molecule; and a cured product of a curable resin; a charging unit that charges the electrophotographic photoreceptor; an exposing unit that exposes the charged electrophotographic photoreceptor to form an electrostatic latent image; a developing unit that develops the electrostatic latent image with a toner to form a toner image; and a transferring unit that transfers the toner image to a transfer medium, wherein the compound having a triple bond and a hydroxyl group is at least one compound selected from the group consisting of 2-propyn-1-ol, 1-butyn-3-ol, 2-butyn-1-ol, 3-butyn-1-ol, 1-pentyn-3-ol, 2-pentyn-1-ol, 3-pentyn-1-ol, 4-pentyn-1-ol, 4-pentyn-2-ol, 1-hexyn-3-ol, 2-hexyn-1-ol, 3-hexyn-1-ol, 5-hexyn-1-ol, 5-hexyn-3-ol, 1-heptyn-3-ol, 2-heptyn-1-ol, 3-heptyn-1-ol, 4-heptyn-2-ol, 5-heptyn-3-ol, 1-octyn-3-ol, 3-octyn-1-ol, 3-nonyn-1-ol, 2-decyn-1-ol, 3-decyn-1-ol, 10-undecyn-1-ol, 3-methyl-1-butyn-3-ol, 3-methyl-1-penten-4-yn-3-ol, 3-methyl-1-pentyn-3-ol, 5-methyl-1-hexyn-3-ol, 3-ethyl-1-pentyn-3-ol, 3-ethyl-1-heptyn-3-ol, 4-ethyl-1-octyn-3-ol, 3,4-dimethyl-1-pentyn-3-ol, 3,5-dimethyl-1-hexyn-3-ol, 3,6-dimethyl-1-heptyn-3-ol, 2,2,8,8-tetramethyl-3,6-nonadiyn-5-ol, 4,6-nonadecadiyn-1-ol, 10,12-pentacosadiyn-1-ol, 2-butyn-1,4-diol, 3-hexyn-2,5-diol, 2,4-hexadiyn-1,6-diol, 2,5-dimethyl-3-hexyn-2,5-diol, 3,6-dimethyl-4-octyn-3,6-diol, 2,4,7,9-tetramethyl-5-decyn-4,7-diol, (+)-1,6-bis(2-chlorophenyl)-1,6-diphenyl-2,4-hexadiyn-1,6-diol, (−)-1,6-bis(2-chlorophenyl)-1,6-diphenyl-2,4-hexadiyn-1,6-diol, 2-butyn-1,4-diol bis(2-hydroxyethyl), 1,4-diacetoxy-2-butyn-4-diethylamino-2-butyn-1-ol, 1,1-diphenyl-2-propyn-1-ol, 1-ethynyl-1-cyclohexanol, 9-ethynyl-9-fluorenol, 2,4-hexadiyndiyl-1,6-bis(4-phenylazobenzene sulfonate), ethyl 2-hydroxy-3-butynoate, 2-methyl-4-phenyl-3-butyn-2-ol, methyl propargyl ether, 5-phenyl-4-pentyn-1-ol, 1-phenyl-1-propyn-3-ol, 1-phenyl-2-propyn-1-ol, 4-trimethylsilyl-3-butyn-2-ol, 3-trimethylsilyl-2-propyn-1-ol and a compound represented by fomula (XX-1) or (XX-2):

(XX-1)

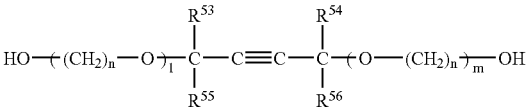

(XX-2)

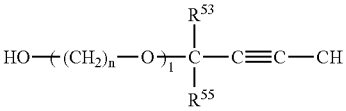

wherein $R^{53}$, $R^{54}$, $R^{55}$ and $R^{56}$ each independently represents a monovalent organic group, and l, m and n each independently represents an integer.

14. An image forming apparatus comprising: an electrophotographic photoreceptor comprising: an electroconductive support; and a photosensitive layer on the electroconductive support, wherein the photosensitive layer comprises a functional layer, the functional layer being obtained by curing a curable resin composition comprising a compound having a triple bond and a hydroxyl group in a molecule and a curable resin a charging unit that charges the electrophotographic photoreceptor; an exposing unit that exposes the charged electrophotographic photoreceptor to form an electrostatic latent image; a developing unit that develops the electrostatic latent image with a toner to form a toner image; and a transferring unit that transfers the toner image to a transfer medium, wherein the compound having a triple bond and a hydroxyl group is at least one compound selected from the group consisting of 2-propyn-1-ol, 1-butyn-3-ol, 2-butyn-1-ol, 3-butyn-1-ol, 1-pentyn-3-ol, 2-pentyn-1-ol, 3-pentyn-1-ol, 4-pentyn-1-ol, 4-pentyn-2-ol, 1-hexyn-3-ol, 2-hexyn-1-ol, 3-hexyn-1-ol, 5-hexyn-1-ol, 5-hexyn-3-ol, 1-heptyn-3-ol, 2-heptyn-1-ol, 3-heptyn-1-ol, 4-heptyn-2-ol, 5-heptyn-3-ol, 1-octyn-3-ol, 3-octyn-1-ol, 3-nonyn-1-ol, 2-decyn-1-ol, 3-decyn-1-ol, 10-undecyn-1-ol, 3-methyl-1-butyn-3-ol, 3-methyl-1-penten-4-yn-3-ol, 3-methyl-1-pentyn-3-ol, 5-methyl-1-hexyn-3-ol, 3-ethyl-1-pentyn-3-ol, 3-ethyl-1-heptyn-3-ol, 4-ethyl-1-octyn-3-ol, 3,4-dimethyl-1-pentyn-3-ol, 3,5-dimethyl-1-hexyn-3-ol, 3,6-dimethyl-1-heptyn-3-ol, 2,2,8,8-tetramethyl-3,6-nonadiyn-5-ol, 4,6-nonadecadiyn-1-ol, 10,12-pentacosadiyn-1-ol, 2-butyn-1,4-diol, 3-hexyn-2,5-diol, 2,4-hexadiyn-1,6-diol, 2,5-dimethyl-3-hexyn-2,5-diol, 3,6-dimethyl-4-octyn-3,6-diol, 2,4,7,9-tetramethyl-5-decyn-4,7-diol, (+)-1,6-bis(2-chlorophenyl)-1,6-diphenyl-2,4-hexadiyn-1,6-diol, (−)-1,6-bis(2-chlorophenyl)-1,6-diphenyl-2,4-hexadiyn-1,6-diol, 2-butyn-1,4-diol bis(2-hydroxyethyl), 1,4-diacetoxy-2-butyn-4-diethylamino-2-butyn-1-ol, 1,1-diphenyl-2-propyn-1-ol, 1-ethynyl-1-cyclohexanol, 9-ethynyl-9-fluorenol, 2,4-hexadiyndiyl-1,6-bis(4-phenylazobenzene sulfonate), ethyl 2-hydroxy-3-butynoate, 2-methyl-4-phenyl-3-butyn-2-ol, methyl propargyl ether, 5-phenyl-4-pentyn-1-ol, 1-phenyl-1-propyn-3-ol, 1-phenyl-2-propyn-1-ol, 4-trimethylsilyl-3-butyn-2-ol, 3-trimethylsilyl-2-propyn-1-ol and a compound represented by fomula (XX-1) or (XX-2):

(XX-1)

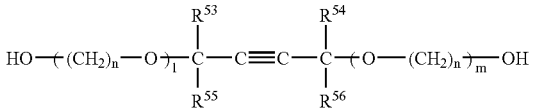

(XX-2)

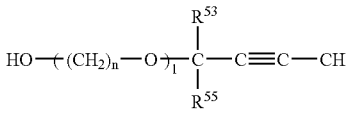

wherein $R^{53}$, $R^{54}$, $R^{55}$ and $R^{56}$ each independently represents a monovalent organic group, and l, m and n each independently represents an integer.

15. A process cartridge comprising: an electrophotographic photoreceptor comprising: an electroconductive support; and a photosensitive layer on the electroconductive support, wherein the photosensitive layer comprises a functional layer, the functional layer comprising: a compound having a triple bond and a hydroxyl group in a molecule; and a cured product of a curable resin; at least one member selected from: a charging unit that charges the electrophotographic photoreceptor; a developing unit that develops an electrostatic latent image formed on the electrophotographic photoreceptor, with a toner to form a toner image; and a cleaning unit that removes a toner remaining on a surface of the electrophotographic photoreceptor after transferring, wherein the compound having a triple bond and a hydroxyl group is at least one compound selected from the group consisting of 2-propyn-1-ol, 1-butyn-3-ol, 2-butyn-1-ol, 3-butyn-1-ol, 1-pentyn-3-ol, 2-pentyn-1-ol, 3-pentyn-1-ol, 4-pentyn-1-ol, 4-pentyn-2-ol, 1-hexyn-3-ol, 2-hexyn-1-ol, 3-hexyn-1-ol, 5-hexyn-1-ol, 5-hexyn-3-ol, 1-heptyn-3-ol, 2-heptyn-1-ol, 3-heptyn-1-ol, 4-heptyn-2-ol, 5-heptyn-3-ol, 1-octyn-3-ol, 3-octyn-1-ol, 3-nonyn-1-ol, 2-decyn-1-ol, 3-decyn-1-ol, 10-undecyn-1-ol, 3-methyl-1-butyn-3-ol, 3-methyl-1-penten-4-yn-3-ol, 3-methyl-1-pentyn-3-ol, 5-methyl-1-hexyn-3-ol, 3-ethyl-1-pentyn-3-ol, 3-ethyl-1-heptyn-3-ol, 4-ethyl-1-octyn-3-ol, 3,4-dimethyl-1-pentyn-3-ol, 3,5-dimethyl-1-hexyn-3-ol, 3,6-dimethyl-1-heptyn-3-ol, 2,2,8,8-tetramethyl-3,6-nonadiyn-5-ol, 4,6-nonadecadiyn-1-ol, 10,12-pentacosadiyn-1-ol, 2-butyn-1,4-diol, 3-hexyn-2,5-diol, 2,4-hexadiyn-1,6-diol, 2,5-dimethyl-3-hexyn-2,5-diol, 3,6-dimethyl-4-octyn-3,6-diol, 2,4,7,9-tetramethyl-5-decyn-4,7-diol, (+)-1,6-bis(2-chlorophenyl)-1,6-diphenyl-2,4-hexadiyn-1,6-diol, (−)-1,6-bis(2-chlorophenyl)-1,6-diphenyl-2,4-hexadiyn-1,6-diol, 2-butyn-1,4-diol bis(2-hydroxyethyl), 1,4-diacetoxy-2-butyn-4-diethylamino-2-butyn-1-ol, 1,1-diphenyl-2-propyn-1-ol, 1-ethynyl-1-cyclohexanol, 9-ethynyl-9-fluorenol, 2,4-hexadiyndiyl-1,6-bis(4-phenylazobenzene sulfonate), ethyl 2-hydroxy-3-butynoate, 2-methyl-4-phenyl-3-butyn-2-ol, methyl propargyl ether, 5-phenyl-4-pentyn-1-ol, 1-phenyl-1-propyn-3-ol, 1-phenyl-2-propyn-1-ol, 4-trimethylsilyl-3-butyn-2-ol, 3-trimethylsilyl-2-propyn-1-ol and a compound represented by fomula (XX-1) or (XX-2):

(XX-1)

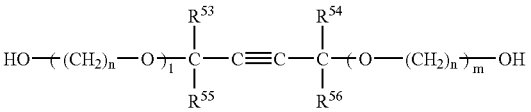

(XX-2)

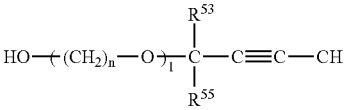

wherein $R^{53}$, $R^{54}$, $R^{55}$ and $R^{56}$ each independently represents a monovalent organic group, and l, m and n each independently represents an integer.

16. A process cartridge comprising: an electrophotographic photoreceptor comprising: an electroconductive support; and a photosensitive layer on the electroconductive support, wherein the photosensitive layer comprises a functional layer, the functional layer being obtained by curing a curable resin composition comprising a compound having a triple bond and a hydroxyl group in a molecule and a curable resin at least one member selected from: a charging unit that charges the electrophotographic photoreceptor; a developing unit that develops an electrostatic latent image formed on the electrophotographic photoreceptor, with a toner to form a toner image; and a cleaning unit that removes a toner remaining on a surface of the electrophotographic photoreceptor after transferring, wherein the compound having a triple bond and a hydroxyl group is at least one compound selected from the group consisting of 2-propyn-1-ol, 1-butyn-3-ol, 2-butyn-1-ol, 3-butyn-1-ol, 1-pentyn-3-ol, 2-pentyn-1-ol, 3-pentyn-1-ol, 4-pentyn-1-ol, 4-pentyn-2-ol, 1-hexyn-3-ol, 2-hexyn-1-ol, 3-hexyn-1-ol, 5-hexyn-1-ol, 5-hexyn-3-ol, 1-heptyn-3-ol, 2-heptyn-1-ol, 3-heptyn-1-ol, 4-heptyn-2-ol, 5-heptyn-3-ol, 1-octyn-3-ol, 3-octyn-1-ol, 3-nonyn-1-ol, 2-decyn-1-ol, 3-decyn-1-ol, 10-undecyn-1-ol, 3-methyl-1-butyn-3-ol, 3-methyl-1-penten-4-yn-3-ol, 3-methyl-1-pentyn-3-ol, 5-methyl-1-hexyn-3-ol, 3-ethyl-1-pentyn-3-ol, 3-ethyl-1-heptyn-3-ol, 4-ethyl-1-octyn-3-ol, 3,4-dimethyl-1-pentyn-3-ol, 3,5-dimethyl-1-hexyn-3-ol, 3,6-dimethyl-1-heptyn-3-ol, 2,2,8,8-tetramethyl-3,6-nonadiyn-5-ol, 4,6-nonadecadiyn-1-ol, 10,12-pentacosadiyn-1-ol, 2-butyn-1,4-diol, 2,4-hexadiyn-1,6-diol, 2,5-dimethyl-3-hexyn-2,5-diol, 3,6-dimethyl-4-octyn-3,6-diol, 2,4,7,9-tetramethyl-5-decyn-4,7-diol, (+)-1,6-bis(2-chlorophenyl)-1,6-diphenyl-2,4-hexadiyn-1,6-diol, (−)-1,6-bis(2-chlorophenyl)-1,6-diphenyl-2,4-hexadiyn-1,6-diol, 2-butyn-1,4-diol bis(2-hydroxyethyl), 1,4-diacetoxy-2-butyn-4-diethylamino-2-butyn-1-ol, 1,1-diphenyl-2-propyn-1-ol, 1-ethynyl-1-cyclohexanol, 9-ethynyl-9-fluorenol, 2,4-hexadiyndiyl-1,6-bis(4-phenylazobenzene sulfonate), ethyl 2-hydroxy-3-butynoate, 2-methyl-4-phenyl-3-butyn-2-ol, methyl propargyl ether, 5-phenyl-4-pentyn-1-ol, 1-phenyl-1-propyn-3-ol, 1-phenyl-2-propyn-1-ol, 4-trimethylsilyl-3-butyn-2-ol, 3-trimethylsilyl-2-propyn-1-ol and a compound represented by fomula (XX-1) or (XX-2):

(XX-1)

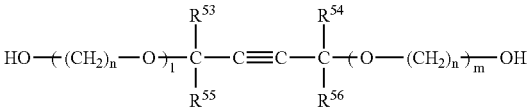

(XX-2)

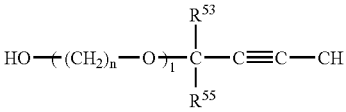

wherein $R^{53}$, $R^{54}$, $R^{55}$ and $R^{56}$ each independently represents a monovalent organic group, and l, m and n each independently represents an integer.

* * * * *